United States Patent [19]

Ogawa et al.

[11] 4,452,874

[45] Jun. 5, 1984

[54] PHOTOCONDUCTIVE MEMBER WITH MULTIPLE AMORPHOUS SI LAYERS

[75] Inventors: Kyosuke Ogawa, Tokyo; Shigeru Shirai, Yamato; Junichiro Kanbe, Yokohama; Keishi Saitoh, Tokyo; Yoichi Osato, Yokohama; Teruo Misumi, Kawasaki, all of Japan

[73] Assignee: Canon Kabushiki Kaisha, Tokyo, Japan

[21] Appl. No.: 463,043

[22] Filed: Feb. 1, 1983

[30] Foreign Application Priority Data

| | | | |
|---|---|---|---|
| Feb. 8, 1982 | [JP] | Japan | 57-18416 |
| Feb. 8, 1982 | [JP] | Japan | 57-18417 |
| Feb. 8, 1982 | [JP] | Japan | 57-18418 |
| Feb. 8, 1982 | [JP] | Japan | 57-18419 |
| Feb. 10, 1982 | [JP] | Japan | 57-20989 |
| Feb. 12, 1982 | [JP] | Japan | 57-21594 |
| Feb. 12, 1982 | [JP] | Japan | 57-21595 |
| Feb. 12, 1982 | [JP] | Japan | 57-21596 |
| Feb. 12, 1982 | [JP] | Japan | 57-21597 |
| Feb. 13, 1982 | [JP] | Japan | 57-21716 |
| Feb. 13, 1982 | [JP] | Japan | 57-21717 |
| Feb. 15, 1982 | [JP] | Japan | 57-22416 |
| Feb. 25, 1982 | [JP] | Japan | 57-29731 |
| Feb. 25, 1982 | [JP] | Japan | 57-29732 |
| Feb. 25, 1982 | [JP] | Japan | 57-29733 |
| Feb. 25, 1982 | [JP] | Japan | 57-29734 |
| Feb. 26, 1982 | [JP] | Japan | 57-31238 |
| Feb. 26, 1982 | [JP] | Japan | 57-31235 |
| Feb. 26, 1982 | [JP] | Japan | 57-31236 |
| Feb. 26, 1982 | [JP] | Japan | 57-31237 |
| Mar. 1, 1982 | [JP] | Japan | 57-31937 |
| Mar. 1, 1982 | [JP] | Japan | 57-31938 |
| Mar. 1, 1982 | [JP] | Japan | 57-31939 |
| Mar. 1, 1982 | [JP] | Japan | 57-31940 |

[51] Int. Cl.[3] ..... G03G 5/082

[52] U.S. Cl. ..... 430/57; 430/60; 430/63; 430/65; 252/501.1; 427/74; 357/2

[58] Field of Search ..... 430/57, 60, 63, 65; 252/501.1; 427/74; 357/2

[56] References Cited

U.S. PATENT DOCUMENTS

| | | | |
|---|---|---|---|
| 3,210,184 | 10/1965 | Uhlig | 430/65 |
| 4,064,521 | 12/1977 | Carlson | 357/2 |
| 4,217,374 | 8/1980 | Ovshinsky et al. | 430/84 X |
| 4,226,898 | 10/1980 | Ovshinsky et al. | 430/84 X |
| 4,251,289 | 2/1981 | Moustakas et al. | 204/192 |
| 4,253,882 | 3/1981 | Dalal | 427/74 X |
| 4,265,991 | 5/1981 | Hirai et al. | 430/65 X |
| 4,289,822 | 9/1981 | Shimada et al. | 427/74 X |
| 4,317,844 | 3/1982 | Carlson | 427/39 |
| 4,328,258 | 5/1982 | Coleman | 427/39 |
| 4,359,512 | 11/1982 | Fukuda et al. | 430/57 |
| 4,359,514 | 11/1982 | Shimizu et al. | 430/65 |
| 4,378,417 | 3/1983 | Maruyama et al. | 430/57 |
| 4,394,426 | 7/1983 | Shimizu et al. | 430/65 |
| 4,409,308 | 10/1983 | Shimizu et al. | 430/60 |

FOREIGN PATENT DOCUMENTS

| | | | |
|---|---|---|---|
| 56-25743 | 3/1981 | Japan | 430/57 |
| 56-64347 | 6/1981 | Japan | 430/57 |

*Primary Examiner*—Roland E. Martin, Jr.

*Attorney, Agent, or Firm*—Fitzpatrick, Cella, Harper & Scinto

[57] ABSTRACT

A photoconductive member comprises a support for photoconductive member, an interface layer comprising an amorphous material represented by any of the formulas:

$$Si_aN_{1-a}\ (0.57<a<1) \quad (1)$$

$$(Si_bN_{1-b})_cH_{1-c}\ (0.6<b<1,\ 0.65\leqq c<1) \quad (2)$$

$$(Si_dN_{1-d})_e(X,\ H)_{1-e}\ (0.6<d<1,\ 0.8\leqq e<1) \quad (3)$$

(wherein X represents a halogen atom), a rectifying layer comprising an amorphous material containing atoms (A) belonging to the group III or the group V of the periodic table as constituent atoms in a matrix of silicon atoms, and an amorphous layer exhibiting photoconductivity comprising an amorphous material containing at least one of hydrogen atoms and halogen atoms as constituent atoms in a matrix of silicon atoms.

9 Claims, 6 Drawing Figures

PHOTOCONDUCTIVE MEMBER WITH MULTIPLE AMORPHOUS SI LAYERS

BACKGROUND OF THE INVENTION

1. Field of the Invention

This invention relates to a photoconductive member having sensitivity to electromagnetic waves such as light (herein used in a broad sense, including ultraviolet rays, visible light, infrared rays, X-rays and gamma-rays).

2. Description of the Prior Art

Photoconductive materials constituting photoconductive layers for solid state image pick-up devices, electrophotographic image forming members in the field of image formation, or manuscript reading devices, are required to have a high sensitivity, a high SN ratio [Photocurrent ($I_p$)/Dark current ($I_d$)], spectral characteristics matching to those of electromagnetic waves to be irradiated, a rapid response to light, a desired dark resistance value as well as no harm to human bodies during usage. Further, in a solid state image pick-up device, it is also required that the residual image should easily be treated within a predetermined time. In particular, in case of an image forming member for electrophotography to be assembled in an electrophotographic device to be used in an office as office apparatus, the aforesaid harmless characteristic is very important.

From the standpoint as mentioned above, amorphous silicon (hereinafter referred to as a-Si) has recently attracted attention as a photoconductive material. For example, German Laid-Open Patent Publication Nos. 2746967 and 2855718 disclose applications of a-Si for use in image forming members for electrophotography, and German Laid-Open Patent Publication No. 2933411 an application of a-Si for use in an electro-photoconverting reading device.

However, under the present situation, the photoconductive members having photoconductive layers constituted of conventional a-Si are further required to be improved in the overall characteristics including electrical, optical and photoconductive characteristics such as dark resistance value, photosensitivity and response to light, etc., and environmental characteristics during use, and further stability with lapse of time and durability.

For instance, when applied in an image forming member for electrophotography, at the dark portion, injection of charges from the support side cannot sufficiently be impeded; the image forming member employed is not free from some problems with respect to dielectric strength or durability against repeated continuous uses; or there occurred image defects commonly called as "black area" on the images transferred on a transfer paper which may be considered to be due to the local discharge destroying phenomenon, or so called image defects commonly called as "white line", which may be considered to be caused by, for example, scraping with a blade employed for cleaning. Also, when used in a highly humid atmosphere or immediately after being left to stand in a highly humid atmosphere for a long time, so called "unfocused image" was frequently observed in images obtained.

Further, when the layer thickness is as thick as ten and some microns or higher, there tend to occur such phenomena as loosening or peeling of layers off from the support surface or formation of cracks in the layers with lapse of time when left to stand after taking out from a vacuum deposition chamber for layer formation. These phenomenon will occur particularly frequently when the support is a drum-shaped support conventionally employed in the field of electrophotography. Thus, there are problems to be solved with respect to stability with lapse of time.

Thus, it is required in designing of a photoconductive material to make efforts to solve all of the problems as mentioned above along with the improvement in characteristics of a-Si materials per se.

In view of the above points, the present invention is achieved as a result of extensive studies made comprehensively from the standpoints of applicability and utility of a-Si as a photoconductive member for image forming members for electrophotography, solid state image pick-up devices, reading devices, etc. Now, a photoconductive member having a photoconductive layer which comprises an amorphous material containing at least one of hydrogen atom (H) and halogen atom (X) in a matrix of silicon atoms [hereinafter referred to comprehensively as a-Si (H,X)], so called hydrogenated amorphous silicon, halogenated amorphous silicon or halogen-containing hydrogenated amorphous silicon, which photoconductive member is prepared by designing so as to have a specific layer structure, is found to exhibit not only practically extremely excellent characteristics but also surpass the photoconductive members of the prior art in substantially all respects, especially markedly excellent characteristics as a photoconductive member for electrophotography. The present invention is based on such finding.

SUMMARY OF THE INVENTION

A primary object of the present invention is to provide a photoconductive member which is excellent in durability without causing deterioration phenomenon when used repeatedly and also excellent in dielectric strength.

Another object of the present invention is to provide a photoconductive member which is excellent in adhesion between a support and a layer provided on the support or between respective laminated layers, stable with closeness of structural arrangement and high in layer quality.

Still another object of the present invention is to provide a photoconductive member having sufficiently an ability to retain charges during charging treatment for formation of electrostatic images, when applied as an electrophotographic image forming member and having excellent electrophotographic characteristics, for which ordinary electrophotographic methods can very effectively be applied.

According to the present invention, there is provided a photoconductive member comprising a support for photoconductive member, an interface layer comprising an amorphous material represented by any of the formulas:

$$Si_aN_{1-a}(0.57>a>1) \quad (1)$$

$$(Si_bN_{1-b})_cH_{1-c}(0.6<b<1,\ 0.65\leqq c<1) \quad (2)$$

$$(Si_dN_{1-d})_e(X,H)_{1-e}(0.6<d<1,\ 0.8\leqq e<1) \quad (3)$$

(wherein X represents a halogen atom), a rectifying layer comprising an amorphous material containing atoms (A) belonging to the group III or the group V of the periodic table as constituent atoms in a matrix of silicon atoms, and an amorphous layer exhibiting photoconductivity comprising an amorphous material containing at least one of hydrogen atoms and halogen atoms as constituent atoms in a matrix of silicon atoms.

DETAILED DESCRIPTION OF THE PREFERRED EMBODIMENTS

Figure 1:
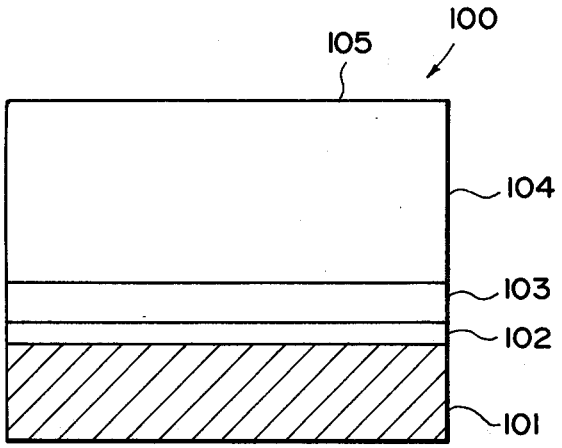
FIG. 1 through FIG. 4 are schematic sectional views for illustration of the layer constitutions of preferred embodiments of the photoconductive member according to the present invention, respectively.

FIG. 1 shows a schematic sectional view for illustration of the layer constitution of a first embodiment of the photoconductive member according to this invention.

The photoconductive member 100 as shown in FIG. 1 is provided with an interface layer 102 comprising an amorphous material represented by any of the above formulas (1) to (3) [hereinafter abbreviated as "a-SiN(H,X)"], a rectifying layer 103 and an amorphous layer 104 having photoconductivity, on a support 101 for photoconductive member, said amoprhous layer 104 having a free surface 105.

The interface layer 102 is provided primarily for the purpose of enhancement of adhesion between the support 101 and the rectifying layer 103, and it is formed so that it may have affinities for both the support 101 and the rectifying layer 103.

The rectifying layer 103 has a function primarily of preventing effectively injection of charges from the side of the support 101 into the amorphous layer 104.

The amorphous layer 104 has a function to receive irradiation of a light to which it is sensitive thereby to generate photocarriers in said layer 104 and transport said photocarriers in a certain direction.

In the present invention, illustrative as the halogen atom (X) to be incorporated in a-SiN(H,X) forming the interface layer are F, Cl, Br and I, of which F and Cl are particularly preferred.

Formation of an interface layer comprising a-SiN(H,X) may be performed according to the glow discharge method, the sputtering method, the ion implantation method, the ion plating method, the electron beam method, etc. The preparation methods may be suitably selected depending on various factors such as the preparation conditions, the extent of the load for capital investment for installations, the production scale, the desirable characteristics required for the photoconductive member to be prepared, etc. For the advantages of relatively easy control of the preparation conditions for preparing photoconductive members having desired characteristics and easy introduction of silicon atoms (Si) and nitrogen atoms (N) into the interface layer to be formed, there may preferably be employed the glow discharge method or the sputtering method.

Further, in the present invention, the interface layer may be formed by using the glow discharge method and the sputtering method in combination in the same device system.

For information of an interface layer by the sputtering method, a single crystalline or polycrystalline Si wafer or $Si_3N_4$ wafer or a Si wafer formed as a mixture with $Si_3N_4$ is used as target and subjected to sputtering in an atmosphere of various gases.

For example, when both of Si wafer and $Si_3N_4$ wafer are used as target, a gas for sputtering such as He, Ne, Ar, etc. is introduced into a deposition chamber for sputtering to form a gas plasma therein and effect sputtering with said Si wafer and $Si_3N_4$ wafer.

Alternatively, by use of one sheet target formed as a mixture of Si and $Si_3N_4$, a gas for sputtering is introduced into the device system and sputtering is effected in the atmosphere of said gas.

When the electron beam method is employed, a single crystalline or polycrystalline high purity silicon and a high purity silicon nitride may be placed in two vapor deposition boats, respectively, and vapor deposition may be effected at the same time independently of each other with electron beam, or alternatively vapor deposition may be effected with a single electron beam using silicon and silicon nitride placed in the same vapor deposition boat. The composition ratio of silicon atoms to nitrogen atoms in the interface layer may be controlled, in the former case, by varying the acceleration voltage of electron beam relative to silicon and silicon nitride, respectively, while in the latter case, by determining previously the mixed amounts of silicon and silicon nitride.

When the ion plating method is employed, various gases are introduced into a vapor deposition chamber, and a high frequency electric field is applied to a coil previously wound around the vapor deposition chamber to form a gas plasma therein, under which state Si and $Si_3N_4$ may be vapor deposited by utilization of the electron beam method.

For information of an interface layer according to the glow discharge method, starting gases for formation of a-SiN(H,X), which may optionally be mixed with a diluting gas at a predetermined mixing ratio, may be introduced into a deposition chamber for vacuum deposition in which a support is placed, and glow discharge is excited in said deposition chamber to form the gases into a gas plasma, thereby depositing a-SiN(H,X) on the support.

In the present invention, as the starting materials which may be the starting gases for formation of a-SiN(H,X), there may be used almost all substances which are gaseous or gasified substances of gasifiable substances and contain as constituent atom at least one of Si, N, H and X.

As the starting materials which can be effectively used as the starting gases for formation of the interface layer, there may be included substances which are gaseous under conditions of normal temperature and normal pressure or readily gasifiable.

Such starting materials for formation of the interface layer may include, for example, nitrogen compounds such as nitrogen, nitrides, nitrogen fluoride and azides, single halogen substances, hydrogen halides, interhalogen compounds, silicon halides, halogen-substituted hydrogenated silicons, hydrogenated silicon and the like.

More specifically, there may be mentioned nitrogen ($N_2$); as nitrogen compounds, ammonia ($NH_3$), hydrazine ($H_2NNH_2$), nitrogen trifluoride ($F_3N$), nitrogen tetrafluoride ($F_4N_2$), hydrogen azide ($HN_3$), ammonium azide ($NH_4N_3$); as single halogen substances, halogenic gases such as of fluorine, chlorine, bromine and iodine; as hydrogen halides, FH, HI, HCl, HBr; as interhalogen compounds, BrF, ClF, $ClF_3$, $ClF_5$, $BrF_5$, $BrF_3$, $IF_7$, $IF_5$, ICl, IBr; as silicon halides, $SiF_4$, $Si_2F_6$, $SiCl_4$, $SiCl_3Br$, $SiCl_2Br_2$, $SiClBr_3$, $SiCl_3I$, $SiBr_4$; as halogen-substituted hydrogenated silicon, $SiH_2F_2$, $SiH_2Cl_2$, $SiHCl_3$, $SiH_3Cl$, $SiH_3Br$, $SiH_2Br_2$, $SiHBr_3$; as hydrogenated silicon, silanes such as $SiH_4$, $Si_2H_6$, $Si_3H_8$, $Si_4H_{10}$; and so on.

These starting materials for formation of the interface layer may be employed by suitable selection in forming the interface layer as desired so that silicon atoms, nitrogen atoms, and if necessary hydrogen atoms or halogen atoms may be contained at a desired composition ratio in the interface layer to be formed.

For example, an interface layer may be formed by introducing $SiH_4$ or $Si_2H_6$, capable of readily incorporating silicon atoms and hydrogen atoms and forming an interface layer having desired characteristics, $N_2$ or $NH_3$ as a material for incorporating nitrogen atoms, and, if necessary, $SiF_4$, $SiH_2F_2$, $SiHCl_3$, $SiCl_4$, $SiH_2Cl_2$ or $SiH_3Cl$ as a material for incorporating halogen atoms, at a predetermined mixing ratio under gaseous state into a device system for formation of an interface layer and exciting glow discharge therein.

Alternatively, an interface layer may also be formed by introducing $SiF_4$ or the like, capable of incorporating silicon atoms and halogen atoms into an interface layer to be formed, and $N_2$ or the like as a material for incorporating nitrogen atoms at a predetermined ratio, if desired, together with a diluting gas such as He, Ne, Ar or the like, into a device system for formation of an interface layer and exciting glow discharge therein.

In forming an interface layer according to the sputtering method, it is also possible to form a desired interface layer by using silicon as a target and starting gases as enumerated in description of formation of an interface layer according to the glow discharge method as starting gases for introduction of N, and, if desired, H or X.

In the present invention, incorporation of hydrogen atoms or halogen atoms in the interface layer is convenient from aspect of production cost, because the starting gas species can be made common in part at the time of forming continuously the rectifying layer and the amorphous layer.

The amorphous material a-SiN(H,X) constituting the interface layer of the present invention, because the function of the interface layer is to consolidate adhesion between the support and the rectifying layer and, in addition, to make electrical contact therebetween uniform, is desired to be carefully prepared by selecting strictly the conditions for preparation of the interface layer so that the interface layer may be endowed with the required characteristics as desired.

As an important factor among the conditions for formation of a-SiN(H,X) having the characteristics adapted for the objects of the present invention, there may be mentioned the support temperature during formation.

That is, in forming an interface layer comprising a-SiN(H,X) on the surface of a support, the support temperature during layer formation is an important factor having influences on the structure and the characteristics of the layer to be formed. In the present invention, the support temperature during layer formation is desired to be strictly controlled so that a-SiN(H,X) having the intended characteristics may be prepared as desired.

The support temperature in forming the interface layer for accomplishing effectively the objects of the present invention should be selected within the optimum range in conformity with the method for formation of the interface layer to carry out formation of the interface layer.

When the interface layer is to be formed of a-$Si_aN_{1-a}$ [amorphous material represented by the formula (1)], the support temperature is desired to be preferably 20° C. to 200° C., more preferably 20° C. to 150° C. When the interface layer is to be formed of a-$(Si_bN_{1-b})_cH_{1-c}$ [amorphous material represented by the formula (2)] or a-$(Si_dN_{1-d})_e(X,H)_{1-e}$ [amorphous material represented by the formula (3)], the support temperature is desired to be preferably 50° C. to 350° C., more preferably 100° C. to 250° C.

In practicing formation of the interface layer, employment of the glow discharge method, the sputtering method and the electron beam method is advantageous, because it is possible to form continuously the interface layer, the rectifying layer, the amorphous layer, further other layers optionally formed on the amorphous layer, in the same system, and also because severe control of the composition ratio of the atoms constituting respective layers or control of the layer thickness can be done with relative ease as compared with other methods. When the interface layer is formed according to these layer forming methods, the discharging power and the gas pressure during layer formation may be mentioned as important factors similarly to the aforesaid support temperature which have influences on the characteristics of the a-SiN(H,X) to be prepared.

The discharging power condition for preparing effectively the interface layer having the characteristics for accomplishing the objects in the present invention with good productivity, in case of a-$Si_aN_{1-a}$, may preferably be 50 W to 250 W, more preferably 80 W to 150 W. In case of a-$(Si_bN_{1-b})_cH_{1-c}$ or a-$(Si_dN_{1-d})_e$ $(X,H)_{1-e}$, it may preferably be 1 to 300 W, more preferably 2 to 100 W.

The gas pressure in a deposition chamber in case of carrying out the layer formation according to the glow discharge method may preferably be 0.01 to 5 Torr, more preferably 0.1 to 0.5 Torr. In case of carrying out the layer formation according to the sputtering method, it may preferably be $1\times10^{-3}$ to $5\times10^{-2}$ Torr, more preferably $8\times10^{-3}$ to $3\times10^{-2}$ Torr.

The contents of nitrogen atoms (N), hydrogen atoms (H) and halogen atoms (X) in the a-SiN(H,X) constituting the interface layer in the photoconductive member of the present invention are also important factors for forming an interface layer having desired characteristics to accomplish the objects of the present invention, similarly to the conditions for preparation of the interface layer.

That is, in the above formulas representing the amorphous material constituting the interface layer, a, b, c, d and e have values generally as specified above, but a may preferably $0.57<a\leqq0.99999$, more preferably $0.57<a\leqq0.99$, most preferably $0.57<a\leqq0.9$; b preferably $0.6<b\leqq0.99999$, more preferably $0.6<b\leqq0.99$, most preferably $0.6<b\leqq0.9$; c preferably $0.65\leqq c\leqq0.98$, more preferably $0.7\leqq c\leqq0.95$; d preferably $0.6<d\leqq0.99999$, more preferably $0.6<d\leqq0.99$, most preferably $0.6<d\leqq0.9$; e preferably $0.8\leqq e\leqq0.99$, more preferably $0.85\leqq e\leqq0.98$.

The numerical range for the thickness of the interface layer in the present invention may suitably be determined so that the objects of the present invention may be accomplished effectively.

The thickness of the interface layer for accomplishing effectively the objects of the present invention may preferably be 30 Å to 2μ, more preferably 40 Å to 1.5μ, most preferably 50 Å to 1.5μ.

The rectifying layer constituting the photoconductive member of the present invention comprises an amorphous material containing as the constituent atoms the atoms belonging to the group III of the periodic table (the group III atoms) or the atoms belonging to the group V of the periodic table (the group V atoms), preferably together with hydrogen atoms (H) or halogen atoms (X) or both thereof, in a matrix of silicon atoms (Si) [hereinafter written as "a-Si (III,V,H,X)"], and its layer thickness t and the content C(A) of the group III atoms or the group V atoms are suitably determined as desired so that the objects of the present invention may be effectively accomplished.

The layer thickness t of the rectifying layer in the present invention may preferably be 0.3 to 5μ, more preferably 0.5 to 2μ. The aforesaid content C(A) may preferably be $1\times10^2$ to $1\times10^5$ atomic ppm, more preferably $5\times10^2$ to $1\times10^5$ atomic ppm.

In the present invention, the atoms to be used as the group III atoms contained in the rectifying layer may include B (boron), Al (aluminum), Ga (gallium), In (indium), Tl (thallium) and the like, particularly preferably B and Ga.

The atoms belonging to the group V atoms contained in the rectifying layer may include P (phosphorus), As (arsenic), Sb (antimony), Bi (bismuth) and the like, particularly preferably P and As.

In the present invention, as halogen atoms (X) to be incorporated in the rectifying layer, if desired, there may be mentioned fluorine, chlorine, bromine and iodine, particularly preferably fluorine and chlorine.

For formation of a rectifying layer comprising a-Si(III,V,H,X), there may be employed the glow discharge method, the sputtering method, the ion implantation method, the ion-plating method, electron beam method and the like, similarly as in formation of an interface layer.

For example, for formation of a rectifying layer comprising a-Si(III,V,H,X) according to the glow discharge method, the basic procedure comprises introducing a starting gas capable of supplying the group III atoms or a starting gas capable of supplying the group V atoms, and optionally a starting gas for introduction of hydrogen atoms (H) and/or halogen atoms (X), together with a starting gas for supplying silicon atoms (Si), into a deposition chamber which can be internally brought to a reduced pressure, wherein glow discharge is excited thereby to form a layer comprising a-Si(III,V,H,X) on the surface of a support placed at a predetermined position in the chamber. When it is to be formed according to the sputtering method, a starting gas for introduction of the group III atoms or a starting gas for introduction of the group V atoms, optionally together with gases for introduction of hydrogen atoms and/or halogen atoms, may be introduced into the chamber into a deposition chamber for sputtering when effecting sputtering of a target constituted of Si in an atmosphere of an inert gas such as Ar, He or a gas mixture based on these gases.

As the starting materials which can be used as the starting gases for formation of the rectifying layer, there may be employed those selected as desired from the same starting materials as used for formation of the interface layer, except for the starting materials to be used as the starting gases for introduction of the group III atoms and the group V atoms.

For introducing the group III atoms or the group V atoms structurally into the rectifying layer, the starting material for introduction of the group III atoms or the starting material for introduction of the group V atoms may be introduced under gaseous state into a deposition chamber together with other starting materials for formation of the rectifying layer. As the material which can be used as such starting materials for introduction of the group III atoms or the group V atoms, there may be desirably employed those which are gaseous under the conditions of normal temperature and normal pressure, or at least readily gasifiable under layer forming conditions.

Illustrative of such starting materials for introduction of the group III atoms are boron hydrides such as $B_2H_6$, $B_4H_{10}$, $B_5H_9$, $B_5H_{11}$, $B_6H_{10}$, $B_6H_{12}$, $B_6H_{14}$ and the like, boron halides such as $BF_3$, $BCl_3$, $BBr_3$ and the like. In addition, there may also be included $AlCl_3$, $GaCl_3$, $Ga(CH_3)_3$, $InCl_3$, $TlCl_3$ and the like.

Illustrative of the starting materials for introduction of the group V atoms are phosphorus hydrides such as $PH_3$, $P_2H_4$ and the like, phosphorus halides such as $PH_4I$, $PF_3$, $PF_5$, $PCl_3$, $PCl_5$, $PBr_3$, $PBr_5$, $PI_3$ and the like. In addition, there may also be included $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$, $BiBr_3$ and the like, as effective materials for introduction of the group V atoms.

In the present invention, the group III atoms or the group V atoms to be contained in the rectifying layer for imparting rectifying characteristic may preferably be distributed substantially uniformly within planes parallel to the surface of the support and in the direction of the layer thickness.

In the present invention, the content of the group III atoms and the group V atoms to be introduced into the rectifying layer can be controlled freely by controlling the gas flow rate, the gas flow rate ratio of the starting materials for introduction of the group III atoms and the group V atoms, the discharging power, the support temperature, the pressure in the deposition chamber and others.

In the present invention, as the halogen atoms (X), which may be introduced into the rectifying layer, if necessary, there may be included those as mentioned above concerning description about the interface layer.

In the present invention, formation of an amorphous layer comprising a-Si(H,X) may be conducted by the vacuum deposition method utilizing discharging phenomenon, such as the glow discharge method, the sputtering method or the ion-plating method similarly to in formation of an interface layer. For example, for formation of an amorphous layer comprising a-Si(H,X) according to the glow discharge method, the basic procedure comprises introducing a starting gas capable of supplying a starting gas for introduction of hydrogen atoms (H) and/or halogen atoms (X), together with a starting gas for supplying silicon atoms (Si), into a deposition chamber which can be internally brought to a reduced pressure, wherein glow discharge is excited thereby to form a layer comprising a-Si(H,X) on the surface of a rectifying layer on a support placed at a predetermined position in the chamber. When it is to be formed according to the sputtering method, a starting gas for introduction of hydrogen atoms (H) and/or halogen atoms (X) may be introduced into the chamber into a deposition chamber for sputtering when effecting sputtering of a target constituted of Si in an atmosphere of an inert gas such as Ar, He or a gas mixture based on these gases.

In the present invention, as the halogen atoms (X), which may be introduced into the amorphous layer, if necessary, there may included those as mentioned above concerning description about the interface layer.

The starting gas for supplying Si to be used for formation of an amorphous layer in the present invention may include gaseous or gasifiable hydrogenated silicons (silanes) such as $SiH_4$, $Si_2H_6$, $Si_3H_8$, $Si_4H_{10}$ and others as mentioned in description about the interface layer or the rectifying layer as effective materials. In particular, $SiH_4$ and $Si_2H_6$ are preferred with respect to easy handling during formation and efficiency for supplying Si.

As the effective starting gas for incorporation of halogen atoms to be used in the present invention for formation of an amorphous layer, there may be employed a number of halogen compounds similarly as in case of an interface layer, including gaseous or gasifiable halogen compounds such as halogen gases, halides, interhalogen compounds, silane derivatives substituted by halogens and the like.

Further, there may be also included gaseous or gasifiable silicon compounds containing halogen atoms, which comprises silicon atoms (Si) and halogen atoms (X) as constituents, as effective materials to be used in the present inventions.

In the present invention, the amount of hydrogen atoms (H) or halogen atoms (X) or the sum (H+X) of hydrogen atoms (H) and halogen atoms (X) to be contained in the rectifying layer or the amorphous layer is desired to be in the range preferably from 1 to 40 atomic %, more preferably from 5 to 30 atomic %. For controlling the amount of hydrogen atoms (H) and/or halogen atoms (X) to be contained in the rectifying layer or in the amorphous layer, for example, the support temperature, the amount of the starting material to be used for incorporation of hydrogen atoms (H) or halogen atoms (X), discharging power and others may be controlled.

In the present invention, as diluting gases to be used in formation of the amorphous layer according to the glow discharge method or as gases for sputtering during formation according to the sputtering method, there may be employed so called rare gases such as He, Ne, Ar and the like.

In the present invention, the amorphous layer may have a layer thickness, which may be suitably determined depending on the characteristics required for the photoconductive member prepared, but desirably within the range generally from 1 to 100$\mu$, preferably 1 to 80$\mu$, most preferably 2 to 50$\mu$.

In the present invention, when the group V atoms are to be incorporated in the rectifying layer, it is desirable that the conduction characteristic of said layer is controlled freely by incorporating a substance for controlling the conduction characteristic different from the group V atoms in the amorphous layer.

As such a substance, there may be preferably mentioned the so called impurities in the field of semiconductors, preferably p-type impurities for imparting p-type conduction characteristic to a-Si(H,X) constituting the amorphous layer to be formed in the present invention, typically the atoms belonging to the aforesaid group III of the periodic table (the group III atoms).

In the present invention, the content of the substance for controlling the conduction characteristic in the amorphous layer may be selected suitably in view of organic relationships with the conduction characteristic required for said amorphous layer, the characteristics of other layers provided in direct contact with said amorphous layer, the characteristic at the contacted interface with said other layers, etc.

In the present invention, the content of the substance for controlling the conduction characteristic in the amorphous layer is desired to be generally 0.001 to 1000 atomic ppm, preferably 0.05 to 500 atomic ppm, most preferably 0.1 to 200 atomic ppm.

The support to be used in the present invention may be either electroconductive or insulating. As the electroconductive support, there may be mentioned metals such as NiCr, stainless steel, Al, Cr, Mo, Au, Nb, Ta, V, Ti, Pt, Pd etc. or alloys thereof.

As insulating supports, there may conventionally be used films or sheets of synthetic resins, including polyesters, polyethylene, polycarbonates, cellulose acetate, polypropylene, polyvinyl chloride, polyvinylidene chloride, polystyrene, polyamides, etc., glasses, ceramics, papers and so on. These insulating supports may preferably have at least one surface subjected to electroconductive treatment, and it is desirable to provide other layers on the side at which said electroconductive treatment has been applied.

For example, electroconductive treatment of a glass can be effected by providing a thin film of NiCr, Al, Cr, Mo, Au, Ir, Nb, Ta, V, Ti, Pt, Pd, $In_2O_3$, $SnO_2$, ITO ($In_2O_3+SnO_2$) thereon. Alternatively, a synthetic resin film such as polyester film can be subjected to the electroconductive treatment on its surface by vacuum vapor deposition, electron-beam deposition or sputtering of a metal such as NiCr, Al, Ag, Pb, Zn, Ni, Au, Cr, Mo, Ir, Nb, Ta, V, Ti, Pt, etc. or by laminating treatment with said metal, thereby imparting electroconductivity to the surface. The support may be shaped in any form such as cylinders, belts, plates or others, and its form may be determined as desired. For example, when the photoconductive member 100 in FIG. 1 is to be used as an image forming member for electrophotography, it may desirably be formed into an endless belt or a cylinder for use in continuous high speed copying. The support may have a thickness, which is conveniently determined so that a photoconductive member as desired may be formed. When the photoconductive member is required to have a flexibility, the support is made as thin as possible, so far as the function of a support can be exhibited. However, in such a case, the thickness is generally 10$\mu$ or more from the points of fabrication and handling of the support as well as its mechanical strength.

Figure 2:
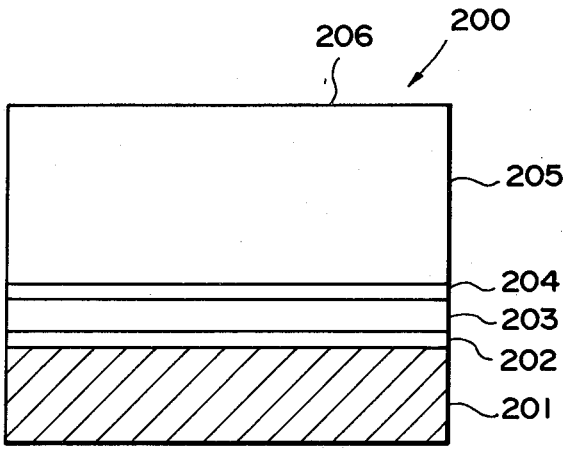

FIG. 2 shows the second preferred embodiment of the photoconductive member of the present invention.

The photoconductive member 200 shown in FIG. 2 is different from the photoconductive member 100 shown in FIG. 1 in having an upper interface layer 204 between the rectifying layer 203 and the amorphous layer 205 exhibiting photoconductivity.

That is, the photoconductive member 200 is provided with a support 201, and, consecutively laminated on said support 201, a lower interface layer 202, a rectifying layer 203, an upper interface layer 204 and an amorphous layer 205, the amorphous layer 205 having a free surface 206.

The upper interface layer 204 has the function of consolidating adhesion between the rectifying layer 203 and the amorphous layer 205 thereby to make electrical contact at the interface of both layers uniform, while concomitantly making tough the layer quality of the rectifying layer 203 by being provided directly on the rectifying layer 203.

The lower interface layer 202 and the upper interface layer 204 constituting the photoconductive member 200 as shown in FIG. 2 are constituted of the same amorphous material as in case of the interface layer 102 constituting the photoconductive member 100 as shown in FIG. 1 and may be formed according to the same preparation procedure under the same conditions so that similar characteristics may be imparted thereto. The rectifying layer 203 and the amorphous layer 205 have also the same characteristics and functions as the rectifying layer 103 and the amorphous layer 104, respectively, and may be formed according to the same layer preparation procedure under the same conditions as in case of FIG. 1.

Figure 3:
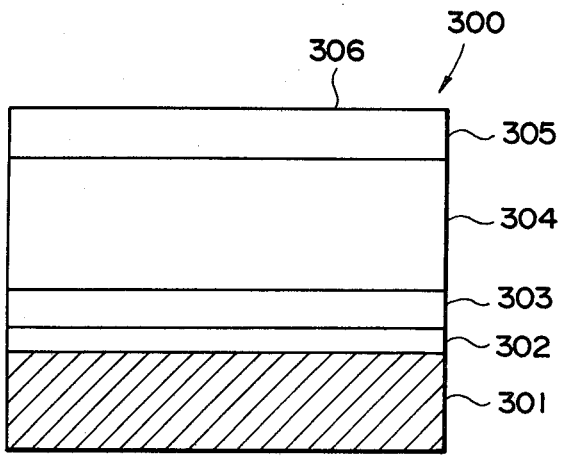

FIG. 3 is a schematic illustration of the layer constitution of the third embodiment of the photoconductive member of the present invention.

The photoconductive member 300 as shown in FIG. 3 has the same layer constitution as that of the photoconductive member 100 as shown in FIG. 1 except for having a second amorphous layer (II) 305 on a first amorphous layer (I) 304 which is the same as the amorphous layer 104 as shown in FIG. 1.

That is, the photoconductive member 300 as shown in FIG. 3 is provided with an interface layer 302, a rectifying layer 303, a first amorphous layer (I) 304 having photoconductivity and a second amorphous layer (II) 305, which comprises an amorphous material comprising silicon atoms and carbon atoms, optionally together with at least one of hydrogen atoms and halogen atoms, as constituent atoms [hereinafter written as "a-SiC(H,X)"], on a support 301 for photoconductive member, the second amorphous layer (II) 305 having a free surface 306.

The second amorphous layer (II) 305 is provided primarily for the purpose of accomplishing the objects of the present invention with respect to humidity resistance, continuous repeated use characteristics, dielectric strength, environmental characteristics in use and durability.

In the photoconductive member 300 as shown in FIG. 3, since each of the amorphous materials forming the first amorphous layer (I) 302 and the second amorphous layer (II) 305 have the common constituent of silicon atom, chemical and electric stabilities are sufficiently ensured at the laminated interface.

As a-SiC(H,X) constituting the second amorphous layer (II), there may be mentioned an amorphous material constituted of silicon atoms and carbon atoms (a-$Si_aC_{1-a}$ where $0<a<1$), an amorphous material constituted of silicon atoms, carbon atoms and hydrogen atoms [a-$(Si_bC_{1-b})_cH_{1-c}$, where $0<a$, $b<1$] and an amorphous material constituted of silicon atoms, carbon atoms, halogen atoms and, if desired, hydrogen atoms [a-$(Si_dC_{1-d})_e(X,H)_{1-e}$, where $0<d$, $e<1$] as effective materials.

Formation of the second amorphous layer (II) constituted of a-SiC(H,X) may be performed according to the glow discharge method, the sputtering method, the ion implantation method, the ion plating method, the electron beam method, etc. These preparation methods may be suitably selected depending on various factors such as the preparation conditions, the degree of the load for capital investment for installations, the production scale, the desirable characteristics required for the photoconductive member to be prepared, etc. For the advantages of relatively easy control of the preparation conditions for preparing photoconductive members having desired characteristics and easy introduction of silicon atoms and carbon atoms, optionally together with hydrogen atoms or halogen atoms, into the second amorphous layer (II) to be prepared, there may preferably be employed the glow discharge method or the sputtering method.

Further, in the present invention, the second amorphous layer (II) may be formed by using the glow discharge method and the sputtering method in combination in the same device system.

For formation of the second amorphous layer (II) according to the glow discharge method, starting gases for formation of a-SiC(H,X), optionally mixed at a predetermined mixing ratio with diluting gas, may be introduced into a deposition chamber for vacuum deposition in which a support is placed, and the gas introduced is made into a gas plasma by excitation of glow discharging, thereby depositing a-SiC(H,X) on the first amorphous layer (I) which has already been formed on the aforesaid support.

As the starting gases for formation of a-SiC(H,X) to be used in the present invention, it is possible to use most of gaseous substances or gasified gasifiable substances containing at least one of Si, C, H and X as constituent atoms.

In case when a starting gas having Si as constituent atoms as one of Si, C, H and X is employed, there may be employed, for example, a mixture of a starting gas containing Si as constituent atom with a starting gas containing H or X as constituent atom at a desired mixing ratio, or alternatively a mixture of a starting gas containing Si as constituent atoms with a starting gas containing C and H or X also at a desired mixing ratio, or a mixture of a starting gas containing Si as constituent atoms with a gas containing three atoms of Si, C and H or of Si, C and X as constituent atoms.

Alternatively, it is also possible to use a mixture of a starting gas containing Si and H or X as constituent atoms with a starting gas containing C as constituent atom.

In the present invention, the starting gases effectively used for formation of the second amorphous layer (II) may include hydrogenated silicon gases containing Si and H as constituent atoms such as silanes (e.g. $SiH_4$, $Si_2H_6$, $Si_3H_8$, $Si_4H_{10}$, etc.), compounds containing C and H as constituent atoms such as saturated hydrocarbons having 1 to 5 carbon atoms, ethylenic hydrocarbons having 2 to 5 carbon atoms and acetylenic hydrocarbons having 2 to 4 carbon atoms.

More specifically, there may be included, as saturated hydrocarbons, methane ($CH_4$), ethane ($C_2H_6$), propane ($C_3H_8$), n-butane (n-$C_4H_{10}$), pentane ($C_5H_{12}$); as ethylenic hydrocarbons, ethylene ($C_2H_4$), propylene ($C_3H_6$), butene-1 ($C_4H_8$), butene-2 ($C_4H_8$), isobutylene ($C_4H_8$), pentene ($C_5H_{10}$); as acetylenic hydrocarbons, acetylene ($C_2H_2$), methyl acetylene ($C_3H_4$), butyne ($C_4H_6$); and the like.

As the starting gas containing Si, C and H as constituent atoms, there may be mentioned alkyl silanes such as $Si(CH_3)_4$, $Si(C_2H_5)_4$ and the like. In addition to these starting gases, it is also possible as a matter of course to use $H_2$ as effective starting gas for introduction of H.

In the present invention, preferable halogen atoms (X) to be contained in the second amorphous layer (II) are F, Cl, Br and I. Particularly, F and Cl are preferred.

Incorporation of hydrogen atoms into the second amorphous layer (II) is convenient from aspect of production cost, because a part of starting gas species can be made common in forming continuous layers together with the first amorphous layer (I).

In the present invention, as the starting gas which can be used effectively for introduction of halogen atoms (X) in formation of the second amorphous layer (II), there may be mentioned gaseous substances under conditions of normal temperature and normal pressure or readily gasifiable substances.

Such starting gases for introduction of halogen atoms may include single halogen substances, hydrogen halides, interhalogen atoms, silicon halides halo-substituted hydrogenated silicons and the like.

More specifically, there may be mentioned, as single halogen substances, halogenic gases such as of fluorine, chlorine, bromine and iodine; as hydrogen halides FH, HI, HCl, HBr; as interhalogen compounds, BrF, ClF, $ClF_3$ $ClF_5$, $BrF_5$, $BrF_3$ $IF_7$, $IF_5$, ICl, IBr; as silicon halides, $SiF_4$, $Si_2F_6$, $SiCl_4$, $SiCl_3Br$, $SiCl_2Br_2$, $SiClBr_3$, $SiCl_3I$, $SiBr_4$; as halo-substituted hydrogenated silicon, $SiH_2F_2$, $SiH_2Cl_2$, $SiHCl_3$, $SiH_3Cl$, $SiH_3Br$, $SiH_2Br_2$, $SiHBr_3$; and so on.

In addition to these materials, there may also be employed halo-substituted paraffinic hydrocarbons such as $CCl_4$, $CHF_3$, $CH_2F_2$, $CH_3F$, $CH_3Cl$, $CH_3Br$, $CH_3I$, $C_2H_5Cl$ and the like, fluorinated sulfur compounds such as $SF_4$, $SF_6$ and the like, halo-containing alkyl silanes such as $SiCl(CH_3)_3$, $SiCl_2(CH_3)_2$, $SiCl_3CH_3$ and the like, as effective materials. For formation of the second amorphous layer (II) according to the sputtering method, a single crystalline or polycrystalline Si wafer or C wafer or a wafer containing Si and C mixed therein is used as target and subjected to sputtering in an atmosphere of various gases.

For example, when Si wafer is used as target, a starting gas for introducing at least C, which may be diluted with a diluting gas, if desired, is introduced into a deposition chamber for sputter to form a gas plasma therein and effect sputtering of said Si wafer.

Alternatively, Si and C as separate targets or one sheet target of a mixture of Si and C can be used and sputtering is effected in a gas atmosphere containing, if necessary, at least hydrogen atoms or halogen atoms.

As the starting gas for introduction of C or for introduction of H or X, there may be employed those as mentioned in the glow discharge as described above as effective gases also in case of the sputtering method.

In the present invention, as the diluting gas to be used in forming the second amorphous layer (II) by the glow discharge method or the sputtering method, there may be preferably employed so called rare gases such as He, Ne, Ar and the like.

The second amorphous layer (II) in the present invention should be carefully formed so that the required characteristics may be given exactly as desired.

That is, a substance containing as constituent atoms Si, C and, if necessary H and/or X can take various forms from crystalline to amorphous, electrical properties from conductive through semi-conductive to insulating and photoconductive properties from photoconductive to non-photoconductive depending on the preparation conditions. Therefore, in the present invention, the preparation conditions are strictly selected as desired so that there may be formed a-SiC(H,X) having desired characteristics depending on the purpose.

For example, when the second amorphous layer (II) is to be provided primarily for the purpose of improvement of dielectric strength, a-SiC(H,X) is prepared as an amorphous material having marked electric insulating behaviours under the usage conditions.

Alternatively, when the primary purpose for provision of the second amorphous layer (II) is improvement of continuous repeated use characteristics or environmental characteristics in use, the degree of the above electric insulating property may be alleviated to some extent and a-SiC(H,X) may be prepared as an amorphous material having sensitivity to some extent to the light irradiated.

In forming the second amorphous layer (II) comprising a-SiC(H,X) on surface of the first amorphous layer (I), the support temperature during layer formation is an important factor having influences on the structure and the characteristics of the layer to be formed, and it is desired in the present invention to control severely the support temperature during layer formation so that a-SiC(H,X) having intended characteristics may be prepared as desired.

As the support temperature in forming the second amorphous layer (II) for accomplishing effectively the objects of the present invention, there may be selected suitably the optimum temperature range in conformity with the method for forming the second amorphous layer (II) in carrying out formation of the second amorphous layer (II).

When the second amorphous layer (II) is to be formed of a-$Si_aC_{1-a}$, the support temperature may preferably be 20° to 300° C., more preferably 20° to 250° C.

When the second amorphous layer (II) is to be formed of a-$(Si_bC_{1-b})_cH_{1-c}$ or a-$(Si_dC_{1-d})_e(X,H)_{1-e}$, the support temperature may preferably be 50° to 350° C., more preferably 100° to 250° C.

For formation of the second amorphous layer (II), the glow discharge method or the sputtering method may be advantageously adopted, because severe control of the composition ratio of atoms constituting the layer or control of layer thickness can be conducted with relative ease as compared with other methods. In case when the second amorphous layer (II) is to be formed according to these layer forming methods, the discharging power and the gas pressure during layer formation are important factors influencing the characteristics of a-SiC(H,X) to be prepared, similarly as the aforesaid support temperature.

The discharging power condition for preparing effectively a-$Si_aC_{1-a}$ having characteristics for accomplishing the objects of the present invention with good productivity may preferably be 50 W to 250 W, most preferably 80 W to 150 W.

The discharging power conditions, in case of a-$(Si_bC_{1-b})_cH_{1-c}$ or a-$(Si_dC_{1-d})_e(X,H)_{1-e}$, may preferably be 10 to 300 W, more preferably 20 to 200 W.

The gas pressure in a deposition chamber may preferably be about 0.01 to 5 Torr, more preferably about 0.01 to 1 Torr, most preferably about 0.1 to 0.5 Torr.

In the present invention, the above numerical ranges may be mentioned as preferable numerical ranges for the support temperature, discharging power, etc. for preparation of the second amorphous layer (II). However, these factors for layer formation should not be determined separately independently of each other, but it is desirable that the optimum values of respective layer forming factors should be determined based on mutual organic relationships so that a second amorphous layer (II) comprising a-SiC(H,X) having desired characteristics may be formed.

The contents of carbon atoms and hydrogen atoms in the second amorphous layer (II) in the photoconductive member of the present invention are the second important factor for obtaining the desired characteristics to accomplish the objects of the present invention, similarly as the conditions for preparation of the second amorphous layer (II).

The content of carbon atoms contained in the second amorphous layer in the present invention, when it is constituted of a-$Si_aC_{1-a}$, may be generally $1\times10^{-3}$ to 90 atomic %, preferably 1 to 80 atomic %, most preferably 10 to 75 atomic %. That is, in terms of the aforesaid representation a in the formula a-$Si_aC_{1-a}$, a may be generally 0.1 to 0.99999, preferably 0.2 to 0.99, most preferably 0.25 to 0.9.

When the second amorphous layer (II) is constituted of a-$(Si_bC_{1-b})_cH_{1-c}$, the content of carbon atoms contained in said layer (II) may be generally $1\times10^{-3}$ to 90 atomic %, preferably 1 to 90 atomic %, most preferably 10 to 80 atomic %. The content of hydrogen atoms may be generally 1 to 40 atomic %, preferably 2 to 35 atomic %, most preferably 5 to 30 atomic %. A photoconductive member formed to have a hydrogen atom content with these ranges is sufficiently applicable as an excellent one in practical applications. That is, in terms of the representation by a-$(Si_bC_{1-b})_cH_{1-c}$, b may be generally 0.1 to 0.99999, preferably 0.1 to 0.99, most preferably 0.15 to 0.9, and c generally 0.6 to 0.99, preferably 0.65 to 0.98, most preferably 0.7 to 0.95.

When the second amorphous layer (II) is constituted of a-$(Si_dC_{1-d})_e(X,H)_{1-e}$, the content of carbon atoms contained in said layer (II) may be generally $1\times10^{-3}$ to 90 atomic %, preferably 1 to 90 atomic %, most preferably 10 to 80 atomic %. The content of halogen atoms may be generally 1 to 20 atomic %, preferably 1 to 18 atomic %, most preferably 2 to 15 atomic %. A photoconductive member formed to have a halogen atom content with these ranges is sufficiently applicable as an excellent one in practical applications. The content of hydrogen atoms to be optionally contained may be generally up to 19 atomic %, preferably up to 13 atomic %. That is, in terms of the representation by a-$(Si_dC_{1-d})_e(X,H)_{1-e}$, d may be generally 0.1 to 0.99999, preferably 0.1 to 0.99, most preferably 0.15 to 0.9, and e generally 0.8 to 0.99, preferably 0.82 to 0.99, most preferably 0.85 to 0.98.

The range of the numerical value of layer thickness of the second amorphous layer (II) in the present invention is one of important factors for accomplishing effectively the objects of the present invention.

It is desirable that the range of the numerical value of layer thickness of the second amorphous layer (II) is suitably determined depending on the intended purpose so as to effectively accomplish the objects of the present invention.

The layer thickness of the second amorphous layer (II) is required to be determined desired suitably with due considerations about the relationships with the contents of carbon atoms, hydrogen atoms or halogen atoms, the layer thickness of the first amorphous layer (I), as well as other organic relationships with the characteristics required for respective layer regions. In addition, it is also desirable to have considerations from economical point of view such as productivity or capability of mass production.

The second amorphous layer (II) in the present invention is desired to have a layer thickness generally of 0.003 to 30μ, preferably 0.004 to 20μ, most preferably 0.005 to 10μ.

Figure 4:
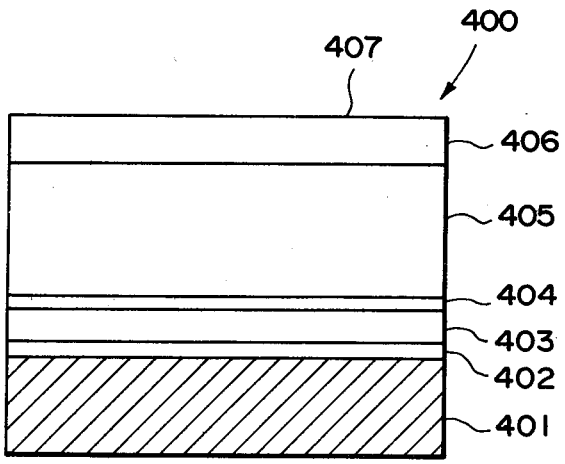

FIG. 4 shows the fourth embodiment of the present invention.

The photoconductive member 400 as shown in FIG. 4 is different from the photoconductive member 200 as shown in FIG. 2 in having a second amorphous layer (II) 406 similar to the second amorphous layer (II) 305 as shown in FIG. 3 on a first amorphous layer 405 exhibiting photoconductivity.

That is, the photoconductive member 400 has a support 401, and, consecutively laminated on said support 401, a lower interface layer 402, a rectifying layer 403, an upper interface layer 404, a first amorphous layer (I) 405 and a second amorphous layer (II) 406, the second amorphous layer (II) 406 having a free surface 407.

The photoconductive member of the present invention designed to have layer constitution as described above can overcome all of the problems as mentioned above and exhibit very excellent electrical, optical, photoconductive characteristics, dielectric strength as well as good environmental characteristics in use.

In particular, when it is applied as an image forming member for electrophotography, it is free from influence of residual potential of image formation at all, being stable in its electrical properties with high sensitivity and having high SN ratio as well as excellent light fatigue resistance and repeated usage characteristics, whereby it is possible to obtain repeatedly images of high quality with high concentration, clear halftone and high resolution.

Also, the amorphous layer itself formed on the support, in photoconductive member of the present invention, is tough and very excellent in adhesion to the support and therefore it is possible to use the photoconductive member at a high speed repeatedly and continuously for a long time.

Next, a process for producing the photoconductive member formed according to the glow discharge decomposition method is to be described.

Figure 5:
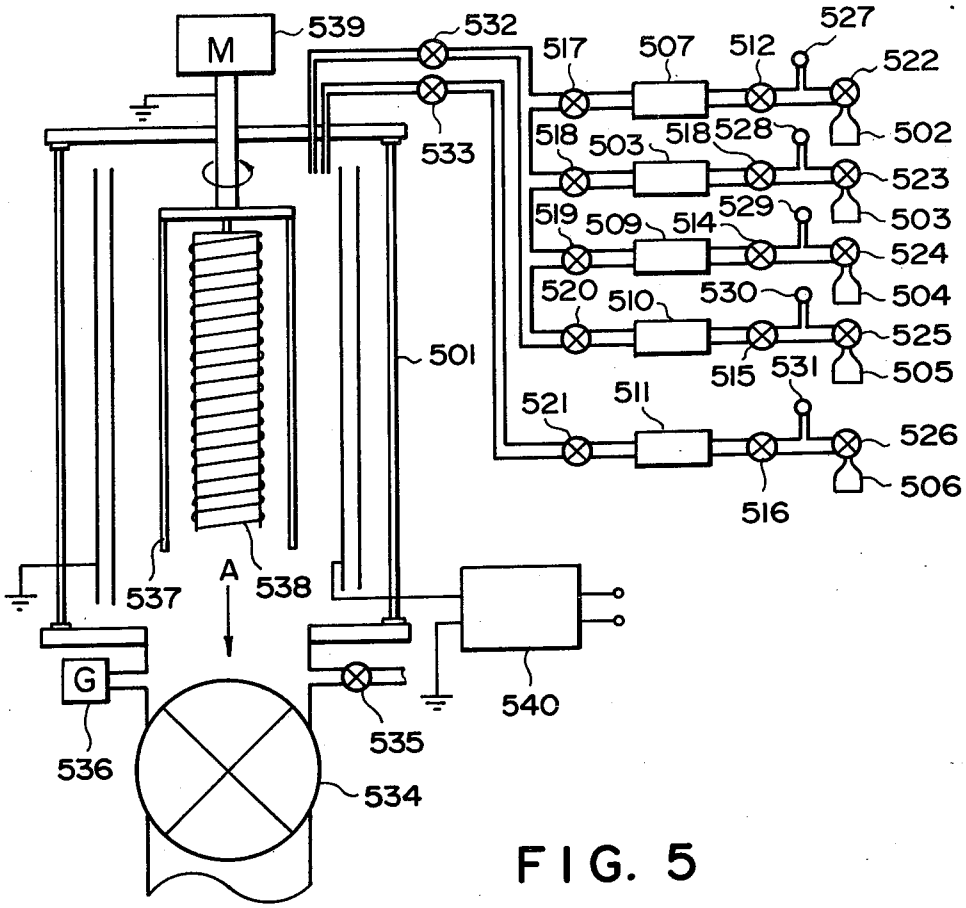
FIG. 5 and FIG. 6 are schematic explanatory views for illustration of examples of the device used for preparation of the photoconductive members of the present invention, respectively.

FIG. 5 shows a device for producing a photoconductive member according to the glow discharge decomposition method.

In the gas bombs 502 to 506, there are hermetically contained starting gases for formation of respective layers of the present invention. For example, 502 is a bomb containing $SiH_4$ gas (purity: 99.999%) diluted with He (hereinafter abbreviated as "$SiH_4$/He"), 503 is a bomb containing $B_2H_6$ gas (purity: 99.999%) diluted with He (hereinafter abbreviated as "$B_2H_6$/He"), 504 is a bomb containing $NH_3$ gas (purity: 99.9%), 505 is a bomb containing $SiF_4$ gas (purity: 99.999%) diluted with He (hereinafter abbreviated as "$SiF_4$/He") and 506 is a bomb containing $C_2H_4$ gas (purity: 99.999%).

The kinds of gases to be filled in these bombs can of course be changed depending on the kinds of the layers to be formed.

For allowing these gases to flow into the reaction chamber 501, on confirmation of the valves 522–526 of the gas bombs 502–506 and the leak valve 535 to be closed, and the inflow valves 512–516, the outflow vlaves 517–521 and the auxiliary valves 532, 533 to be opened, the main valve 534 is first opened to evacuate the reaction chamber 501 and the gas pipelines. As the next step, when the reading on the vacuum indicator 536 becomes about $5\times10^{-6}$ Torr, the auxiliary value 532, 533 and the outflow valves 517–521 are closed.

Then, the valves of the gas pipelines connected to the bombs of gases to be introduced into the reaction chamber 501 are operated as scheduled to introduce desired gases into the reaction chamber 501.

In the following, one example of the procedure in preparation of a photoconductive member having the constitution as shown in FIG. 3 is to be briefly described.

$SiH_4$/He gas from the gas bomb 502 and $NH_3$ gas from the gas bomb 504 are permitted to flow into the mass-flow controllers 507 and 509, respectively, by opening the valves 522 and 524 to control the pressures at the outlet pressure gauges 527 and 529 to 1 Kg/cm$^2$, respectively, and opening gradually the inflow valves 512 and 514, respectively. Subsequently, the outflow valves 517 and 519 and the auxiliary valve 532 are gradually opened to permit respective gases to flow into the reaction chamber 501. The opening of outflow valves 526 and 529 are controlled so that the relative flow rate ratio of $SiH_4$/He to $NH_3$ may have a desired value and opening of the main valve 534 is also controlled while watching the reading on the vacuum indicator 536 so that the pressure in the reaction chamber may reach a desired value.

And, after confirming that the temperature of the support 537 is set at 50°–400° C. by the heater 538, the power source 540 is set at a desired power to excite glow discharge in the reaction chamber 501, and this glow discharging is maintained for a desired period of time to prepare an interface layer on the support with a desired thickness on the support.

Preparation of a rectifying layer on an interface layer may be conducted according to, for example, the procedure as described below.

After formation of an interface layer has been completed, the power source 540 is turned off for intermission of discharging, and the valves in the whole system for pipelines for introduction of gases in the device are once closed to discharge the gases remaining in the reaction chamber 501 out of the reaction chamber 501, thereby evacuating the chamber to a predetermined degree of vacuum. Then, the valves 522 and 523 for $SiH_4$/He gas from the gas bomb 502 and $B_2H_6$/He gas from the gas bomb 503, respectively, were opened to adjust the pressures at the outlet pressure gauges 527 and 528 to 1 Kg/cm$^2$, respectively, followed by gradual opening of the inflow valves 512 and 513, respectively, to permit the gases to flow into the mass-flow controllers 507 and 508, respectively. Subsequently, by opening gradually the outflow valves 517, 518 and the auxiliary valve 532, the respective gases are permitted to flow into the reaction chamber 501. The outflow valves 527 and 528 are thereby adjusted so that the ratio of the flow rate of $SiH_4$/He gas to $B_2H_6$/He gas may become a desired value, and opening of the main valve 534 is also adjusted while watching the reading on the vacuum indicator 536 so that the pressure in the reaction chamber may become a desired value. And, after confirming that the temperature of the support 537 is set with the heater 538 within the range from 50° to 400° C., the power from the power source 540 is set at a desired value to excite glow discharging in the reaction chamber 501, which glow discharging is maintained for a predetermined period of time thereby to form a rectifying layer with a desired layer thickness on an interface layer.

Formation of a first amorphous layer (I) may be performed by use of, for example, $SiH_4$/He gas filled in the bomb 502 according to the same procedure as described in the case of the aforesaid interface layer or the rectifying layer. As the starting gas species to be used for formation of a first amorphous layer (I), other than $SiH_4$/He gas, there may be employed particularly effectively $Si_2H_6$/He gas for improvement of layer formation speed.

Formation of a second amorphous layer (II) on a first amorphous layer (I) may be performed by use of, for example, $SiH_4$/He gas filled in the bomb 502 and $C_2H_4$ gas filled in the bomb 506 according to the same procedure as described in the case of the aforesaid interface layer or the rectifying layer.

In case when halogen atoms (X) are to be incorporated in the interface layer, the rectifying layer or the first amorphous layer (I), the gases employed for formation of the above respective layers are further added with, for example, $SiF_4$/He gas and delivered into the reaction chamber 501.

Figure 6:
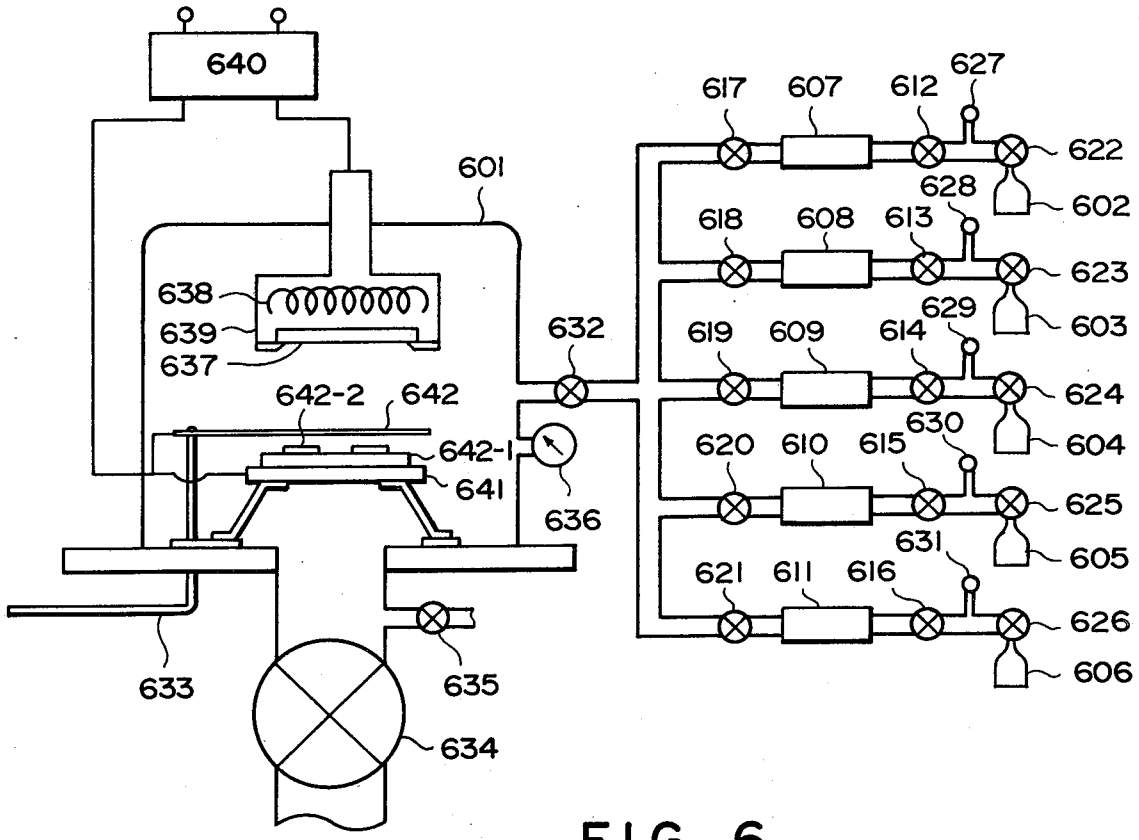

Next, the method for preparation of a photoconductive member by use of a vacuum deposition device as shown in FIG. 6 is to be described. The preparation device shown in FIG. 6 is an example in which the glow discharge decomposition method and the sputtering method can suitably be selected depending on the layers to be formed.

In the gas bombs 611 to 615, there are hermetically contained starting gases for formation of respective layers of the present invention. For example, the bomb 611 is filled with $SiH_4$/He gas, the bomb 612 with $B_2H_6$/He gas, the bomb 613 with $SiF_4$/He, the bomb 614 with $NH_3$ gas and the bomb 615 with Ar gas, respectively. The kinds of gases to be filled in these bombs can of course be changed depending on the kinds of the layers to be formed.

For allowing these gases to flow into the reaction chamber 601, on confirmation of the valves 631–635 of the gas bombs 611–615 and the leak valve 606 to be closed, and the inflow valves 621–625, the outflow valves 626–630 and the auxiliary valves 641 to be opened, the main valve 610 is first opened to evacuate the reaction chamber 601 and the gas pipelines. As the next step, when the reading on the vacuum indicator 642 becomes about $5\times10^{-6}$ Torr, the auxiliary valve 641 and the outflow valves 626 to 630 are closed. Then, the valves of the gas pipelines connected to the bombs of gases to be introduced into the reaction chamber are operated as scheduled to introduce desired gases into the reaction chamber 601.

In the following, one example of the procedure in preparation of a photoconductive member having the constitution as shown in FIG. 3 is to be briefly described.

$SiH_4$/He gas from the gas bomb 611 and $NH_3$ gas from the gas bomb 614 are permitted to flow into the mass-flow controllers 616 and 619, respectively, by opening the valves 631 and 639 to control the pressures at the outlet pressure gauges 636 and 639 to 1 Kg/cm$^2$, respectively, and then opening gradually the inflow valves 621 and 624, respectively. Subsequently, the outflow valves 626 and 629 and the auxiliary valve 641 are gradually opened to permit respective gases to flow into the reaction chamber 601. During this operation, the opening of outflow valves 626 and 629 are controlled so that the relative flow rate ratio of $SiH_4$/He to $NH_3$ may become a desired value and opening of the main valve 610 is also controlled while watching the reading on the vacuum indicator 642 so that the pressure in the reaction chamber 601 may reach a desired value.

And, after confirming that the temperature of the support 609 is set at 50–400° C. by the heater 608, the power source 643 is set at a desired power to excite glow discharge in the reaction chamber 501, and this glow discharging is maintained for a desired period of time to prepare an interface layer on the support with a desired thickness on the support.

Preparation of a rectifying layer on an interface layer may be conducted according to, for example, the procedure as described below.

After formation of an interface has been completed, the power source 643 is turned off for intermission of discharging, and the valves in the whole system for pipelines for introduction of gases in the device are once closed to discharge the gases remaining in the reaction chamber 601 out of the reaction chamber 601, thereby evacuating the chamber to a predetermined degree of vacuum.

Then, the valves 631 and 632 for $SiH_4$/He gas from the gas bomb 611 and $B_2H_6$/He gas from the gas bomb 612, respectively, were opened to adjust the pressures at the outlet pressure gauges 631 and 632 to 1 Kg/cm$^2$, respectively, followed by gradual opening of the inflow valves 621 and 622, respectively, to permit the gases to flow into the mass-flow controllers 616 and 617, respectively. Subsequently, by opening gradually the outflow valves 626, 627 and the auxiliary valve 641, the respective gases are permitted to flow into the reaction chamber 601. The outflow valves 626 and 627 are thereby adjusted so that the ratio of the flow rate of $SiH_4$/He gas to $B_2H_6$/He gas may become a desired value, and opening of the main valve 610 is also adjusted while watching the reading on the vacuum indicator 642 so that the pressure in the reaction chamber may become a desired value. And, after confirming that the temperature of the support 609 is set with the heater 608 within the range from 50 to 400° C., the power from the power source 643 is set at a desired value to excite glow discharging in the reaction chamber 601, which glow discharging is maintained for a predetermined period of time thereby to form a rectifying layer with a desired layer thickness on an interface layer.

Formation of a first amorphous layer (I) may be performed by use of, for example, $SiH_4$/He gas filled in the bomb 611 according to the same procedure as described in the case of the aforesaid interface layer or the rectifying layer.

As the starting gas species to be used for formation of a first amorphous layer (I), other than $SiH_4$/He gas, there may be employed particularly effectively $Si_2H_6$/He gas for improvement of layer formation speed.

Formation of a second amorphous layer (II) on a first amorphous layer (I) may be performed by, for example, the following procedure. First, the shutter 605 is opened. All the gas supplying valves are once closed and the reaction chamber 601 is evacuated by full opening of the main valve 610.

On the electrode 602 to which a high voltage power is to be applied, there are previously provided targets having arranged a high purity silicon wafer 604-1 and high purity graphite wafers 604-2 at a desired area ratio. From the gas bomb 615, Ar gas is introduced into the reaction chamber 601, and the main valve 610 is adjusted so that the inner pressure in the reaction chamber 601 may become 0.05 to 1 Torr. The high voltage power source is turned on and the targets are subjected to sputtering at the same time, whereby a second amorphous layer (II) can be formed on a first amorphous layer (I).

In the case when halogen atoms (X) are to be incorporated in the interface layer, the rectifying layer or the first amorphous layer (I), the gases employed for formation of the above respective layers are further added with, for example, $SiF_4$/He and delivered into the reaction chamber 601.

EXAMPLE 1

By means of the preparation device as shown in FIG. 6, respective layers were consecutively formed on an aluminum substrate under the following conditions, using a high purity silicon wafer in forming the interface layer.

TABLE 1

| | Conditions | | | | | | |
|---|---|---|---|---|---|---|---|
| Order of layer formation | Layer formation method | Gases employed | Flow rate (SCCM) | Flow rate ratio | Inner pressure in reaction chamber (torr) | Discharging power (W/cm$^2$) | Layer thickness |
| 1 (Interface layer) | Sputtering | $N_2$<br>Ar | $N_2$ = 50 | $N_2$:Ar = 1:1 | 0.1 | 0.30 | 500 Å |
| 2 (Rectifying layer) | Glow | $SiH_4$/He = 1<br>$B_2H_6$/He = $1 \times 10^{-2}$ | $SiH_4$ = 200 | $SiH_4$:$B_2H_6$ = 1:1 $\times 10^{-3}$ | 0.3 | 0.18 | 6000 Å |
| 3 (Amorphous layer) | Glow | $SiH_4$/He = 1 | $SiH_4$ = 200 | | 0.3 | 0.18 | 15μ |

Aluminum substrate temperature: 250° C.
Discharging frequency: 13.56 MHz

The image forming member for electrophotography thus obtained was set in a copying device, subjected to corona charging at ⊕ 5 kV for 0.2 sec. and irradiated with a light image. As the light source, a tungsten lamp was employed at a dose of 1.0 lux.sec. The latent image was developed with a negatively charged developer (containing toner and carrier) and transferred onto a plain paper. The presence of any image defect (e.g. blank area at the black image portion) was checked, but no such defect was recognized at all, and the image quality was found to be very good. The toner remaining on the image forming member without being transferred was subjected to cleaning by a rubber blade before turning to the next cycle of copying. Such copying step was repeated for 100,000 times or more, whereby no image defect or peel-off of layers occurred.

EXAMPLE 2

Image forming members for electrophotography were prepared according to entirely the same procedure as in Example 1 except for varying the content of nitrogen atoms relative to silicon atoms in the interface layer by varying the area ratio of Si wafer to $Si_3N_4$ wafer of the targets for sputtering and evaluated similarly to Example 1 to obtain the results shown below.

TABLE 2

| Nitrogen content (atomic %) | $5 \times 10^{-4}$ | 1 | 10 | 20 | 37 | 40 | 50 |
|---|---|---|---|---|---|---|---|
| Evaluation | Readily peeled | Good | Good | Excellent | Excellent | Good | Image defect slightly formed |

TABLE 3

| Layer thickness | 10 Å | 30 Å | 400 Å | 2μ | 5μ |
|---|---|---|---|---|---|
| Evaluation | Readily peeled | Good | Excellent | Good | Image defect slightly formed |

EXAMPLE 4

Image forming members for electrophotography were prepared according to entirely the same procedure as in Example 1 except for varying the layer thickness of the rectifying layer and the content of boron as follows. All of the results were good.

TABLE 4

| Sample No. | 41 | 42 | 43 | 44 | 45 | 46 | 47 |
|---|---|---|---|---|---|---|---|
| Boron content (atomic ppm) | $1 \times 10^5$ | 5000 | 3500 | 1500 | 800 | 500 | 100 |
| Thickness (μ) | 0.3 | 0.4 | 0.8 | 0.5 | 0.9 | 1.5 | 5 |

EXAMPLE 5

By means of the preparation device as shown in FIG. 6, layers were formed on an aluminum substrate under the following conditions.

TABLE 5

| Order of layer formation | Layer formation method | Conditions: Gases employed | Flow rate (SCCM) | Flow rate ratio | Inner pressure in reaction chamber (torr) | Discharging power ($W/cm^2$) | Layer thickness |
|---|---|---|---|---|---|---|---|
| 1 (Interface layer) | Sputtering | $N_2$<br>Ar | $N_2 = 50$ | $N_2$:Ar = 2:1 | 0.1 | 0.30 | 500 Å |
| 2 (Rectifying layer) | Glow | $SiH_4/He = 1$<br>$B_2H_6/He = 1 \times 10^{-2}$ | $SiH_4 = 200$ | $SiH_4:B_2H_6 = 1:1 \times 10^{-3}$ | 0.3 | 0.18 | 1μ |
| 3 (Interface layer) | Sputtering | $N_2$<br>Ar | $N_2 = 50$ | $N_2$Ar = 2:1 | 0.1 | 0.30 | 100 Å |
| 4 (Amorphous layer) | Glow | $SiH_4/He = 1$ | $SiH_4 = 200$ | | 0.3 | 0.18 | 15μ |

EXAMPLE 3

Image forming members for electrophotography were prepared according to entirely the same procedure as in Example 1 except for varying the layer thickness of the interface layer and evaluated similarly to Example 1 to obtain the results shown below.

The image forming member for electrophotography thus obtained was evaluated similarly to Example 1 to obtain very good results.

EXAMPLE 6

Layer forming operations were conducted in the same manner as in Example 1 by means of the device as shown in FIG. 6 except for using the following conditions.

TABLE 6

| Order of layer formation | Conditions: Gases employed | Flow rate (SCCM) | Flow rate ratio | Discharging power ($W/cm^2$) | Layer thickness |
|---|---|---|---|---|---|
| 1 (Interface layer) | $SiH_4/He = 1$<br>$SiF_4/He = 1$<br>$NH_3$ | $SiH_4 = 100$ | $SiH_4:SiF_4:NH_3 = 1:1:2$ | 0.18 | 400 Å |
| 2 (Rectifying layer) | $SiH_4/He = 1$<br>$SiF_4/He = 1$<br>$B_2H_6/He \times 10^{-2}$ | $SiH_4 = 100$ | $SiH_4:SiF_4:B_2H_6 = 1:1:1 \times 10^{-3}$ | 0.18 | 1μ |
| 3 (Amorphous | $SiH_4/He = 1$<br>$SiF_4/He = 1$ | $SiH_4 = 100$ | $SiH_4:SiF_4 = 1:1$ | 0.18 | 15μ |

TABLE 6-continued

| Order of layer formation | Conditions: Gases employed | Flow rate (SCCM) | Flow rate ratio | Discharging power (W/cm²) | Layer thickness |
|---|---|---|---|---|---|
| layer) | | | | | |

The image forming member for electrophotography thus obtained was evaluated similarly to Example 1 to obtain very good results.

EXAMPLE 7

By means of the preparation device as shown in FIG. 6, layers were formed on an aluminum substrate under the following conditions.

TABLE 7

| Order of layer formation | Conditions: Gases employed | Flow rate (SCCM) | | Discharging power (W/cm²) | Layer thickness |
|---|---|---|---|---|---|
| 1 (Interface layer) | Ar | 200 | Area ratio Si wafer:$Si_3N_4$ = 2:1 | 0.3 | 500 Å |
| 2 (Rectifying layer) | $SiH_4$/He = 1 $B_2H_6$/He = $1 \times 10^{-2}$ | $SiH_4$ = 200 | Flow rate ratio $SiH_4$:$B_2H_6$ = 1:4 × $10^{-3}$ | 0.18 | 4000 Å |
| 3 (Amorphous layer (I)) | $SiH_4$/He = 1 | $SiH_4$ = 200 | | 0.18 | 15μ |
| 4 (Amorphous layer (II)) | Ar | 200 | Area ratio Si wafer:graphite = 1.5:8.5 | 0.3 | 0.5μ |

Al substrate temperature: 250° C.
Discharging frequency: 13.56 MHz
Inner pressure in reaction chamber:

| | |
|---|---|
| interface layer | 0.2 Torr |
| rectifying layer, amorphous layer (I) | 0.3 Torr |
| amorphous layer (II) | 0.2 Torr |

The image forming member thus obtained was set in a charging-exposure-developing device, subjected to corona charging at ⊕ 5 kV for 0.2 sec, followed immediately by irradiation of a light image. As the light source, a tungsten lamp was employed and irradiation was effected at 1.0 lux.sec. using a transmissive type test chart.

Immediately thereafter, a negatively charged developer (containing toner and carrier) was cascased onto the surface of the image forming member, whereby a good toner image was obtained thereon.

The thus obtained toner image was once subjected to cleaning with a rubber blade and again the above image making-cleaning steps were repeated. No deterioration of image was observed even after a repetition number of 150,000 or more.

EXAMPLE 8

By means of the preparation device as shown in FIG. 6, layers were formed on an aluminum substrate under the following conditions.

TABLE 8

| Order of layer formation | Conditions: Gases employed | Flow rate (SCCM) | | Discharging power (W/cm²) | Layer thickness |
|---|---|---|---|---|---|
| 1 (Interface layer) | Ar | 200 | Area ratio Si wafer:$Si_3N_4$ = 10:1 | 0.3 | 2000 Å |
| 2 (Rectifying layer) | $SiH_4$/He = 1 $B_2H_6$/He = $1 \times 10^{-2}$ | $SiH_4$ = 200 | Flow rate ratio $SiH_4$:$B_2H_6$ = 1:2 × $10^{-3}$ | 0.18 | 4000 Å |
| 3 (Amorphous layer (I)) | $SiH_4$/He = 1 | $SiH_4$ = 200 | | 0.18 | 15μ |
| 4 (Amorphous layer (II)) | Ar | 200 | Area ratio Si wafer:graphite = 0.5:9.5 | 0.3 | 0.3μ |

Other conditions were the same as in Example 7.

The image forming member thus obtained was set in a charging-exposure-developing device, subjected to corona charging at ⊕ 5 kV for 0.2 sec, followed immediately by irradiation of a light image. As the light source, a tungsten lamp was employed and irradiation was effected at 1.0 lux.sec. using a transmissive type test chart.

Immediately thereafter, a negatively charged developer (containing toner and carrier) was cascaded onto the surface of the image forming member, whereby a good toner image was obtained thereon.

The thus obtained toner image was once subjected to cleaning with a rubber blade and again the above image making-cleaning steps were repeated. No deterioration of image was observed even after a repetition number of 100,000 or more.

EXAMPLE 9

By means of the preparation device as shown in FIG. 6, layers were formed on an aluminum substrate under the following conditions.

TABLE 9

| Order of layer formation | Gases employed | Flow rate (SCCM) | Conditions | Discharging power ($W/cm^2$) | Layer thickness |
|---|---|---|---|---|---|
| 1 (Interface layer) | Ar | 200 | Area ratio Si wafer:$Si_3N_4$ = 2:1 | 0.3 | 500 Å |
| 2 (Rectifying layer) | $SiH_4/He = 1$ $B_2H_6/He = 1 \times 10^{-2}$ | $SiH_4 = 200$ | Flow rate ratio $SiH_4:B_2H_6 = 1:1 \times 10^{-3}$ | 0.18 | 4000 Å |
| 3 (Amorphous layer (I)) | $SiH_4/He = 1$ | $SiH_4 = 200$ | | 0.18 | 15μ |
| 4 (Amorphous layer (II)) | Ar | 200 | Area ratio Si wafer:graphite = 6:4 | 0.3 | 1.0μ |

Other conditions were the same as in Example 7.

The image forming member thus obtained was set in a charging-exposure-developing device, subjected to corona charging at ⊕ 5 kV for 0.2 sec, followed immediately by irradiation of a light image. As the light source, a tungsten lamp was employed and irradiation was effected at 1.0 lux.sec. using a transmissive type test chart.

Immediately thereafter, a negatively charged developer (containing toner and carrier) was cascaded onto the surface of the image forming member, whereby a good toner image with very high density was obtained thereon.

The thus obtained toner image was once subjected to cleaning with a rubber blade and again the above image making-cleaning steps were repeated. No deterioration of image was observed even after a repetition number of 150,000 or more.

EXAMPLE 10

Image forming members were prepared according to entirely the same procedure as in Example 7 except for varying the content ratio of silicon atoms to carbon atoms in the second amorphous layer (II) by varying the area ratio of silicon wafer to graphite during formation of the amorphous layer (II). For the thus obtained image forming members, image evaluations were conducted after repeating 50,000 times the steps of image making, developing and cleaning to obtain the results as shown in Table 10.

TABLE 10

| | | | | | | | |
|---|---|---|---|---|---|---|---|
| Si:C Target (Area ratio) | 9:1 | 6.5:3.5 | 4:6 | 2:8 | 1:9 | 0.5:9.5 | 0.2:9.8 |
| Si:C (Content ratio) | 9.7:0.3 | 8.8:1.2 | 7.3:2.7 | 4.8:5.2 | 3:7 | 2:8 | 0.8:9.2 |
| Image quality evaluation | Δ | ○ | ⊙ | ⊙ | ⊙ | ○ | x |

⊙: Very good
○: Good
Δ: Practically satisfactory
x: Image defect slightly formed

EXAMPLE 11

Image forming members were prepared according to entirely the same procedure as in Example 7 except for varying the layer thickness of the amorphous layer (II). By repeating the image making, developing and cleaning steps as described in Example 7, the following results were obtained.

TABLE 11

| Thickness of amorphous layer (II) (μ) | Results |
|---|---|
| 0.001 | Image defect liable to occur |
| 0.02 | No image defect during 20,000 repetitions |
| 0.05 | Stable for 50,000 repetitions or more |
| 1 | Stable for 200,000 repetitions or more |

EXAMPLE 12

An image forming member was prepared according to the same procedure as in Example 7 except for changing the methods for forming the layers other than the amorphous layer (II) to those as shown in the Table below, and evaluation was conducted similarly to Example 7 to obtain good results.

TABLE 12

| Order of layer formation | Conditions: Gases employed | Flow rate (SCCM) | | Discharging power ($W/cm^2$) | Layer thickness |
|---|---|---|---|---|---|
| 1 (Interface layer) | Ar | 200 | Area ratio Si wafer:$Si_3N_4$ = 2:1 | 0.3 | 500 Å |
| 2 (Rectifying layer) | $SiH_4/He = 1$ $B_2H_6/He = 1 \times 10^{-2}$ | $SiH_4 = 200$ | Flow rate ratio $SiH_4:B_2H_6$ = $1:6.0 \times 10^{-3}$ | 0.18 | 6000 Å |
| 3 (Interface layer) | Ar | 200 | Area ratio Si wafer:$Si_3N_4$ = 2:1 | 0.3 | 100 Å |
| 4 (Amorphous layer (I)) | $SiH_4/He = 1$ | $SiH_4 = 200$ | | 0.18 | 15μ |

EXAMPLE 13

An image forming member was prepared according to the same procedure as in Example 7 except for changing the methods for forming the layers other than the amorphous layer (II) to those as shown in the Table below, and evaluation was conducted similarly to Example 7 to obtain good results.

TABLE 13

| Order of layer formation | Conditions: Gases employed | Flow rate (SCCM) | | Discharging power ($W/cm^2$) | Layer thickness |
|---|---|---|---|---|---|
| 1 (Interface layer) | Ar | 200 | Area ratio Si wafer:$Si_3N_4$ = 1:1 | 0.3 | 400 Å |
| 2 (Rectifying layer) | $SiH_4/He = 1$ $SiF_4/He = 1$ $B_2H_6/He = 1 \times 10^{-2}$ | $SiH_4 = 100$ | Flow rate ratio $SiH_4:SiF_4:B_2H_6$ = $1:1:1 \times 10^{-3}$ | 0.18 | 1μ |
| 3 (Amorphous layer (I)) | $SiH_4/He = 1$ $SiF_4/He = 1$ | $SiH_4 = 100$ | Flow rate ratio $SiH_4:SiF_4 = 1:1$ | 0.18 | 15μ |

EXAMPLE 14

By means of the preparation device as shown in FIG. 6, layers were formed on an aluminum substrate under the following conditions.

TABLE 14

| Order of layer formation | Conditions: Gases employed | Flow rate (SCCM) | | Discharging power ($W/cm^2$) | Layer thickness |
|---|---|---|---|---|---|
| 1 (Interface layer) | Ar | 200 | Area ratio Si wafer:$Si_3N_4$ = 2:1 | 0.3 | 500 Å |
| 2 (Rectifying layer) | $SiH_4/He = 1$ $B_2H_6/He = 1 \times 10^{-2}$ | $SiH_4 = 200$ | Flow rate ratio $SiH_4:B_2H_6$ = $1:4 \times 10^{-3}$ | 0.18 | 4000 Å |
| 3 (Amorphous layer (I)) | $SiH_4/He = 1$ | $SiH_4 = 200$ | | 0.18 | 15μ |
| 4 (Amorphous layer (II)) | $SiH_4/He = 0.5$ $C_2H_4$ | $SiH_4 = 100$ | Flow rate ratio $SiH_4:C_2H_4 = 3:7$ | 0.18 | 0.5μ |

Al substrate temperature: 250° C.
Discharging frequency: 13.56 MHz
Inner pressure in reaction chamber:

| | |
|---|---|
| interface layer | 0.2 Torr |
| rectifying layer } amorphous layer (I) | 0.3 Torr |
| amorphous layer (II) | 0.2 Torr |

The image forming member thus obtained was set in a copying device, subjected to corona charging at ⊕ 5 kV for 0.2 sec. followed by irradiation of a light image. As the light source, a tungsten lamp was employed and irradiation was effected at 1.0 lux.sec. The latent image was developed with a negatively charged developer (containing toner and carrier) and transferred onto a plain paper, whereby a very good transferred image was obtained thereon.

The toner remaining on the image forming member for electrophotography was subjected to cleaning with a rubber blade before turning to the next cycle of copying. No deterioration of image was observed even after repeating such steps 150,000 times or more.

EXAMPLE 15

By means of the preparation device as shown in FIG. 6, layers were formed on an aluminum substrate under the following conditions.

TABLE 15

| Order of layer formation | Conditions: Gases employed | Flow rate (SCCM) | | Discharging power ($W/cm^2$) | Layer thickness |
|---|---|---|---|---|---|
| 1 (Interface layer) | Ar | 200 | Area ratio Si wafer:$Si_3N_4$ = 10:1 | 0.3 | 2000 Å |
| 2 (Rectifying layer) | $SiH_4/He = 1$ $B_2H_6/He = 1 \times 10^{-2}$ | $SiH_4 = 200$ | Flow rate ratio $SiH_4:B_2H_6 = 1:2 \times 10^{-3}$ | 0.18 | 4000 Å |
| 3 (Amorphous layer (I)) | $SiH_4/He = 1$ | $SiH_4 = 200$ | | 0.18 | 15μ |
| 4 (Amorphous layer (II)) | $SiH_4/He = 1$ $C_2H_4$ | $SiH_4 = 15$ | Flow rate ratio $SiH_4:C_2H_4 = 0.4:9.6$ | 0.18 | 0.3μ |

Other conditions were the same as in Example 14.

The image forming member thus obtained was set in a copying device, subjected to corona charging at ⊕ 5 kV for 0.2 sec., followed by irradiation of a light image. As the light source, a tungsten lamp was employed and irradiation was effected at 1.0 lux.sec. The latent image was developed with a negatively charged developer (containing toner and carrier) and transferred onto a plain paper, whereby a very good transferred image was obtained thereon.

The toner remaining on the image forming member for electrophotography was subjected to cleaning with a rubber blade before turning to the next cycle of copying. No deterioration of image was observed even after repeating such steps 100,000 times or more.

EXAMPLE 16

By means of the preparation device as shown in FIG. 6, layers were formed on an aluminum substrate under the following conditions.

TABLE 16

| Order of layer formation | Conditions: Gases employed | Flow rate (SCCM) | | Discharging power ($W/cm^2$) | Layer thickness |
|---|---|---|---|---|---|
| 1 (Interface layer) | Ar | 200 | Area ratio Si wafer:$Si_3N_4$ = 2:1 | 0.3 | 500 Å |
| 2 (Rectifying layer) | $SiH_4/He = 1$ $B_2H_6/He = 1 \times 10^{-2}$ | $SiH_4 = 200$ | Flow rate ratio $SiH_4:B_2H_6 = 1:1 \times 10^{-3}$ | 0.18 | 4000 Å |
| 3 (Amorphous layer (I)) | $SiH_4/He = 1$ | $SiH_4 = 200$ | | 0.18 | 15μ |
| 3 (Amorphous layer (II)) | $SiH_4/He = 0.5$ $C_2H_4$ | $SiH_4 = 100$ | Flow rate ratio $SiH_4:C_2H_4 = 5:5$ | 0.18 | 1.5μ |

Other conditions were the same as in Example 14.

The image forming member thus obtained was set in a copying device, subjected to corona charging at ⊕ 5 kV for 0.2 sec., followed by irradiation of a light image. As the light source, a tungsten lamp was employed and irradiation was effected at 1.0 lux.sec. The latent image was developed with a negatively charged developer (containing toner and carrier) and transferred onto a plain paper. The transferred image was good with a very high density.

The toner remaining on the image forming member for electrophotography was subjected to cleaning with a rubber blade before turning to the next cycle of copying. No deterioration of image was observed even after repeating such steps 150,000 times or more.

EXAMPLE 17

Image forming members were prepared according to entirely the same procedure as in Example 14 except for varying the content ratio of silicon atoms to carbon atoms in the second amorphous layer (II) by varying the flow rate ratio of $SiH_4$ gas to $C_2H_4$ gas during formation of the amorphous layer (II). For the thus obtained image forming member for electrophotography, image evaluations were conducted after repeating 50,000 times the image forming step to the transferring step as described in Example 14 to obtain the results as shown in Table 17.

TABLE 17

| | | | | | | | |
|---|---|---|---|---|---|---|---|
| $SiH_4$: $C_2H_4$ | 9:1 | 6:4 | 4:6 | 2:8 | 1:9 | 0.5:9.5 | 0.35: 9.65 | 0.2:9.8 |

(Flow

TABLE 17-continued

| rate ratio) Si:C (Content ratio) | 9:1 | 7:3 | 5.5:4.5 | 4:6 | 3:7 | 2:8 | 1.2:8.8 | 0.8:9.2 |
|---|---|---|---|---|---|---|---|---|
| Image quality evaluation | ○ | ⊙ | ⊙ | ⊙ | ⊙ | ⊙ | ○ | x |

⊙: Very good
○: Good
x: Image defect slightly formed

EXAMPLE 18

Layer formation was conducted according to entirely the same procedure as in Example 14 except for varying the layer thickness of the amorphous layer (II). The results of evaluation are as shown in the Table below.

TABLE 18

| Thickness of amorphous layer (II) (μ) | Results |
|---|---|
| 0.001 | Image defect liable to occur |
| 0.02 | No image defect during 20,000 repetitions |
| 0.05 | No image defect during 50,000 repetitions |
| 2 | Stable for 200,000 repetitions or more |

EXAMPLE 19

Layer formation was conducted according to the same procedure as in Example 14 except for changing the methods for forming the layers other than the amorphous layer (II) to those as shown in the Table below, and evaluation was made to obtain good results.

TABLE 19

| Order of layer formation | Conditions: Gases employed | Flow rate (SCCM) | | Discharging power ($W/cm^2$) | Layer thickness |
|---|---|---|---|---|---|
| 1 (Interface layer) | Ar | 200 | Area ratio Si wafer:$Si_3N_4$ = 1:1 | 0.3 | 400 Å |
| 2 (Rectifying layer) | $SiH_4/He = 1$ $SiF_4/He = 1$ $B_2H_6/He = 1 \times 10^{-2}$ | $SiH_4 = 100$ | Flow rate ratio $SiH_4:SiF_4:B_2H_6 = 1:1:1 \times 10^{-3}$ | 0.18 | 1μ |
| 3 (Amorphous layer (I)) | $SiH_4/He = 1$ $SiF_4/He = 1$ | $SiH_4 = 100$ | Flow rate ratio $SiH_4:SiF_4 = 1:1$ | 0.18 | 15μ |

EXAMPLE 20

Layer formation was carried out according to the same procedure as in Example 14 except for changing the methods for forming the layers other than the amorphous layer (II) to those as shown in the Table below, and evaluation was made to obtain good results.

TABLE 20

| Order of layer formation | Conditions: Gases employed | Flow rate (SCCM) | | Discharging power ($W/cm^2$) | Layer thickness |
|---|---|---|---|---|---|
| 1 (Interface layer) | Ar | 200 | Area ratio Si wafer:$Si_3N_4$ = 2:1 | 0.3 | 500 Å |
| 2 (Rectifying layer) | $SiH_4/He = 1$ $B_2H_6/He = 1 \times 10^{-2}$ | $SiH_4 = 200$ | Flow rate ratio $SiH_4:B_2H_6 = 1:6.0 \times 10^{-3}$ | 0.18 | 6000 Å |
| 3 (Interface layer) | Ar | 200 | Area ratio Si wafer:$Si_3N_4$ = 2:1 | 0.3 | 100 Å |
| 4 (Amorphous layer (I)) | $SiH_4/He = 1$ | $SiH_4 = 200$ | | 0.18 | 15μ |

EXAMPLE 21

By means of the preparation device as shown in FIG. 6, layers were formed on an aluminum substrate under the following conditions.

TABLE 21

| Order of layer formation | Conditions: Gases employed | Flow rate (SCCM) | | Discharging power ($W/cm^2$) | Layer thickness |
|---|---|---|---|---|---|
| 1 (Interface layer) | Ar | 200 | Area ratio Si wafer:$Si_3N_4$ = 2:1 | 0.3 | 500 Å |
| 2 (Rectifying layer) | $SiH_4/He = 1$ $B_2H_6/He = 1 \times 10^{-2}$ | $SiH_4 = 200$ | Flow rate ratio $SiH_4:B_2H_6 = 1:4 \times 10^{-3}$ | 0.18 | 4000 Å |
| 3 (Amorphous layer (I)) | $SiH_4/He = 1$ | $SiH_4 = 200$ | | 0.18 | 15μ |
| 4 (Amorphous layer (II)) | $SiH_4/He = 0.5$ $SiF_4/He = 0.5$ $C_2H_4$ | $SiH_4 + SiF_4 =$ 150 | Flow rate ratio $SiH_4:SiF_4:C_2H_4$ = 1.5:1.5:7 | 0.18 | 0.5μ |

Al substrate temperature: 250° C.
Discharging frequency: 13.56 MHz
Inner pressure in reaction chamber:

| | |
|---|---|
| interface layer | 0.2 Torr |
| rectifying layer, amorphous layer (I) | 0.3 Torr |
| amorphous layer (II) | 0.5 Torr |

The image forming member thus obtained was set in a charging-exposure-developing device, subjected to corona charging at ⊕ 5 kV for 0.2 sec., followed immediately by irradiation of a light image. As the light source, a tungsten lamp was employed and irradiation was effected at 1.0 lux.sec. using a transmissive type test chart.

Immediately thereafter, a negatively charged developer (containing toner and carrier) was cascaded onto the surface of the image forming member, whereby a good toner image was obtained thereon.

The thus obtained toner image was once subjected to cleaning with a rubber blade and again the above image making-cleaning steps were repeated. No deterioration of image was observed even after a repetition number of 150,000 or more.

EXAMPLE 22

By means of the preparation device as shown in FIG. 6, layers were formed on an aluminum substrate under the following conditions.

TABLE 22

| Order of layer formation | Conditions: Gases employed | Flow rate (SCCM) | | Discharging power ($W/cm^2$) | Layer thickness |
|---|---|---|---|---|---|
| 1 (Interface layer) | Ar | 200 | Area ratio Si wafer:$Si_3N_4$ = 10:1 | 0.3 | 2000 Å |
| 2 (Rectifying layer) | $SiH_4/He = 1$ $B_2H_6/He = 1 \times 10^{-2}$ | $SiH_4 = 200$ | Flow rate ratio $SiH_4:B_2H_6 = 1:2 \times 10^{-3}$ | 0.18 | 4000 Å |
| 3 (Amorphous layer (I)) | $SiH_4/He = 1$ | $SiH_4 = 200$ | | 0.18 | 15μ |
| 4 (Amorphous layer (II)) | $SiH_4/He = 0.5$ $SiF_4/He = 0.5$ $C_2H_4$ | $SiH_4 + SiF_4 =$ 15 | Flow rate ratio $SiH_4:SiF_4:C_2H_4$ = 0.3:0.1:9.6 | 0.18 | 0.3μ |

Other conditions were the same as in Example 21.

The image forming member thus obtained was set in a charging-exposure-developing device, subjected to corona charging at ⊕5 kV for 0.2 sec., followed immediately by irradiation of a light image. As the light source, a tungsten lamp was employed and irradiation was effected at 1.0 lux.sec. using a transmissive type test chart.

Immediately thereafter, a negatively charged developer (containing toner and carrier) was cascaded onto the surface of the image forming member, whereby a good toner image was obtained thereon.

The thus obtained toner image was once subjected to cleaning with a rubber blade and again the above image making-cleaning steps were repeated. No deteriotation of image was observed even after a repetition number of 100,000 or more.

EXAMPLE 23

By means of the preparation device as shown in FIG. 6, layers were formed on an aluminum substrate under the following conditions.

TABLE 23

| Order of layer formation | Conditions: Gases employed | Flow rate (SCCM) | | Discharging power ($W/cm^2$) | Layer thickness |
|---|---|---|---|---|---|
| 1 (Interface layer) | Ar | 200 | Area ratio Si wafer:$Si_3N_4$ = 2:1 | 0.3 | 500 Å |
| 2 (Rectifying layer) | $SiH_4/He = 1$ $B_2H_6/He = 1 \times 10^{-2}$ | $SiH_4 = 200$ | Flow rate ratio $SiH_4:B_2H_6 = 1:1 \times 10^{-3}$ | 0.18 | 4000 Å |
| 3 (Amorphous layer (I)) | $SiH_4/He = 1$ | $SiH_4 = 200$ | | 0.18 | 15μ |
| 4 (Amorphous layer (II)) | $SiH_4/He = 0.5$ $SiF_4/He = 0.5$ $C_2H_4$ | $SiH_4 + SiF_4 = 150$ | Flow rate ratio $SiH_4:SiF_4:C_2H_4$ = 3:3:4 | 0.18 | 1.5μ |

Other conditions were the same as in Example 21.

The image forming member thus obtained was set in a charging-exposure-developing device, subjected to corona charging at ⊕5 kV for 0.2 sec., followed immediately by irradiation of a light image. As the light source, a tungsten lamp was employed and irradiation was effected at 1.0 lux.sec. using a transmissive type test chart.

Immediately thereafter, a negatively charged developer (containing toner and carrier) was cascaded onto the surface of the image forming member, whereby a good toner image with very high density was obtained thereon.

The thus obtained toner image was once subjected to cleaning with a rubber blade and again the above image making-cleaning steps were repeated. No deterioration of image was observed even after a repetition number of 150,000 or more.

EXAMPLE 24

Image forming members were prepared according to entirely the same procedure as in Example 21 except for varying the content ratio of silicon atoms to carbon atoms in the second amorphous layer (II) by varying the flow rate ratio of $SiH_4$ gas: $SiF_4$ gas: $C_2H_4$ gas during formation of the amorphous layer (II). For the thus obtained image forming members, image evaluations were conducted after repeating 50,000 times the steps of image making, developing and cleaning similarly as described in Example 21 to obtain the results as shown in Table 24.

TABLE 24

| | | | | | | | | |
|---|---|---|---|---|---|---|---|---|
| $SiH_4$: $SiF_4$: $C_2H_4$ (Flow rate | 5: 4: 1 | 3: 3.5: 3.5 | 2: 2: 6 | 1: 1: 8 | 0.6: 0.4: 9 | 0.2: 0.3: 9.5 | 0.2: 0.15: 9.65 | 0.1: 0.1: 9.8 |

TABLE 24-continued

| | | | | | | | | |
|---|---|---|---|---|---|---|---|---|
| ratio) Si:C (Content ratio) | 9:1 | 7:3 | 5.5:4.5 | 4:6 | 3:7 | 2:8 | 1.2:8.8 | 0.8:9.2 |
| | ○ | ◎ | ◎ | ◎ | ◎ | ◎ | ○ | x |

◎: Very good
○ : Good
x: Image defect slightly formed

EXAMPLE 25

Image forming members were prepared according to entirely the same procedure as in Example 21 except for varying the layer thickness of the amorphous layer (II). By repeating the image making, developing and cleaning steps as described in Example 21, the following results were obtained.

TABLE 25

| Thickness of amorphous layer (II) (μ) | Results |
|---|---|
| 0.001 | Image defect liable to occur |
| 0.02 | No image defect during 20,000 repetitions |
| 0.05 | Stable for 50,000 repetitions or more |
| 1 | Stable for 200,000 repetitions or more |

EXAMPLE 26

An image forming member was prepared according to the same procedure as in Example 21 except for changing the methods for forming the layers other than the amorphous layer (II) to those as shown in the Table below, the evaluation was conducted similarly to Example 21 to obtain good results.

TABLE 26

| Order of layer formation | Conditions: Gases employed | Flow rate (SCCM) | | Discharging power ($W/cm^2$) | Layer thickness |
|---|---|---|---|---|---|
| 1 (Interface layer) | Ar | 200 | Area ratio Si wafer:$Si_3N_4$ = 2:1 | 0.3 | 500 Å |
| 2 (Rectifying layer) | $SiH_4/He = 1$ $B_2H_6/He = 1 \times 10^{-2}$ | $SiH_4 = 200$ | Flow rate ratio $SiH_4:B_2H_6 = 1:6.0 \times 10^{-3}$ | 0.18 | 6000 Å |

TABLE 26-continued

| Order of layer formation | Conditions: Gases employed | Flow rate (SCCM) | | Discharging power (W/cm²) | Layer thickness |
|---|---|---|---|---|---|
| 3 (Interface layer) | Ar | 200 | Area ratio Si wafer:$Si_3N_4$ = 2:1 | 0.3 | 100 Å |
| 4 (Amorphous layer (I)) | $SiH_4$/He = 1 | $SiH_4$ = 200 | | 0.18 | 15μ |

EXAMPLE 27

An image forming member was prepared according to the same procedure as in Example 21 except for changing the methods for forming the layers other than the amorphous layer (II) to those as shown in the Table below, and evaluation was conducted similarly as in Example 21 to obtain good results.

TABLE 27

| Order of layer formation | Conditions: Gases employed | Flow rate (SCCM) | | Discharging power (W/cm²) | Layer thickness |
|---|---|---|---|---|---|
| 1 (Interface layer) | Ar | 200 | Area ratio Si wafer:$Si_3N_4$ = 1:1 | 0.3 | 400 Å |
| 2 (Rectifying layer) | $SiH_4$/He = 1<br>$SiF_4$/He = 1<br>$B_2H_6$/He = 1 × $10^{-2}$ | $SiH_4$ = 100 | Flow rate ratio $SiH_4$:$SiF_4$:$B_2H_6$ = 1:1:1 × $10^{-3}$ | 0.18 | 1μ |
| 3 (Amorphous layer (I)) | $SiH_4$/He = 1<br>$SiF_4$/He = 1 | $SiH_4$ = 100 | Flow rate ratio $SiH_4$:$SiF_4$ = 1:1 | 0.18 | 15μ |

EXAMPLE 28

An image forming member was prepared according to the same method as in Example 23 except that the amorphous layer (II) was formed according to the sputtering method under the conditions shown in the Table below, and evaluated similarly to Example 23 to obtain good results.

TABLE 28

| | Gases employed | Flow rate (SCCM) | Target area ratio Si wafer: graphite | Discharging power (W/cm²) | Layer thickness (μ) |
|---|---|---|---|---|---|
| Amorphous layer (II) | Ar<br>$SiF_4$/He = 0.5 | Ar = 200<br>$SiF_4$ = 100 | 2.5:7.5 | 0.3 | 1 |

EXAMPLE 29

An image forming member was prepared according to the same method as in Example 23 except that the amorphous layer (II) was formed according to the sputtering method under the conditions shown in the Table below, and evaluated similarly as in Example 23 to obtain good results.

TABLE 28A

| | Gases employed | Flow rate (SCCM) | Target area ratio Si wafer: graphite | Discharging power (W/cm²) | Layer thickness (μ) |
|---|---|---|---|---|---|
| Amorphous layer (II) | Ar<br>$SiF_4$/He = 0.5 | Ar = 200<br>$SiF_4$ = 100 | 3.0:7.0 | 0.3 | 0.5 |

EXAMPLE 30

By means of the preparation device as shown in FIG. 5, layers were formed on a drum-shaped aluminum substrate under the following conditions.

TABLE 29

| Order of layer formation | Conditions: Gases employed | Flow rate (SCCM) | Flow rate ratio | Discharging power (W/cm²) | Layer thickness |
|---|---|---|---|---|---|
| 1 (Interface layer) | $SiH_4$/He = 1<br>$NH_3$ | $SiH_4$ = 100 | $SiH_4$:$NH_3$ = 3:1 | 0.18 | 500 Å |
| 2 (Rectifying layer) | $SiH_4$/He = 1<br>$B_2H_6$/He = 1 × $10^{-2}$ | $SiH_4$ = 200 | $SiH_4$:$B_2H_6$ = 1:4 × $10^{-3}$ | 0.18 | 4000 Å |
| 3 (Amorphous | $SiH_4$/He = 1 | $SiH_4$ = 200 | | 0.18 | 15μ |

TABLE 29-continued

| Order of layer formation | Conditions: Gases employed | Flow rate (SCCM) | Flow rate ratio | Discharging power (W/cm²) | Layer thickness |
|---|---|---|---|---|---|
| layer) | | | | | |

Aluminum substrate temperature: 250° C.
Discharging frequency: 13.56 MHz
Inner pressure in reaction chamber: 0.3 Torr The image forming member for electrophotography thus obtained was set in a copying device, subjected to corona charging at ⊕5 kV for 0.2 sec and irradiated with a light image. As the light source, a tungsten lamp was employed at 1.0 lux.sec. The latent image was developed with a negatively charged developer (containing toner and carrier) and transferred onto a plain paper. The transferred image was very good. The toner remaining on the image forming member without being transferred was subjected to cleaning by a rubber blade before turning to the next cycle of copying. Such step was repeated for 100,000 times or more, whereby no peel-off of layers occurred and the images were good.

EXAMPLE 31

Image forming members for electrophotography were prepared according to entirely the same procedure as in Example 30 except for varying the content of nitrogen atoms relative to silicon atoms in the interface layer.

The results of evaluations conducted similarly as in Example 30 are shown below.

TABLE 30

| Nitrogen atom content (atomic %) | 0.1 | 1 | 10 | 20 | 23 | 25 |
|---|---|---|---|---|---|---|
| Evaluation | Good | Good | Excellent | Good | Good | Image defect formed in few cases |

EXAMPLE 32

Image forming members for electrophotography were prepared according to entirely the same procedure as in Example 30 except for varying the layer thickness of the interface layer and evaluated similarly to Example 30 to obtain the results shown below.

TABLE 31

| Layer thickness | 10 Å | 30 Å | 400 Å | 2μ | 5μ |
|---|---|---|---|---|---|
| Evaluation | Readily peeled | o | o | o | Image defect formed in some cases |

o: Not peeled, and good image obtained.

EXAMPLE 33

Image forming members for electrophotography were prepared according to entirely the same procedure as in Example 30 except for varying the layer thickness of the rectifying layer and the content of boron as follows. All of the results were good.

TABLE 32

| Sample No. | 31 | 32 | 33 | 34 | 35 | 36 | 37 |
|---|---|---|---|---|---|---|---|
| Boron content (atomic ppm) | $1 \times 10^5$ | 5000 | 3500 | 1500 | 800 | 500 | 100 |
| Thickness (μ) | 0.3 | 0.4 | 0.8 | 0.5 | 0.9 | 1.5 | 5 |

EXAMPLE 34

By means of the preparation device as shown in FIG. 5, layers were formed on a drum-shaped aluminum substrate under the following conditions.

TABLE 43

| Order of layer formation | Conditions: Gases employed | Flow rate (SCCM) | Flow rate ratio | Discharging power (W/cm²) | Layer thickness |
|---|---|---|---|---|---|
| 1 (Lower interface layer) | $SiH_4/He = 1$ $NH_3$ | $SiH_4 = 100$ | $SiH_4:NH_3 = 3:1$ | 0.18 | 500 Å |
| 2 (Rectifying layer) | $SiH_4/He = 1$ $B_2H_6/He = 1 \times 10^{-2}$ | $SiH_4 = 200$ | $SiH_4:B_2H_6 = 1:6.0 \times 10^{-3}$ | 0.18 | 6000 Å |
| 3 (Upper interface layer) | $SiH_4/He = 1$ $NH_3$ | $SiH_4 = 10$ | $SiH_4:NH_3 = 3:1$ | 0.18 | 500 Å |
| 4 (Amorphous layer) | $SiH_4/He = 1$ | $SiH_4 = 200$ | | 0.18 | 15μ |

The image forming member obtained was of a high quality with no peel-off of layers and no image defect at all.

EXAMPLE 35

By means of the device as shown in FIG. 5, layers were formed on a drum-shaped aluminum substrate under the following conditions.

TABLE 34

| Order of layer formation | Conditions: Gases employed | Flow rate (SCCM) | Flow rate ratio | Discharging power (W/cm²) | Layer thickness |
|---|---|---|---|---|---|
| 1 (Interface layer) | $SiH_4$/He = 1<br>$NH_3$ | $SiH_4$ = 100 | $SiH_4$:$NH_3$ = 1:1 | 0.18 | 400 Å |
| 2 (Rectifying layer) | $SiH_4$/He = 1<br>$SiF_4$/He = 1<br>$B_2H_6$/He = $1 \times 10^{-2}$ | $SiH_4$ = 100 | $SiH_4$:$SiF_4$:$B_2H_6$ = 1:1:1 × $10^{-3}$ | 0.18 | 1μ |
| 3 (Amorphous layer) | $SiH_4$/He = 1<br>$SiF_4$/He = 1 | $SiH_4$ = 100 | $SiH_4$:$SiF_4$ = 1:1 | 0.18 | 15μ |

The image forming member for electrophotography thus obtained was evaluated similarly to Example 30 to obtain very good results.

EXAMPLE 36

By means of the preparation device as shown in FIG. 6, layers were formed on an aluminum substrate under the following conditions.

TABLE 35

| Order of layer formation | Conditions: Gases employed | Flow rate (SCCM) | | Discharging power (W/cm²) | Layer thickness |
|---|---|---|---|---|---|
| 1 (Interface layer) | $SiH_4$/He = 1<br>$NH_3$ | $SiH_4$ = 100 | Flow rate ratio<br>$SiH_4$/$NH_3$ = 3:1 | 0.18 | 500 Å |
| 2 (Rectifying layer) | $SiH_4$/He = 1<br>$B_2H_6$/He = $1 \times 10^{-2}$ | $SiH_4$ = 200 | Flow rate ratio<br>$SiH_4$:$B_2H_6$ = 1:4 × $10^{-3}$ | 0.18 | 4000 Å |
| 3 (Amorphous layer (I)) | $SiH_4$/He = 1 | $SiH_4$ = 200 | | 0.18 | 15μ |
| 4 (Amorphous layer (II)) | Ar | 200 | Area ratio<br>Si wafer:graphite = 1.5:8.5 | 0.3 | 0.5μ |

Al substrate temperature: 250° C.
Discharging frequency: 13.56 MHz
Inner pressure in reaction chamber:
amorphous layer (I) 0.3 Torr
amorphous layer (II) 0.2 Torr The image forming member thus obtained was set in a charging-exposure-developing device, subjected to corona charging at ⊕5 kV for 0.2 sec., followed immediately by irradiation of a light image. As the light source, a tungsten lamp was employed and irradiation was effected at 1.0 lux.sec. using a transmissive type test chart.

Immediately thereafter, a negatively charged developer (containing toner and carrier) was cascaded onto the surface of the image forming member, whereby a good toner image was obtained thereon.

The thus obtained toner image was once subjected to cleaning with a rubber blade and again the above image making-cleaning steps were repeated. No deterioration of image was observed even after a repetition number of 150,000 or more.

EXAMPLE 37

By means of the preparation device a shown in FIG. 6, layers were formed on an aluminum substrate under the following conditions.

TABLE 36

| Order of layer formation | Conditions: Gases employed | Flow rate (SCCM) | Flow rate ratio | Discharging power (W/cm²) | Layer thickness |
|---|---|---|---|---|---|
| 1 (Interface layer) | $SiH_4$/He = 1<br>$NH_3$ | $SiH_4$ = 100 | $SiH_4$:$NH_3$ = 10:1 | 0.18 | 2000 Å |
| 2 (Rectifying layer) | $SiH_4$/He = 1<br>$B_2H_6$/He = $1 \times 10^{-2}$ | $SiH_4$ = 200 | $SiH_4$:$B_2H_6$ = 1:2 × $10^{-3}$ | 0.18 | 4000 Å |
| 3 (Amorphous layer (I)) | $SiH_4$/He = 1 | $SiH_4$ = 200 | | 0.18 | 15μ |
| 4 (Amorphous layer (II)) | Ar | 200 | Si wafer:graphite = 0.5:9.5 (area ratio) | 0.3 | 0.3μ |

Other conditions were the same as in Example 36.

The image forming member thus obtained was set in a charging-exposure-developing device, subjected to corona charging at ⊕5 kV for 0.2 sec., followed immediately by irradiation of a light image. As the light source, a tungsten lamp was employed and irradiation was effected at 1.0 lux.sec. using a transmissive type test chart.

Immediately thereafter, a negatively charged developer (containing toner and carrier) was cascaded onto the surface of the image forming member, whereby a good toner image was obtained thereon.

The thus obtained toner image was once subjected to cleaning with a rubber blade and again the above image making-cleaning steps were repeated. No deterioration of image was observed even after a repetition number of 100,000 or more.

EXAMPLE 38

By means of the preparation device as shown in FIG. 6, layers were formed on an aluminum substrate under the following conditions.

TABLE 37

| Order of layer formation | Conditions: Gases employed | Flow rate (SCCM) | Flow rate ratio | Discharging power ($W/cm^2$) | Layer thickness |
|---|---|---|---|---|---|
| 1 (Interface layer) | $SiH_4/He = 1$ $NH_3$ | $SiH_4 = 100$ | $SiH_4:NH_3 = 3:1$ | 0.18 | 500 Å |
| 2 (Rectifying layer) | $SiH_4/He = 1$ $B_2H_6/He = 1 \times 10^{-2}$ | $SiH_4 = 200$ | $SiH_4:B_2H_6 = 1:1 \times 10^{-3}$ | 0.18 | 4000 Å |
| 3 (Amorphous layer (I)) | $SiH_4/He = 1$ | $SiH_4 = 200$ | | 0.18 | 15μ |
| 4 (Amorphous layer (II)) | Ar | 200 | Si wafer:graphite = 6:4 (area ratio) | 0.3 | 1.0μ |

Other conditions were the same as in Example 36.

The image forming member thus obtained was set in a charging-exposure-developing device, subjected to corona charging at ⊕5 kV for 0.2 sec., followed immediately by irradiation of a light image. As the light source, a tungsten lamp was employed and irradiation was effected at 1.0 lux.sec. using a transmissive type test chart.

Immediately thereafter, a negatively charged developer (containing toner and carrier) was cascaded onto the surface of the image forming member, whereby a good toner image with very high density was obtained thereon.

The thus obtained toner image was once subjected to cleaning with a rubber blade and again the above image making-cleaning steps were repeated. No deterioration of image was observed even after a repetition number of 150,000 or more.

EXAMPLE 39

Image forming members were prepared according to entirely the same procedure as in Example 36 except for changing the content ratio of silicon atoms to carbon atoms in the second amorphous layer (II) by changing the area ratio of silicon wafer to graphite during formation of the amorphous layer (II). For the thus obtained image forming member, image evaluations were conducted after repeating 50,000 times the steps of image making, developing and cleaning to obtain the results as shown in Table 38.

TABLE 38

| | | | | | | | |
|---|---|---|---|---|---|---|---|
| Si:C Target (Area ratio) | 9:1 | 6.5:3.5 | 4:6 | 2:8 | 1:9 | 0.5:9.5 | 0.2:9.8 |
| Si:C (Content ratio) | 9.7:0.3 | 8.8:1.2 | 7.3:2.7 | 4.8:5.2 | 3:7 | 2:8 | 0.8:9.2 |
| Image quality evaluation | Δ | ○ | ⊙ | ⊙ | ⊙ | ○ | x |

⊙: Very good
○: Good
Δ: Practically satisfactory
x: Image defect slightly formed

EXAMPLE 40

Image forming members were prepared according to entirely the same procedure as in Example 36 except for varying the film thickness of the amorphous layer (II). By repeating the image making, developing and cleaning steps as described in Example 36, the following results were obtained.

TABLE 39

| Thickness of amorphous layer (II) (μ) | Results |
|---|---|
| 0.001 | Image defect liable to occur |
| 0.02 | No image defect during 20,000 repetitions |
| 0.05 | Stable after 50,000 repetitions or more |
| 1 | Stable after 200,000 repetitions or more |

EXAMPLE 41

An image forming member was prepared according to the same procedure as in Example 36 except for changing the methods for forming the layers other than the amorphous layer (II) to those as shown in the Table below, and evaluation was conducted similarly to Example 36 to obtain good results.

TABLE 40

| Order of layer formation | Conditions: Gases employed | Flow rate (SCCM) | Flow rate ratio | Discharging power ($W/cm^2$) | Layer thickness |
|---|---|---|---|---|---|
| 1 (Interface layer) | $SiH_4/He = 1$ $NH_3$ | $SiH_4 = 100$ | $SiH_4:NH_3 = 3:1$ | 0.18 | 500 Å |
| 2 (Rectifying layer) | $SiH_4/He = 1$ $B_2H_6/He = 1 \times 10^{-2}$ | $SiH_4 = 200$ | $SiH_4:B_2H_6 = 1:6.0 \times 10^{-3}$ | 0.18 | 6000 Å |
| 3 (Interface layer) | $SiH_4/He = 100$ $NH_3$ | $SiH_4 = 100$ | $SiH_4:NH_3 = 3:1$ | 0.18 | 500 Å |
| 4 (Amorphous layer (I)) | $SiH_4/He = 1$ | $SiH_4 = 200$ | | 0.18 | 15μ |

EXAMPLE 42

An image forming member was prepared according to the same procedure as in Example 36 except for changing the methods for forming the layers other than the amorphous layer (II) to those as shown in the Table below, and evaluation was conducted similarly to Example 36 to obtain good results.

TABLE 41

| Order of layer formation | Conditions: Gases employed | Flow rate (SCCM) | Flow rate ratio | Discharging power ($W/cm^2$) | Layer thickness |
|---|---|---|---|---|---|
| 1 (Interface layer) | $SiH_4/He = 1$ $NH_3$ | $SiH_4 = 100$ | $SiH_4:NH_3 = 1:1$ | 0.18 | 400 Å |
| 2 (Rectifying layer) | $SiH_4/He = 1$ $SiF_4/He = 1$ $B_2H_6/He = 1 \times 10^{-2}$ | $SiH_4 = 100$ | $SiH_4:SiF_4:B_2H_6 = 1:1:1 \times 10^{-3}$ | 0.18 | 1μ |
| 3 (Amorphous layer (I)) | $SiH_4/He = 1$ $SiF_4/He = 1$ | $SiH_4 = 100$ | $SiH_4:SiF_4 = 1:1$ | 0.18 | 15μ |

EXAMPLE 43

By means of the preparation device as shown in FIG. 5, layers were formed on a drum-shaped aluminum substrate under the following conditions.

TABLE 42

| Order of layer formation | Conditions: Gases employed | Flow rate (SCCM) | Flow rate ratio | Discharging power ($W/cm^2$) | Layer thickness |
|---|---|---|---|---|---|
| 1 (Interface layer) | $SiH_4/He = 1$ $NH_3$ | $SiH_4 = 100$ | $SiH_4:NH_3 = 3:1$ | 0.18 | 500 Å |
| 2 (Rectifying layer) | $SiH_4/He = 1$ $B_2H_6/He = 1 \times 10^{-2}$ | $SiH_4 = 200$ | $SiH_4:B_2H_6 = 1:4 \times 10^{-3}$ | 0.18 | 4000 Å |
| 3 (Amorphous layer (I)) | $SiH_4/He = 1$ | $SiH_4 = 200$ | | 0.18 | 15μ |
| 4 (Amorphous layer (II)) | $SiH_4/He = 0.5$ $C_2H_4$ | $SiH_4 = 100$ | $SiH_4:C_2H_4 = 3:7$ | 0.18 | 0.5μ |

Aluminum substrate temperature: 250° C.
Discharging frequency: 13.56 MHz
Inner pressure in reaction chamber:
during formation of amorphous layer (I), 0.3 Torr
during formation of amorphous layer (II), 0.5 Torr The image forming member for electrophotography thus obtained was set in a copying device, subjected to corona charging at ⊕5 kV for 0.2 sec. and irradiated with a light image. As the light source, a tungsten lamp was employed at 1.0 lux.sec. The latent image was developed with a negatively charged developer (containing toner and carrier) and transferred onto a plain paper. The transferred image was very good. The toner remaining on the image forming member without being transferred was subjected to cleaning by a rubber blade before turning to the next cycle of copying. Such step was repeated for 150,000 times or more, whereby no deterioration of image was observed.

EXAMPLE 44

By means of the preparation device as shown in FIG. 5, layers were formed on a drum-shaped aluminum substrate under the following conditions.

TABLE 43

| Order of layer formation | Conditions: Gases employed | Flow rate (SCCM) | Flow rate ratio | Discharging power ($W/cm^2$) | Layer thickness |
|---|---|---|---|---|---|
| 1 (Interface layer) | $SiH_4/He = 1$ $NH_3$ | $SiH_4 = 100$ | $SiH_4:NH_3 = 10:1$ | 0.18 | 2000 Å |
| 2 (Rectifying layer) | $SiH_4/He = 1$ $B_2H_6/He = 1 \times 10^{-2}$ | $SiH_4 = 200$ | $SiH_4:B_2H_6 = 1:2 \times 10^{-3}$ | 0.18 | 4000 Å |
| 3 (Amorphous layer (I)) | $SiH_4/He = 1$ | $SiH_4 = 200$ | | 0.18 | 15μ |
| 4 (Amorphous layer (II)) | $SiH_4/He = 1$ $C_2H_4$ | $SiH_4 = 15$ | $SiH_4:C_2H_4 = 0.4:9.6$ | 0.18 | 0.3μ |

Other conditions were the same as in Example 43.

The image forming member for electrophotography thus obtained was set in a copying device, subjected to corona charging at ⊕5 kV for 0.2 sec. and irradiated with a light image. As the light source, a tungsten lamp was employed at 1.0 lux.sec. The latent image was developed with a negatively charged developer (containing toner and carrier) and transferred onto a plain paper. The transferred image was very good. The toner remaining on the image forming member without being transferred was subjected to cleaning by a rubber blade before turning to the next cycle of copying. Such step was repeated for 100,000 times or more, whereby no deterioration of image was observed.

EXAMPLE 45

By means of the preparation device as shown in FIG. 5, layers were formed on a drum-shaped aluminum substrate under the following conditions.

TABLE 44

| Order of layer formation | Conditions: Gases employed | Flow rate (SCCM) | Flow rate ratio | Discharging power ($W/cm^2$) | Layer thickness |
|---|---|---|---|---|---|
| 1 (Interface layer) | $SiH_4/He = 1$ $NH_3$ | $SiH_4 = 100$ | $SiH_4:NH_3 = 3:1$ | 0.18 | 500 Å |
| 2 (Rectifying layer) | $SiH_4/He = 1$ $B_2H_6/He = 1 \times 10^{-2}$ | $SiH_4 = 200$ | $SiH_4:B_2H_6 = 1:1 \times 10^{-3}$ | 0.18 | 4000 Å |
| 3 (Amorphous layer (I)) | $SiH_4/He = 1$ | $SiH_4 = 200$ | | 0.18 | 15μ |
| 4 (Amorphous layer (II)) | $SiH_4/He = 0.5$ $C_2H_4$ | $SiH_4 = 100$ | $SiH_4:C_2H_4 = 5:5$ | 0.18 | 1.5μ |

Other conditions were the same as in Example 43.

The image forming member for electrophotography thus obtained was set in a copying device, subjected to corona charging at ⊕ 5 kV for 0.2 sec. and irradiated with a light image. As the light source, a tungsten lamp was employed at 1.0 lux.sec. The latent image was developed with a negatively charged developer (containing toner and carrier) and transferred onto a plain paper. The transferred image was very good. The toner remaining on the image forming member without being transferred was subjected to cleaning by a rubber blade before turning to the next cycle of copying. Such step was repeated for 150,000 times or more, whereby no deterioration of image was observed.

EXAMPLE 46

Image forming members were prepared according to entirely the same procedure as in Example 43 except for varying the content ratio of silicon atoms to carbon atoms in the second amorphous layer (II) by varying the flow rate ratio of $SiH_4$ gas:$C_2H_4$ gas during formation of the amorphous layer (II). For the thus obtained image forming members, image evaluations were conducted after repeating 50,000 times the steps of image making, developing and cleaning according to the methods as described in Example 43 to obtain the results as shown in Table 45.

TABLE 45

| | | | | | | | | |
|---|---|---|---|---|---|---|---|---|
| $SiH_4:C_2H_4$ (Flow rate ratio) | 9:1 | 6:4 | 4:6 | 2:8 | 1:9 | 0.5:9.5 | 0.35:9.65 | 0.2:9.8 |
| Si:C (Content ratio) | 9:1 | 7:3 | 5.5:4.5 | 4:6 | 3:7 | 2:8 | 1.2:8.8 | 0.8:9.2 |
| Image quality evaluation | ○ | ⊙ | ⊙ | ⊙ | ⊙ | ⊙ | ○ | x |

⊙: Very good
○: Good
x: Image defect formed

EXAMPLE 47

Image forming members were prepared according to entirely the same procedure as in Example 43 except for varying the layer thickness of the amorphous layer (II). The results of evaluations are as shown in the Table below.

TABLE 46

| Thickness of amorphous layer (II) (μ) | Results |
|---|---|
| 0.001 | Image defect liable to occur |
| 0.02 | No image defect during 20,000 repetitions |
| 0.05 | No image defect during 50,000 repetitions |
| 2 | Stable for 200,000 repetitions or more |

EXAMPLE 48

An image forming member was prepared according to the same procedure as in Example 43 except for changing the methods for forming the layers other than the amorphous layer (II) to those as shown in the Table below, and evaluation was conducted similarly to Example 43 to obtain good results.

TABLE 47

| Order of layer formation | Conditions: Gases employed | Flow rate (SCCM) | Flow rate ratio | Discharging power ($W/cm^2$) | Layer thickness |
|---|---|---|---|---|---|
| 1 (Interface layer) | $SiH_4/He = 1$ $NH_3$ | $SiH_4 = 100$ | $SiH_4:NH_3 = 3:1$ | 0.18 | 500 Å |
| 2 (Rectifying layer) | $SiH_4/He = 1$ $B_2H_6/He = 1 \times 10^{-2}$ | $SiH_4 = 200$ | $SiH_4:B_2H_6 = 1:6 \times 10^{-3}$ | 0.18 | 6000 Å |
| 3 (Interface layer) | $SiH_4/He = 1$ $NH_3$ | $SiH_4 = 100$ | $SiH_4:NH_3 = 3:1$ | 0.18 | 500 Å |
| 4 (Amorphous layer (I)) | $SiH_4/He = 1$ | $SiH_4 = 200$ | | 0.18 | 15μ |

EXAMPLE 49

An image forming member was prepared according to the same procedure as in Example 43 except for changing the methods for forming the layers other than the amorphous layer (II) to those as shown in the Table below, and evaluation was conducted similarly to Example 43 to obtain good results.

TABLE 48

| Order of layer formation | Conditions: Gases employed | Flow rate (SCCM) | Flow rate ratio | Discharging power ($W/cm^2$) | Layer thickness |
|---|---|---|---|---|---|
| 1 (Interface layer) | $SiH_4/He = 1$ $NH_3$ | $SiH_4 = 100$ | $SiH_4:NH_3 = 1:1$ | 0.18 | 400 Å |
| 2 (Rectifying layer) | $SiH_4/He = 1$ $SiF_4/He = 1$ $B_2H_6/He = 1 \times 10^{-2}$ | $SiH_4 = 100$ | $SiH_4:SiF_4:B_2H_6 = 1:1:1 \times 10^{-3}$ | 0.18 | 1μ |
| 3 (Amorphous layer (I)) | $SiH_4/He = 1$ $SiF_4/He = 1$ | $SiH_4 = 100$ | $SiH_4:SiF_4 = 1:1$ | 0.18 | 15μ |

EXAMPLE 50

By means of the preparation device as shown in FIG. 6, layers were formed on an aluminum substrate under the following conditions.

TABLE 49

| Order of layer formation | Conditions: Gases employed | Flow rate (SCCM) | Flow rate ratio | Discharging power ($W/cm^2$) | Layer thickness |
|---|---|---|---|---|---|
| 1 (Interface layer) | $SiH_4/He = 1$ $NH_3$ | $SiH_4 = 100$ | $SiH_4:NH_3 = 3:1$ | 0.18 | 500 Å |
| 2 (Rectifying layer) | $SiH_4/He = 1$ $B_2H_6/He = 1 \times 10^{-2}$ | $SiH_4 = 200$ | $SiH_4:B_2H_6 = 1:4 \times 10^{-3}$ | 0.18 | 4000 Å |
| 3 (Amorphous layer (I)) | $SiH_4/He = 1$ | $SiH_4 = 200$ | | 0.18 | 15μ |
| 4 (Amorphous layer (II)) | $SiH_4/He = 0.5$ $SiF_4/He = 0.5$ $C_2H_4$ | $SiH_4 + SiF_4 = 150$ | $SiH_4:SiF_4:C_2H_4 = 1.5:1.5:7$ | 0.18 | 0.5μ |

Al substrate temperature: 250° C.
Discharging frequency: 13.56 MHz
Inner pressure in reaction chamber:

during formation of amorphous layer (I), 0.3 Torr
during formation of amorphous layer (II), 0.5 Torr The image forming member thus obtained was set in a charging-exposure-developing device, subjected to corona charging at ⊕ 5 kV for 0.2 sec., followed immediately by irradiation of a light image. As the light source, a tungsten lamp was employed and irradiation was effected at 1.0 lux.sec. using a transmissive type test chart.

Immediately thereafter, a negatively charged developer (containing toner and carrier) was cascaded onto the surface of the image forming member, whereby a good toner image was obtained thereon.

The thus obtained toner image was once subjected to cleaning with a rubber blade and again the above image making-cleaning steps were repeated. No deterioration of image was observed even after a repetition number of 150,000 or more.

EXAMPLE 51

By means of the preparation device as shown in FIG. 6, layers were formed on an aluminum substrate under the following conditions.

TABLE 50

| Order of layer formation | Conditions: Gases employed | Flow rate (SCCM) | Flow rate ratio | Discharging power ($W/cm^2$) | Layer thickness |
|---|---|---|---|---|---|
| 1 (Interface layer) | $SiH_4/He = 1$ $NH_3$ | $SiH_4 = 100$ | $SiH_4:NH_3 = 3:1$ | 0.18 | 500 Å |
| 2 (Rectifying layer) | $SiH_4/He = 1$ $B_2H_6/He = 1 \times 10^{-2}$ | $SiH_4 = 200$ | $SiH_4:B_2H_6 = 1:1 \times 10^{-3}$ | 0.18 | 4000 Å |
| 3 (Amorphous layer (I)) | $SiH_4/He = 1$ | $SiH_4 = 200$ | | 0.18 | 15μ |
| 4 (Amorphous layer (II)) | $SiH_4/He = 0.5$ $SiF_4/He = 0.5$ $C_2H_4$ | $SiH_4 + SiF_4 = 150$ | $SiH_4:SiF_4:C_2H_4 = 3:3:4$ | 0.18 | 1.5μ |

Other conditions were the same as in Example 50.

The image forming member thus obtained was set in a charging-exposure-developing device, subjected to corona charging at ⊕ 5 kV for 0.2 sec., followed immediately by irradiation of a light image. As the light source, a tungsten lamp was employed and irradiation was effected at 1.0 lux.sec. using a transmissive type test chart.

Immediately thereafter, a negatively charged developer (containing toner and carrier) was cascaded onto the surface of the image forming member, whereby a good toner image was obtained thereon.

The thus obtained toner image was once subjected to cleaning with a rubber blade and again the above image making-cleaning steps were repeated. No deterioration of image was observed even after a repetition number of 100,000 or more.

EXAMPLE 52

By means of the preparation device as shown in FIG. 6, layers were formed on an aluminum substrate under the following conditions.

TABLE 51

| Order of layer formation | Conditions: Gases employed | Flow rate (SCCM) | Flow rate ratio | Discharging power ($W/cm^2$) | Layer thickness |
|---|---|---|---|---|---|
| 1 (Interface layer) | $SiH_4/He = 1$ $NH_3$ | $SiH_4 = 100$ | $SiH_4:NH_3 = 3:1$ | 0.18 | 500 Å |
| 2 (Rectifying layer) | $SiH_4/He = 1$ $B_2H_6/He = 1 \times 10^{-2}$ | $SiH_4 = 200$ | $SiH_4:B_2H_6 = 1:1 \times 10^{-3}$ | 0.18 | 4000 Å |
| 3 (Amorphous layer (I)) | $SiH_4/He = 1$ | $SiH_4 = 200$ | | 0.18 | 15μ |
| 4 (Amorphous layer (II)) | $SiH_4/He = 0.5$ $SiF_4/He = 0.5$ $C_2H_4$ | $SiH_4 + SiF_4 = 150$ | $SiH_4:SiF_4:C_2H_4 = 3:3:4$ | 0.18 | 1.5μ |

Other conditions were the same as in Example 50.

The image forming member thus obtained was set in a charging-exposure-developing device, subjected to corona charging at ⊕ 5 kV for 0.2 sec., followed immediately by irradiation of a light image. As the light source, a tungsten lamp was employed and irradiation was effected at 1.0 lux.sec. using a transmissive type test chart.

Immediately thereafter, a negatively charged developer (containing toner and carrier) was cascaded onto the surface of the image forming member, whereby a good toner image with very high density was obtained thereon.

The thus obtained toner image was once subjected to cleaning with a rubber blade and again the above image making-cleaning steps were repeated. No deterioration of image was observed even after a repetition number of 150,000 or more.

EXAMPLE 53

Image forming members were prepared according to entirely the same procedure as in Example 50 except for varying the content ratio of silicon atoms to carbon atoms in the second amorphous layer (II) by varying the flow rate ratio of $SiH_4$:$SiF_4$:$C_2H_4$ during formation of the amorphous layer (II). For the thus obtained image forming members, image evaluations were conducted after repeating 50,000 times the steps of image making, developing and cleaning as described in Example 50 to obtain the results as shown in Table 52.

TABLE 52

| | | | | | | | | |
|---|---|---|---|---|---|---|---|---|
| $SiH_4$: | 5: | 3: | 2: | 1: | 0.6: | 0.2: | 0.2: | 0.1: |
| $SiF_4$: | 4: | 3.5: | 2: | 1: | 0.4: | 0.3: | 0.15: | 0.1: |
| $C_2H_4$ | 1 | 3.5 | 6 | 8 | 9 | 9.5 | 9.65 | 9.8 |
| Si:C (content ratio) | 9:1 | 7:3 | 5.5:4.5 | 4:6 | 3:7 | 2:8 | 1.2:8.8 | 0.8:9.2 |
| Evaluation | ○ | ⊙ | ⊙ | ⊙ | ⊙ | ⊙ | ○ | x |

⊙: Very good
○: Good
x: Slightly liable to form image defect

EXAMPLE 54

Image forming members were prepared according to entirely the same procedure as in Example 50 except for varying the film thickness of the amorphous layer (II). By repeating the image making, developing and cleaning steps as described in Example 50, the following results were obtained.

TABLE 53

| Thickness of amorphous layer (II) (μ) | Results |
|---|---|
| 0.001 | Image defect liable to occur |
| 0.02 | No image defect during 20,000 repetitions |
| 0.05 | Stable for 50,000 repetitions or more |
| 1 | Stable for 200,000 repetitions or more |

EXAMPLE 55

An image forming member was prepared according to the same procedure as in Example 50 except for changing the methods for forming the layers other than the amorphous layer (II) to those as shown in the Table below, and evaluation was conducted similarly to Example 50 to obtain good results.

TABLE 54

| Order of layer formation | Conditions: Gases employed | Flow rate (SCCM) | Flow rate ratio | Discharging power ($W/cm^2$) | Layer thickness |
|---|---|---|---|---|---|
| 1 (Interface layer) | $SiH_4$/He = 1<br>$NH_3$ | $SiH_4$ = 100 | $SiH_4$:$NH_3$ = 3:1 | 0.18 | 500 Å |
| 2 (Rectifying layer) | $SiH_4$/He = 1<br>$B_2H_6$/He = $1 \times 10^{-2}$ | $SiH_4$ = 200 | $SiH_4$:$B_2H_6$ = $1:6 \times 10^{-3}$ | 0.18 | 6000 Å |
| 3 (Interface layer) | $SiH_4$/He = 1<br>$NH_3$ | $SiH_4$ = 100 | $SiH_4$:$NH_3$ = 3:1 | 0.18 | 500 Å |
| 4 (Amorphous layer (I)) | $SiH_4$/He = 1 | $SiH_4$ = 200 | | 0.18 | 15μ |

EXAMPLE 56

An image forming member was prepared according to the same procedure as in Example 50 except for changing the methods for forming the layers other than the amorphous layer (II) to those as shown in the Table below, and evaluation was conducted similarly to Example 50 to obtain good results.

TABLE 55

| Order of layer formation | Conditions: Gases employed | Flow rate (SCCM) | Flow rate ratio | Discharging power ($W/cm^2$) | Layer thickness |
|---|---|---|---|---|---|
| 1 (Interface layer) | $SiH_4$/He = 1<br>$NH_3$ | $SiH_4$ = 100 | $SiH_4$:$NH_3$ = 1:1 | 0.18 | 400 Å |
| 2 (Rectifying layer) | $SiH_4$/He = 1<br>$SiF_4$/He = 1<br>$B_2H_6$/He = $1 \times 10^{-2}$ | $SiH_4$ = 100 | $SiH_4$:$SiF_4$:$B_2H_6$ = $1:1:1 \times 10^{-3}$ | 0.18 | 1μ |
| 3 (Amorphous layer (I)) | $SiH_4$/He = 1<br>$SiF_4$/He = 1 | $SiH_4$ = 100 | $SiH_4$:$SiF_4$ = 1:1 | 0.18 | 15μ |

EXAMPLE 57

An image forming member was prepared according to the same method as in Example 52 except that the amorphous layer (II) was formed according to the sputtering method under the conditions shown in the Table below, and evaluated similarly to Example 52 to obtain good results.

TABLE 56

| | Gases employed | Flow rate (SCCM) | Target area ratio Si wafer: graphite | Discharging power ($W/cm^2$) | Layer thickness ($\mu$) |
|---|---|---|---|---|---|
| Amorphous Layer (II) | Ar $SiF_4/He$ = 0.5 | Ar = 200 $SiF_4$ = 100 | 2.5:7.5 | 0.3 | 1 |

EXAMPLE 58

By means of the preparation device as shown in FIG. 6, layers were formed on an aluminum substrate under the following conditions.

TABLE 57

| Order of layer formation | Layer formation method | Gases employed | Flow rate (SCCM) | Flow rate ratio | Inner pressure in reaction chamber (torr) | Discharging power ($W/cm^2$) | Layer thickness |
|---|---|---|---|---|---|---|---|
| | | Conditions | | | | | |
| 1 (Interface layer) | Glow | $SiH_4/He$ = 1 $SiF_4/He$ = 1 $NH_3$ | $SiH_4$ = 100 | $SiH_4$:$SiF_4$:$NH_3$ = 1:1:1 | 0.3 | 0.18 | 300 Å |
| 2 (Rectifying layer) | Glow | $SiH_4/He$ = 1 $B_2H_6/He$ = $1 \times 10^{-2}$ | $SiH_4$ = 200 | $SiH_4$:$B_2H_6$ = 1:1 $\times 10^{-3}$ | 0.3 | 0.18 | 4000 Å |
| 3 (Amorphous layer) | Glow | $SiH_4/He$ = 1 | $SiH_4$ = 200 | | 0.3 | 0.18 | 15$\mu$ |

Aluminum substrate temperature: 250° C.

Discharging frequency: 13.56 MHz

The image forming member for electrophotography thus obtained was set in a copying device, subjected to corona charging at ⊕ 5 kV for 0.2 sec. and irradiated with a light image. As the light source, a tungsten lamp was employed at 1.0 lux.sec. The latent image was developed with a negatively charged developer (containing toner and carrier) and transferred onto a plain paper. The presence of any image defect (e.g. blank area at the black image portion) was checked, but no such defect was recognized at all and the image quality was found to be very good. The toner remaining on the image forming member without being transferred was subjected to cleaning by a rubber blade before turning to the next cycle of copying. Such a step was repeated for 100,000 times or more, whereby no image defect or peel-off of layers occurred.

EXAMPLE 59

Image forming members for electrophotography were prepared according to entirely the same procedure as in Example 58 except for varying the content of nitrogen atoms relative to silicon atoms in the interface layer by varying the area ratio of Si wafer to $Si_3N_4$ wafer of the targets for sputtering and evaluated similarly to Example 58 to obtain the results shown below.

TABLE 58

| Nitrogen content (atomic %) | $5 \times 10^{-4}$ | 1 | 10 | 20 | 23 | 27 | 50 |
|---|---|---|---|---|---|---|---|
| Evaluation | Readily peeled | Good | Good | Excellent | Excellent | Good | Image defect slightly formed |

EXAMPLE 60

Image forming members for electrophotography were prepared according to entirely the same procedure as in Example 58 except for varying the layer thickness of the interface layer and evaluated similarly to Example 58 to obtain the results shown below.

TABLE 59

| Layer thickness | 10 Å | 30 Å | 400 Å | 2$\mu$ | 5$\mu$ |
|---|---|---|---|---|---|
| Evaluation | Readily peeled | Good | Excellent | Good | Image defect slightly formed |

EXAMPLE 61

Image forming members for electrophotography were prepared according to entirely the same procedure as in Example 58 except for varying the layer thickness of the rectifying layer and the content of boron as follows. All of the results were good.

TABLE 60

| Sample No. | 31 | 32 | 33 | 34 | 35 | 36 | 37 |
|---|---|---|---|---|---|---|---|
| Boron content (ppm) | $1 \times 10^5$ | 5000 | 3500 | 1500 | 800 | 500 | 100 |
| Thickness ($\mu$) | 0.3 | 0.4 | 0.8 | 0.5 | 0.9 | 1.5 | 5 |

EXAMPLE 62

By means of the preparation device as shown in FIG. 6, layers were formed on an aluminum substrate under the following conditions.

TABLE 61

| Order of layer formation | Layer formation method | Conditions: Gases employed | Flow rate (SCCM) | Flow rate ratio | Inner pressure in reaction chamber (torr) | Discharging power ($W/cm^2$) | Layer thickness |
|---|---|---|---|---|---|---|---|
| 1 (Interface layer) | Glow | $SiH_4/He = 1$<br>$SiH_4/He = 1$<br>$NH_3$ | $SiH_4 = 100$ | $SiH_4:SiF_4:NH_3 = 1:2:1$ | 0.3 | 0.18 | 500 Å |
| 2 (Rectifying layer) | Glow | $SiH_4/He = 1$<br>$B_2H_6/He = 1 \times 10^{-2}$ | $SiH_4 = 200$ | $SiH_4:B_2H_6 = 1:6 \times 10^{-3}$ | 0.3 | 0.18 | 6000 Å |
| 3 (Interface layer) | Glow | $SiH_4/He = 1$<br>$NH_3$ | $SiH_4 = 100$ | $SiH_4:NH_3 = 3:1$ | 0.3 | 0.18 | 500 Å |
| 4 (Amorphous layer) | Glow | $SiH_4/He = 1$ | $SiH_4 = 200$ | | 0.3 | 0.18 | 15μ |

The image forming member for electrophotography thus obtained was evaluated similarly to Example 58 to obtain very good results.

EXAMPLE 63

Layer forming operations were conducted in the same manner as in Example 58 by means of the device as shown in FIG. 6 except for using the following conditions.

TABLE 62

| Order of layer formation | Conditions: Gases employed | Flow rate (SCCM) | Flow rate ratio | Discharging power ($W/cm^2$) | Layer thickness |
|---|---|---|---|---|---|
| 1 (Interface layer) | $SiH_4/He = 1$<br>$SiF_4/He = 1$<br>$NH_3$ | $SiH_4 = 100$ | $SiH_4:SiF_4:NH_3 = 2:1:1$ | 0.18 | 400 Å |
| 2 (Rectifying layer) | $SiH_4/He = 1$<br>$SiF_4/He = 1$<br>$B_2H_6/He = 1 \times 10^{-2}$ | $SiH_4 = 100$ | $SiH_4:SiF_4:B_2H_6 = 1:1:1 \times 10^{-3}$ | 0.18 | 1μ |
| 3 (Amorphous layer) | $SiH_4/He = 1$<br>$SiF_4/He = 1$ | $SiH_4 = 100$ | $SiH_4:SiF_4 = 1:1$ | 0.18 | 15μ |

The image forming member for electrophotography thus obtained was evaluated similarly to Example 58 to obtain very good results.

EXAMPLE 64

By means of the preparation device as shown in FIG. 6, layers were formed on an aluminum substrate under the following conditions.

TABLE 63

| Order of layer formation | Conditions: Gases employed | Flow rate (SCCM) | Flow rate ratio | Discharging power ($W/cm^2$) | Layer thickness |
|---|---|---|---|---|---|
| 1 (Interface layer) | $SiH_4/He = 1$<br>$SiF_4/He = 1$<br>$NH_3$ | $SiH_4 = 100$ | $SiH_4:SiF_4:NH_3 = 1:1:1$ | 0.18 | 500 Å |
| 2 (Rectifying layer) | $SiH_4/He = 1$<br>$B_2H_6/He = 1 \times 10^{-2}$ | $SiH_4 = 200$ | $SiH_4:B_2H_6 = 1:4 \times 10^{-3}$ | 0.18 | 4000 Å |
| 3 (Amorphous layer (I)) | $SiH_4/He = 1$ | $SiH_4 = 200$ | | 0.18 | 15μ |
| 4 (Amorphous layer (II)) | Ar | 200 | Si wafer:graphite = 1.5:8.5 (area ratio) | 0.3 | 0.5μ |

Al substrate temperature: 250° C.
Discharging frequency: 13.56 MHz
Inner pressure in reaction chamber:

| | |
|---|---|
| interface layer | 0.2 Torr |
| rectifying layer } | 0.3 Torr |
| amorphous layer (I) } | |
| amorphous layer (II) | 0.2 Torr |

The image forming member thus obtained was set in a charging-exposure-device, subjected to corona charging at ⊕ 5 kV for 0.2 sec., followed immediately by irradiation of a light image. As the light source, a tungsten lamp was employed and irradiation was effected at 1.0 lux.sec. using a transmissive type test chart.

Immediately thereafter, a negatively charged developer (containing toner and carrier) was cascaded onto the surface of the image forming member, whereby a good toner image was obtained thereon.

The thus obtained toner image was once subjected to cleaning with a rubber blade and again the above image making-cleaning steps were repeated. No deterioration of image was observed even after a repetition number of 150,000 or more.

EXAMPLE 65

By means of the preparation device as shown in FIG. 6, layers were formed on an aluminum substrate under the following conditions.

TABLE 64

| Order of layer formation | Conditions: Gases employed | Flow rate (SCCM) | Flow rate ratio | Discharging power ($W/cm^2$) | Layer thickness |
|---|---|---|---|---|---|
| 1 (Interface layer) | $SiH_4/He = 1$<br>$SiF_4/He = 1$<br>$NH_3$ | $SiH_4 = 100$ | $SiH_4:SiF_4:NH_3 =$ 5:5:1 | 0.18 | 2000 Å |
| 2 (Rectifying layer) | $SiH_4/He = 1$<br>$B_2H_6/He = 1 \times 10^{-2}$ | $SiH_4 = 200$ | $SiH_4:B_2H_6 = 1:2 \times 10^{-3}$ | 0.18 | 4000 Å |
| 3 (Amorphous layer (I)) | $SiH_4/He = 1$ | $SiH_4 = 200$ | | 0.18 | 15μ |
| 4 (Amorphous layer (II)) | Ar | 200 | Si wafer:graphite = 0.5:9.5 (area ratio) | 0.3 | 0.3μ |

Other conditions were the same as in Example 64.

The image forming member thus obtained was set in a charging-exposure-developing device, subjected to corona charging at ⊕ 5 kV for 0.2 sec., followed immediately by irradiation of a light image. As the light source, a tungsten lamp was employed and irradiation was effected at 1.0 lux.sec. using a transmissive type test chart.

Immediately thereafter, a negatively charged developer (containing toner and carrier) was cascaded onto the surface of the image forming member, whereby a good toner image was obtained thereon.

The thus obtained toner image was once subjected to cleaning with a rubber blade and again the above image making-cleaning steps were repeated. No deterioration of image was observed even after a repetition number of 100,000 or more.

EXAMPLE 66

By means of the preparation device as shown in FIG. 6, layers were formed on an aluminum substrate under the following conditions.

TABLE 65

| Order of layer formation | Conditions: Gases employed | Flow rate (SCCM) | Flow rate ratio | Discharging power ($W/cm^2$) | Layer thickness |
|---|---|---|---|---|---|
| 1 (Interface layer) | $SiH_4/He = 1$<br>$SiF_4/He = 1$<br>$NH_3$ | $SiH_4 = 100$ | $SiH_4:SiF_4:NH_3 =$ 1:1:1 | 0.18 | 500 Å |
| 2 (Rectifying layer) | $SiH_4/He = 1$<br>$B_2H_6/He = 1 \times 10^{-2}$ | $SiH_4 = 200$ | $SiH_4:B_2H_6 = 1:1 \times 10^{-3}$ | 0.18 | 4000 Å |
| 3 (Amorphous layer (I)) | $SiH_4/He = 1$ | $SiH_4 = 200$ | | 0.18 | 15μ |
| 4 (Amorphous layer (II)) | Ar | 200 | Si wafer:graphite = 6:4 (area ratio) | 0.3 | 1.0μ |

Other conditions were the same as in Example 64.

The image forming member thus obtained was set in a charging-exposure-developing device, subjected to corona charging at ⊕ 5 kV for 0.2 sec., followed immediately by irradiation of a light image. As the light source, a tungsten lamp was employed and irradiation was effected at 1.0 lux.sec. using a transmissive type test chart.

Immediately thereafter, a negatively charged developer (containing toner and carrier) was cascaded onto the surface of the image forming member, whereby a good toner image with very high density was obtained thereon.

The thus obtained toner image was once subjected to cleaning with a rubber blade and again the above image making-cleaning steps were repeated. No deterioration of image was observed even after a repetition number of 150,000 or more.

EXAMPLE 67

Image forming members were prepared according to entirely the same procedure as in Example 64 except for varying the content ratio of silicon atoms to carbon atoms in the second amorphous layer (II) by varying the area ratio of silicon wafer to graphite during formation of the amorphous layer (II). For the thus obtained image forming members, image evaluations were conducted after repeating 50,000 times the steps of image making, developing and cleaning as described in Example 64 to obtain the results as shown in Table 66.

TABLE 66

| | | | | | | | |
|---|---|---|---|---|---|---|---|
| Si:C Target (Area ratio) | 9:1 | 6.5:3.5 | 4:6 | 2:8 | 1:9 | 0.5:9.5 | 0.2:9.8 |
| Si:C (content ratio) | 9.7:0.3 | 8.8:1.2 | 7.3:2.7 | 4.8:5.2 | 3:7 | 2:8 | 0.8:9.2 |
| Image quality evaluation | Δ | | | | | | x |

: Very good
: Good
Δ: Practically good
x: Image defect slightly formed

EXAMPLE 68

Image forming members were prepared according to entirely the same procedure as in Example 64 except for varying the layer thickness of the amorphous layer (II). By repeating the image making, developing and cleaning steps as described in Example 64, the following results were obtained.

TABLE 67

| Thickness of amorphous layer (II) (μ) | Results |
|---|---|
| 0.001 | Image defect liable to occur |
| 0.02 | No image defect during 20,000 repititions |
| 0.05 | Stable for 50,000 repetitions or more |
| 1 | Stable for 200,000 repetitions or more |

EXAMPLE 69

An image forming member was prepared according to the same procedure as in Example 64 except for changing the methods for forming the layers other than the amorphous layer (II) to those as shown in the Table below, and evaluation was conducted similarly to Example 64 to obtain good results.

TABLE 68

| Order of layer formation | Conditions: Gases employed | Flow rate (SCCM) | Flow rate ratio | Discharging power ($W/cm^2$) | Layer thickness |
|---|---|---|---|---|---|
| 1 (Interface layer) | $SiH_4/He = 1$ $SiF_4/He = 1$ $NH_3$ | $SiH_4 = 100$ | $SiH_4:SiF_4:NH_3 = 1:2:1$ | 0.18 | 500 Å |
| 2 (Rectifying layer) | $SiH_4/He = 1$ $B_2H_6/He = 1 \times 10^{-2}$ | $SiH_4 = 200$ | $SiH_4:B_2H_6 = 1:6.0 \times 10^{-3}$ | 0.18 | 6000 Å |
| 3 (Interface layer) | $SiH_4/He = 1$ $SiF_4/He = 1$ $NH_3$ | $SiH_4 = 100$ | $SiH_4:SiF_4:NH_3 = 1:2:1$ | 0.18 | 500 Å |
| 4 (Amorphous layer (I)) | $SiH_4/He = 1$ | $SiH_4 = 200$ | | 0.18 | 15μ |

EXAMPLE 70

An image forming member was prepared according to the same procedure as in Example 64 except for changing the methods for forming the layers other than the amorphous layer (II) to those as shown in the Table below, and evaluation was conducted similarly to Example 64 to obtain good results.

TABLE 69

| Order of layer formation | Conditions: Gases employed | Flow rate (SCCM) | Flow rate ratio | Discharging power ($W/cm^2$) | Layer thickness |
|---|---|---|---|---|---|
| 1 (Interface layer) | $SiH_4/He = 1$ $SiF_4/He = 1$ $NH_3$ | $SiH_4 = 100$ | $SiH_4:SiF_4:NH_3 = 2:1:1$ | 0.18 | 400 Å |
| 2 (Rectifying layer) | $SiH_4/He = 1$ $SiF_4/He = 1$ $B_2H_6/He = 1 \times 10^{-2}$ | $SiH_4 = 100$ | $SiH_4:SiF_4:B_2H_6 = 1:1:1 \times 10^{-3}$ | 0.18 | 1μ |
| 3 (Amorphous layer (I)) | $SiH_4/He = 1$ $SiF_4/He = 1$ | $SiH_4 = 100$ | $SiH_4:SiF_4 = 1:1$ | 0.18 | 15μ |

EXAMPLE 71

By means of the preparation device as shown in FIG. 6, layers were formed on an aluminum substrate under the following conditions.

TABLE 70

| Order of layer formation | Conditions: Gases employed | Flow rate (SCCM) | Flow rate ratio | Discharging power ($W/cm^2$) | Layer thickness |
|---|---|---|---|---|---|
| 1 (Interface layer) | $SiH_4/He = 1$<br>$SiF_4/He = 1$<br>$NH_3$ | $SiH_4 = 100$ | $SiH_4:SiF_4:NH_3 = 1:1:1$ | 0.18 | 500 Å |
| 2 (Rectifying layer) | $SiH_4/He = 1$<br>$B_2H_6/He = 1 \times 10^{-2}$ | $SiH_4 = 200$ | $SiH_4:B_2H_6 = 1:4 \times 10^{-3}$ | 0.18 | 4000 Å |
| 3 (Amorphous layer (I)) | $SiH_4/He = 1$ | $SiH_4 = 200$ | | 0.18 | 15μ |
| 4 (Amorphous layer (II)) | $SiH_4/He = 0.5$<br>$C_2H_4$ | $SiH_4 = 100$ | $SiH_4:C_2H_4 = 3:7$ | 0.18 | 0.5μ |

Al substrate temperature: 250° C.
Discharging frequency: 13.56 MHz
Inner pressure in reaction chamber:

| | |
|---|---|
| interface layer | 0.2 Torr |
| rectifying layer<br>amorphous layer (I) | 0.3 Torr |
| amorphous layer (II) | 0.2 Torr |

The image forming member for electrophotography thus obtained was set in a copying device, subjected to corona charging at ⊕ 5 kV for 0.2 sec. and irradiated with a light image. As the light source, a tungsten lamp was employed at 1.0 lux.sec. The latent image was developed with a negatively charged developer (containing toner and carrier) and transferred onto a plain paper. The transferred image was very good. The toner remaining on the image forming member without being transferred was subjected to cleaning by a rubber blade before turning to the next cycle of copying. Such step was repeated for 150,000 times or more, whereby no deterioration of image was observed.

EXAMPLE 72

By means of the preparation device as shown in FIG. 6, layers were formed on an aluminum substrate under the following conditions.

TABLE 71

| Order of layer formation | Conditions: Gases employed | Flow rate (SCCM) | Flow rate ratio | Discharging power ($W/cm^2$) | Layer thickness |
|---|---|---|---|---|---|
| 1 (Interface layer) | $SiH_4/He = 1$<br>$SiF_4/He = 1$<br>$NH_3$ | $SiH_4 = 100$ | $SiH_4:SiF_4:NH_3 = 5:5:1$ | 0.18 | 2000 Å |
| 2 (Rectifying layer) | $SiH_4/He = 1$<br>$B_2H_6/He = 1 \times 10^{-2}$ | $SiH_4 = 200$ | $SiH_4:B_2H_6 = 1:2 \times 10^{-3}$ | 0.18 | 4000 Å |
| 3 (Amorphous layer(I)) | $SiH_4/He = 1$ | $SiH_4 = 200$ | | 0.18 | 15μ |
| 4 (Amorphous layer(II)) | $SiH_4/He = 1$<br>$C_2H_4$ | $SiH_4 = 15$ | $SiH_4:C_2H_4 = 0.4:9.6$ | 0.18 | 0.3μ |

Other conditions were the same as in Example 71.

The image forming member for electrophotography thus obtained was set in a copying device, subjected to corona charging at ⊕ 5 kV for 0.2 sec. and irradiated with a light image. As the light source, a tungsten lamp was employed at 1.0 lux.sec. The latent image was developed with a negatively charged developer (containing toner and carrier) and transferred onto a plain paper. The transferred image was very good. The toner remaining on the image forming member without being transferred was subjected to cleaning by a rubber blade before turning to the next cycle of copying. Such step was repeated for 100,000 times or more, whereby no deterioration of image was observed.

EXAMPLE 73

By means of the preparation device as shown in FIG. 6, layers were formed on an aluminum substrate under the following conditions.

TABLE 72

| Order of layer formation | Conditions: Gases employed | Flow rate (SCCM) | Flow rate ratio | Discharging power ($W/cm^2$) | Layer thickness |
|---|---|---|---|---|---|
| 1 (Interface layer) | $SiH_4/He = 1$<br>$SiF_4/He = 1$<br>$NH_3$ | $SiH_4 = 100$ | $SiH_4:SiF_4:NH_3 = 1:1:1$ | 0.3 | 500 Å |

TABLE 72-continued

| Order of layer formation | Conditions: Gases employed | Flow rate (SCCM) | Flow rate ratio | Discharging power ($W/cm^2$) | Layer thickness |
|---|---|---|---|---|---|
| 2 (Rectifying layer) | $SiH_4/He = 1$ $B_2H_6/He = 1 \times 10^{-2}$ | $SiH_4 = 200$ | $SiH_4:B_2H_6 = 1:1 \times 10^{-3}$ | 0.18 | 4000 Å |
| 3 (Amorphous layer(I)) | $SiH_4/He = 1$ | $SiH_4 = 200$ | | 0.18 | 15μ |
| 4 (Amorphous layer(II)) | $SiH_4/He = 0.5$ $C_2H_4$ | $SiH_4 = 100$ | $SiH_4:C_2H_4 = 5:5$ | 0.18 | 1.5μ |

Other conditions were the same as in Example 71.

The image forming member for electrophotography thus obtained was set in a copying device, subjected to corona charging at ⊕ 5 kV for 0.2 sec. and irradiated with a light image. As the light source, a tungsten lamp was employed at 1.0 lux.sec. The latent image was developed with a negatively charged developer (containing toner and carrier) and transferred onto a plain paper. The transferred image was very good. The toner remaining on the image forming member without being transferred was subjected to cleaning by a rubber blade before turning to the next cycle of copying. Such step was repeated for 150,000 times or more, whereby no deterioration of image was observed.

EXAMPLE 74

Image forming members were prepared according to entirely the same procedure as in Example 71 except for varying the content ratio of silicon atoms to carbon atoms in the second amorphous layer (II) by varying the flow rate ratio of $SiH_4$ gas:$C_2H_4$ gas during formation of the amorphous layer (II). For the thus obtained image forming members, image evaluation was conducted after repeating for 50,000 times the steps of image making, developing and cleaning according to the methods as described in Example 71 to obtain the results as shown in Table 73.

TABLE 73

| | | | | | | | | |
|---|---|---|---|---|---|---|---|---|
| $SiH_4:C_2H_4$ (Flow rate ratio) | 9:1 | 6:4 | 4:6 | 2:8 | 1:9 | 0.5:9.5 | 0.35:9.65 | 0.2:9.8 |
| Si:C (Content ratio) | 9:1 | 7:3 | 5.5:4.5 | 4:6 | 3:7 | 2:8 | 1.2:8.8 | 0.8:9.2 |
| Image quality evaluation | ○ | ⊙ | ⊙ | ⊙ | ⊙ | ⊙ | ○ | x |

TABLE 73-continued

⊙: Very good
○ : Good
x: Image defect slightly formed

EXAMPLE 75

Image forming members were prepared according to entirely the same procedure as in Example 71 except for varying the layer thickness of the amorphous layer (II). The results of evaluation are as shown in the following table.

TABLE 74

| Thickness of amorphous layer (II) (μ) | Results |
|---|---|
| 0.001 | Image defect liable to occur |
| 0.02 | No image defect during 20,000 repetitions |
| 0.05 | No image defect during 50,000 repetitions |
| 2 | Stable for 200,000 repetitions or more |

EXAMPLE 76

An image forming member was prepared according to the same procedure as in Example 71 except for changing the methods for forming the layers other than the amorphous layer (II) to those as shown in the Table below, and evaluation was conducted to obtain good results.

TABLE 75

| Order of layer formation | Conditions: Gases employed | Flow rate (SCCM) | Flow rate ratio | Discharging power ($W/cm^2$) | Layer thickness |
|---|---|---|---|---|---|
| 1 (Interface layer) | $SiH_4/He = 1$ $SiF_4/He = 1$ $NH_3$ | $SiH_4 = 100$ | $SiH_4:SiF_4:NH_3 = 2:1:1$ | 0.18 | 400 Å |
| 2 (Rectifying layer) | $SiH_4/He = 1$ $SiF_4/He = 1$ $B_2H_6/He = 1 \times 10^{-2}$ | $SiH_4 = 100$ | $SiH_4:SiF_4:B_2H_6 = 1:1:1 \times 10^{-3}$ | 0.18 | 1μ |
| 3 (Amorphous layer(I)) | $SiH_4/He = 1$ $SiF_4/He = 1$ | $SiH_4 = 100$ | $SiH_4:SiF_4 = 1:1$ | 0.18 | 15μ |

EXAMPLE 77

An image forming member was prepared according to the same procedure as in Example 71 except for changing the methods for forming the layers other than the amorphous layer (II) to those as shown in the Table below, and evaluation was conducted to obtain good results.

TABLE 76

| Order of layer formation | Conditions: Gases employed | Flow rate (SCCM) | Flow rate ratio | Discharging power ($W/cm^2$) | Layer thickness |
|---|---|---|---|---|---|
| 1 (Interface layer) | $SiH_4/He = 1$<br>$SiF_4/He = 1$<br>$NH_3$ | $SiH_4 = 100$ | $SiH_4:SiF_4:NH_3 = 1:2:1$ | 0.3 | 500 Å |
| 2 (Rectifying layer) | $SiH_4/He = 1$<br>$B_2H_6/He = 1 \times 10^{-2}$ | $SiH_4 = 200$ | $SiH_4:B_2H_6 = 1:6.0 \times 10^{-3}$ | 0.18 | 6000 Å |
| 3 (Interface layer) | $SiH_4/He = 1$<br>$SiF_4/He = 1$<br>$NH_3$ | $SiH_4 = 100$ | $SiH_4:SiF_4:NH_3 = 1:2:1$ | 0.18 | 500 Å |
| 4 (Amorphous layer(I)) | $SiH_4/He = 1$ | $SiH_4 = 200$ | | 0.18 | 15μ |

EXAMPLE 78

By means of the preparation device as shown in FIG. 6, layers were formed on an aluminum substrate under the following conditions.

TABLE 77

| Order of layer formation | Conditions: Gases employed | Flow rate (SCCM) | Flow rate ratio | Discharging power ($W/cm^2$) | Layer thickness |
|---|---|---|---|---|---|
| 1 (Interface layer) | $SiH_4/He = 1$<br>$SiF_4/He = 1$<br>$NH_3$ | $SiH_4 = 100$ | $SiH_4:SiF_4:NH_3 = 1:1:1$ | 0.18 | 500 Å |
| 2 (Rectifying layer) | $SiH_4/He = 1$<br>$B_2H_6/He = 1 \times 10^{-2}$ | $SiH_4 = 200$ | $SiH_4:B_2H_6 = 1:4 \times 10^{-3}$ | 0.18 | 4000 Å |
| 3 (Amorphous layer(I)) | $SiH_4/He = 1$ | $SiH_4 = 200$ | | 0.18 | 15μ |
| 4 (Amorphous layer(II)) | $SiH_4/He = 0.5$<br>$SiF_4/He = 0.5$<br>$C_2H_4$ | $SiH_4 + SiF_4 = 150$ | $SiH_4:SiF_4:C_2H_4 = 1.5:1.5:7$ | 0.18 | 0.5μ |

Al substrate temperature: 250° C.
Discharging frequency: 13.56 MHz
Inner pressure in reaction chamber:

| | |
|---|---|
| interface layer | 0.2 Torr |
| rectifying layer<br>amorphous layer (I) | 0.3 Torr |
| amorphous layer (II) | 0.5 Torr |

The image forming member thus obtained was set in a charging-exposure-developing device, subjected to corona charging at ⊕5 kV for 0.2 sec., followed immediately by irradiation of a light image. As the light source, a tungsten lamp was employed and irradiation was effected at 1.0 lux.sec. using a transmissive type test chart.

Immediately thereafter, a negatively charged developer (containing toner and carrier) was cascaded onto the surface of the image forming member, whereby a good toner image was obtained othereon.

The thus obtained toner image was once subjected to cleaning with a rubber blade and again the above image making-cleaning steps were repeated. No deterioration of image was observed even after a repetition number of 150,000 or more.

EXAMPLE 79

By means of the preparation device as shown in FIG. 6, layers were formed on an aluminum substrate under the following conditions.

TABLE 78

| Order of layer formation | Conditions: Gases employed | Flow rate (SCCM) | Flow rate ratio | Discharging power ($W/cm^2$) | Layer thickness |
|---|---|---|---|---|---|
| 1 (Interface layer) | $SiH_4/He = 1$<br>$SiF_4/He = 1$<br>$NH_3$ | $SiH_4 = 100$ | $SiH_4:SiF_4:NH_3 = 5:5:1$ | 0.18 | 2000 Å |
| 2 (Rectifying layer) | $SiH_4/He = 1$<br>$B_2H_6/He = 1 \times 10^{-2}$ | $SiH_4 = 200$ | $SiH_4:B_2H_6 = 1:2 \times 10^{-3}$ | 0.18 | 4000 Å |
| 3 (Amorphous layer(I)) | $SiH_4/He = 1$ | $SiH_4 = 200$ | | 0.18 | 15μ |

TABLE 78-continued

| Order of layer formation | Conditions: Gases employed | Flow rate (SCCM) | Flow rate ratio | Discharging power (W/cm²) | Layer thickness |
|---|---|---|---|---|---|
| 4 (Amorphous layer(II)) | $SiH_4/He = 0.5$ $SiF_4/He = 0.5$ $C_2H_4$ | $SiH_4 + SiF_4 = 15$ | $SiH_4:SiF_4:C_2H_4 = 0.3:0.1:9.6$ | 0.18 | 0.3μ |

Other conditions were the same as in Example 78.

The image forming member thus obtained was set in a charging-exposure-developing device, subjected to corona charging at ⊕5 kV for 0.2 sec., followed immediately by irradiation of a light image. As the light source, a tungsten lamp was employed and irradiation was effected to 1.0 lux.sec. using a transmissive type test chart.

Immediately thereafter, a negatively charged developer (containing toner and carrier) was cascaded onto the surface of the image forming member, whereby a good toner image was obtained thereon.

The thus obtained toner image was once subjected to cleaning with a rubber blade and again the above image making-cleaning steps were repeated. No deterioration of image was observed even after a repetition number of 100,000 or more.

EXAMPLE 80

By means of the preparation device as shown in FIG. 6, layers were formed on an aluminum substrate under the following conditions.

TABLE 79

| Order of layer formation | Conditions: Gases employed | Flow rate (SCCM) | Flow rate ratio | Discharging power (W/cm²) | Layer thickness |
|---|---|---|---|---|---|
| 1 (Interface layer) | $SiH_4/He = 1$ $SiF_4/He = 1$ $NH_3$ | $SiH_4 = 100$ | $SiH_4:SiF_4:NH_3 = 1:1:1$ | 0.18 | 500 Å |
| 2 (Rectifying layer) | $SiH_4/He = 1$ $B_2H_6/He = 1 \times 10^{-2}$ | $SiH_4 = 200$ | $SiH_4:B_2H_6 = 1:1 \times 10^{-3}$ | 0.18 | 4000 Å |
| 3 (Amorphous layer(I)) | $SiH_4/He = 1$ | $SiH_4 = 200$ | | 0.18 | 15μ |
| 4 (Amorphous layer(II)) | $SiH_4/He = 0.5$ $SiF_4/He = 0.5$ $C_2H_4$ | $SiH_4 + SiF_4 = 150$ | $SiH_4:SiF_4:C_2H_4 = 3:3:4$ | 0.18 | 1.5μ |

Other conditions were the same as in Example 78.

The image forming member thus obtained was set in a charging-exposure-developing device, subjected to corona charging at ⊕5 kV for 0.2 sec., followed immediately by irradiation of a light image. As the light source, a tungsten lamp was employed and irradiation was effected at 1.0 lux.sec. using a transmissive type test chart.

Immediately thereafter, a negatively charged developer (containing toner and carrier) was cascaded onto the surface of the image forming member, whereby a good toner image with very high density was obtained thereon.

The thus obtained toner image was once subjected to cleaning with a rubber blade and again the above image making-cleaning steps were repeated. No deterioration of image was observed even after a repetition number of 150,000 or more.

EXAMPLE 81

Image forming members were prepared according to entirely the same procedure as in Example 78 except for varying the content ratio of silicon atoms to carbon atoms in the second amorphous layer (II) by varying the flow rate ratio of $SiH_4$ gas:$SiF_4$ gas:$C_2H_4$ gas during formation of the amorphous layer (II). For the thus obtained image forming members, image evaluations were conducted after repeating 50,000 times the steps of image making, developing and cleaning as described in Example 78 to obtain the results as shown in Table 80.

TABLE 80

| | | | | | | | | |
|---|---|---|---|---|---|---|---|---|
| $SiH_4:SiF_4:C_2H_4$ (Flow rate ratio) | 5:4:1 | 3:3.5:3.5 | 2:2:6 | 1:1:8 | 0.6:0.4:9 | 0.2:0.3:9.5 | 0.2:0.15:9.65 | 0.1:0.1:9.8 |
| Si:C (Content ratio) | 9:1 | 7:3 | 5.5:4.5 | 4:6 | 3:7 | 2:8 | 1.2:8.8 | 0.8:9.2 |
| | ○ | ⊙ | ⊙ | ⊙ | ⊙ | ⊙ | ○ | X |

⊙: Very good
○ : Good
X: Image defect formed

EXAMPLE 82

Image forming members were prepared according to entirely the same procedure as in Example 78 except for varying the layer thickness of the amorphous layer (II). By repeating the image making, developing and cleaning steps as described in Example 78, the following results were obtained.

TABLE 67

| Thickness of amorphous layer (II) (μ) | Results |
|---|---|
| 0.001 | Image defect liable to occur |
| 0.02 | No image defect during 20,000 repititions |
| 0.05 | Stable for 50,000 repetitions or more |
| 1 | Stable for 200,000 repetitions or more |

EXAMPLE 83

An image forming member was prepared according to the same procedure as in Example 78 except for changing the methods for forming the layers other than the amorphous layer (II) to those as shown in the Table below, and evaluation was conducted similarly to Example 78 to obtain good results.

TABLE 81A

| Order of layer formation | Conditions: Gases employed | Flow rate (SCCM) | Flow rate ratio | Discharging power (W/cm²) | Layer thickness |
|---|---|---|---|---|---|
| 1 (Interface layer) | $SiH_4$/He = 1<br>$SiF_4$/He = 1<br>$NH_3$ | $SiH_4$ = 100 | $SiH_4$:$SiF_4$:$NH_3$ = 1:2:1 | 0.18 | 500 Å |
| 2 (Rectifying layer) | $SiH_4$/He = 1<br>$B_2H_6$/He = $1 \times 10^{-2}$ | $SiH_4$ = 200 | $SiH_4$:$B_2H_6$ = $1:6.0 \times 10^{-3}$ | 0.18 | 6000 Å |
| 3 (Interface layer) | $SiH_4$/He = 1<br>$SiH_4$/He = 1<br>$NH_3$ | $SiH_4$ = 100 | $SiH_4$:$SiF_4$:$NH_3$ = 1:2:1 | 0.3 | 500 Å |
| 4 (Amorphous layer(I)) | $SiH_4$/He = 1 | $SiH_4$ = 200 | | 0.18 | 15μ |

EXAMPLE 84

An image forming member was prepared according to the same procedure as in Example 78 except for changing the methods for forming the layers other than the amorphous layer (II) to those as shown in the Table below, and evaluation was conducted similarly to Example 78 to obtain good results.

TABLE 82

| Order of layer formation | Conditions: Gases employed | Flow rate (SCCM) | Flow rate ratio | Discharging power (W/cm²) | Layer thickness |
|---|---|---|---|---|---|
| 1 (Interface layer) | $SiH_4$/He = 1<br>$SiF_4$/He = 1<br>$NH_3$ | $SiH_4$ = 100 | $SiH_4$:$SiF_4$:$NH_3$ = 2:1:1 | 0.18 | 400 Å |
| 2 (Rectifying layer) | $SiH_4$/He = 1<br>$SiF_4$/He = 1<br>$B_2H_6$/He = $1 \times 10^{-2}$ | $SiH_4$ = 100 | $SiH_4$:$SiF_4$:$B_2H_6$ = $1:1:1 \times 10^{-3}$ | 0.18 | 1μ |
| 3 (Amorphous layer(I)) | $SiH_4$/He = 1<br>$SiF_4$/He = 1 | $SiH_4$ = 100 | $SiH_4$:$SiF_4$ = 1:1 | 0.18 | 15μ |

EXAMPLE 85

An image forming member was prepared according to the same method as in Example 80 except that the amorphous layer (II) was formed according to the sputtering method under the conditions shown in the Table below, and evaluated similarly Example 80 to obtain good results.

TABLE 56

| | Gases employed | Flow rate (SCCM) | Target area ratio Si wafer: graphite | Discharging power (W/cm²) | Layer thickness (μ) |
|---|---|---|---|---|---|
| Amorphous Layer (II) | Ar<br>$SiF_4$/He = 0.5 | Ar = 200<br>$SiF_4$ = 100 | 2.5:7.5 | 0.3 | 1 |

EXAMPLE 86

By means of the preparation device as shown in FIG. 6, layers were formed on an aluminum substrate under the following conditions.

The image forming member for electrophotography thus obtained was set in a copying device, subjected to corona charging at ⊖5 kV for 0.2 sec. and irradiated with a light image. As the light source, a tungsten lamp was employed at 1.0 lux.sec. The latent image was developed with a positively charged developer (containing toner and carrier) and transferred onto a plain paper. The presence of any image defect (e.g. blank area at the black image portion) was checked, but no such defect was recognized at all and the image quality was found to be very good. The toner remaining on the image forming member without being transferred was subjected to cleaning by a rubber blade before turning to the next cycle of copying. Such step was repeated for 100,000 times or more, whereby no image defect or peel-off of layers occurred.

TABLE 84

| Order of layer formation | Layer formation method | Gases employed | Flow rate (SCCM) | Flow rate ratio | Inner pressure in reaction chamber (torr) | Discharging power (W/cm²) | Layer thickness |
|---|---|---|---|---|---|---|---|
| | | Conditions | | | | | |
| 1 (Interface layer) | Sputtering | $N_2$ Ar | $N_2 = 50$ | $N_2$:Ar = 1:1 | 0.1 | 0.30 | 500 Å |
| 2 (Rectifying layer) | Glow | $SiH_4$/He = 1 $PH_3$/He = $1 \times 10^{-2}$ | $SiH_4 = 200$ | $SiH_4$:$PH_3$ = $1:7 \times 10^{-4}$ | 0.3 | 0.18 | 6000 Å |
| 3 (Amorphous layer) | Glow | $SiH_4$/He = 1 | $SiH_4 = 200$ | | 0.3 | 0.18 | 15μ |

Al substrate temperature: 250° C.
Discharging frequency: 13.56 MHz

EXAMPLE 87

Image forming members for electrophotography were prepared according to entirely the same procedure as in Example 86 except for varying the content of nitrogen atoms relative to silicon atoms in the interface layer by varying the area ratio of Si wafer to $Si_3N_4$ wafer of the targets for sputtering and evaluated similarly to Example 86 to obtain the results shown below.

TABLE 85

| Nitrogren content (atomic %) | $5 \times 10^{-4}$ | 1 | 10 | 20 | 37 | 40 | 50 |
|---|---|---|---|---|---|---|---|
| Evaluation | Readily peeled | Good | Good | Excellent | Excellent | Good | Image defect slightly formed |

EXAMPLE 88

Image forming members for electrophotography were prepared according to entirely the same procedure as in Example 86 except for varying the layer thickness of the interface layer and evaluated similarly to Example 86 to obtain the results shown below.

TABLE 59

| Layer thickness | 10 Å | 30 Å | 400 Å | 2μ | 5μ |
|---|---|---|---|---|---|
| Evaluation | Readily peeled | Good | Excellent | Good | Image defect slightly formed |

EXAMPLE 89

Image forming members for electrophotography were prepared according to entirely the same procedure as in Example 86 except for varying the layer thickness of the rectifying layer and the content of phosphorus atom as follows. All of the results were good.

TABLE 87

| Sample No. | 8901 | 8902 | 8903 | 8904 | 8905 | 8906 | 8907 |
|---|---|---|---|---|---|---|---|
| Phosphorus atom content (atomic ppm) | $1 \times 10^5$ | 50000 | 3500 | 1500 | 800 | 500 | 100 |
| Thickness (μ) | 0.3 | 0.4 | 0.8 | 0.5 | 0.9 | 1.5 | 5 |

EXAMPLE 90

By means of the preparation device as shown in FIG. 6, layers were formed on an aluminum substrate under the following conditions.

The image forming member for electrophotography thus obtained was evaluated similarly to Example 86 to obtain very good results.

TABLE 88

| Order of layer formation | Layer formation method | Gases employed | Flow rate (SCCM) | Flow rate ratio | Inner pressure in reaction chamber (torr) | Discharging power (W/cm²) | Layer thickness |
|---|---|---|---|---|---|---|---|
| | | Conditions | | | | | |
| 1 (Lower interface layer) | Sputtering | $N_2$ Ar | $N_2 = 50$ | $N_2$:Ar = 2:1 | 0.1 | 0.30 | 500 Å |
| 2 (Rectifying layer) | Glow | $SiH_4$/He = 1 $PH_3$/He = $10^{-2}$ | $SiH_4 = 200$ | $SiH_4$:$PH_3$ = $1:5.0 \times 10^{-4}$ | 0.3 | 0.18 | 1μ |
| 3 (Upper | Sputtering | $N_2$ Ar | $N_2 = 50$ | $N_2$:Ar = 1:1 | 0.1 | 0.30 | 100 Å |

TABLE 88-continued

| Order of layer formation | Layer formation method | Gases employed | Flow rate (SCCM) | Flow rate ratio | Inner pressure in reaction chamber (torr) | Discharging power (W/cm²) | Layer thickness |
|---|---|---|---|---|---|---|---|
| | Conditions | | | | | | |
| interface layer) | | | | | | | |
| 4 (Amorphous layer) | Glow | $SiH_4/He = 1$ | $SiH_4 = 200$ | | 0.3 | 0.18 | 15μ |

EXAMPLE 91

Layer forming operation were conducted similarly to Example 86 by means of the device as shown in FIG. 6 except for using the following conditions.

The image forming member for electrophotography thus obtained was evaluated similarly to Example 86 to obtain very good results.

TABLE 89

| Order of layer formation | Gases employed | Flow rate (SCCM) | Flow rate ratio | Discharging power (W/cm²) | Layer thickness |
|---|---|---|---|---|---|
| | Conditions | | | | |
| 1 (Interface layer) | $SiH_4/He = 1$<br>$SiF_4/He = 1$<br>$NH_3$ | $SiH_4 = 100$ | $SiH_4:SiF_4:NH_3 = 1:1:2$ | 0.18 | 400 Å |
| 2 (Rectifying layer) | $SiH_4/He = 1$<br>$SiF_4/He = 1$<br>$PH_3/He = 1 \times 10^{-2}$ | $SiH_4 = 100$ | $SiH_4:SiF_4:PH_3 = 1:1:5 \times 10^{-3}$ | 0.18 | 1μ |
| 3 (Amorphous layer) | $SiH_4/He = 1$<br>$SiF_4/He = 1$ | $SiH_4 = 100$ | $SiH_4:SiF_4 = 1:1$ | 0.18 | 15μ |

EXAMPLE 92

Image forming members were prepared according to the same conditions and procedures as in Examples 86, 90 and 91 except that the amorphous layer was formed under the conditions shown in the Table below, and evaluated similarly to respective Examples to obtain good results.

TABLE 90

| Layer formed | Gases employed | Flow rate (SCCM) | Flow rate ratio | Discharging power (W/cm²) | Layer thickness (μ) |
|---|---|---|---|---|---|
| Amorphous layer | $SiH_4/He = 1$<br>$B_2H_6/He = 1 \times 10^{-2}$ | $SiH_4 = 200$ | $SiH_4:B_2H_6 = 1:2 \times 10^{-5}$ | 0.18 | 15 |

EXAMPLE 93

By means of the preparation device as shown in FIG. 6, layers were formed on an aluminum substrate under the following conditions.

The image forming member thus obtained was set in a charging-exposure-developing device, subjected to corona charging at ⊖5 kV for 0.2 sec., followed immediately by irradiation of a light image. As the light source, a tungsten lamp was employed and irradiation was effected at 1.0 lux.sec. using a transmissive type test chart.

Immediately thereafter, a positively charged developer (containing toner and carrier) was cascaded onto the surface of the image forming member, whereby a good toner image was obtained thereon.

The thus obtained toner image was once subjected to cleaning with a rubber blade and again the above image making-cleaning steps were repeated. No deterioration of image was observed even after a repetition number of 150,000 or more.

TABLE 91

| Order of layer formation | Gases employed | Flow rate (SCCM) | Flow rate ratio | Discharging power (W/cm²) | Layer thickness |
|---|---|---|---|---|---|
| | Conditions | | | | |
| 1 (Interface layer) | Ar | 200 | Area ratio<br>Si wafer:$Si_3N_4$ = 2:1 | 0.3 | 500 Å |

TABLE 91-continued

| Order of layer formation | Conditions: Gases employed | Flow rate (SCCM) | | Discharging power ($W/cm^2$) | Layer thickness |
|---|---|---|---|---|---|
| 2 (Rectifying layer) | $SiH_4/He = 1$<br>$PH_3/He = 1 \times 10^{-2}$ | $SiH_4 = 200$ | Flow rate ratio<br>$SiH_4:PH_3 = 1:5 \times 10^{-4}$ | 0.18 | 4000 Å |
| 3 (Amorphous layer(I)) | $SiH_4/He = 1$ | $SiH_4 = 200$ | | 0.18 | 15μ |
| 4 (Amorphous layer(II)) | Ar | 200 | Area ratio<br>Si wafer:graphite = 1.5:8.5 | 0.3 | 0.5μ |

| | | | |
|---|---|---|---|
| Al substrate temperature | 250° C. | Inner pressure in reaction chamber | |
| Discharging frequency | 13.56 MHz | interface layer | 0.2 Torr |
| | | rectifying layer<br>amorphous layer(I) | 0.3 Torr |
| | | amorphous layer(II) | 0.2 Torr |

EXAMPLE 94

By means of the preparation device as shown in FIG. 6, layers were formed on an aluminum substrate under the following conditions.

Other conditions were the same as in Example 93.

The image forming member thus obtained was set in a charging-exposure-developing device, subjected to corona charging at ⊖5 kV for 0.2 sec., followed immediately by irradiation of a light image. As the light source, a tungsten lamp was employed and irradiation was effected 1.0 lux.sec. using a transmissive type test chart.

Immediately thereafter, a positively charged developer (containing toner and carrier) was cascaded onto the surface of the image forming member, whereby a good toner image was obtained thereon.

The thus obtained toner image was once subjected to cleaning with a rubber blade and again the above image making-cleaning steps were repeated. No deterioration of image was observed even after a repetition number of 100,000 or more.

EXAMPLE 95

By means of the preparation device as shown in FIG. 6, layers were formed on an aluminum substrate under the following conditions.

Other conditions were the same as in Example 93.

The image forming member thus obtained was set in a charging-exposure-developing device, subjected to corona charging at ⊖5 kV for 0.2 sec., followed immediately by irradiation of a light image. As the light source a tungsten lamp was employed and irradiation was effected at 1.0 lux.sec. using a transmissive type test chart.

Immediately thereafter, a positively charged developer (containing toner and carrier) was cascaded onto the surface of the image forming member, whereby a good toner image with a very high density was obtained thereon.

The thus obtained toner image was once subjected to cleaning with a rubber blade and again the above image making-cleaning steps were repeated. No deterioration of image was observed even after a repetition number of 150,000 or more.

TABLE 92

| Order of layer formation | Conditions: Gases employed | Flow rate (SCCM) | | Discharging power ($W/cm^2$) | Layer thickness |
|---|---|---|---|---|---|
| 1 (Interface layer) | Ar | 200 | Area ratio<br>Si wafer:$Si_3N_4$ = 10:1 | 0.3 | 2000 Å |
| 2 (Rectifying layer) | $SiH_4/He = 1$<br>$PH_3/He = 1 \times 10^{-2}$ | $SiH_4 = 200$ | Flow rate ratio<br>$SiH_4:PH_3 = 1:1 \times 10^{-3}$ | 0.18 | 4000 Å |
| 3 (Amorphous layer(I)) | $SiH_4/He = 1$ | $SiH_4 = 200$ | | 0.18 | 15μ |
| 4 (Amorphous layer(II)) | Ar | 200 | Area ratio<br>Si wafer:graphite = 0.5:9.5 | 0.3 | 0.3μ |

TABLE 93

| Order of layer formation | Conditions: Gases employed | Flow rate (SCCM) | | Dis-charging power ($W/cm^2$) | Layer thick-ness |
|---|---|---|---|---|---|
| 1 (Interface layer) | Ar | 200 | Area ratio Si wafer:$Si_3N_4$ = 2:1 | 0.3 | 500 Å |
| 2 (Rectifying layer) | $SiH_4/He = 1$ $PH_3/He = 1 \times 10^{-2}$ | $SiH_4 = 200$ | Flow rate ratio $SiH_4:PH_3 = 1:3 \times 10^{-3}$ | 0.18 | 4000 Å |
| 3 (Amorphous layer(I)) | $SiH_4/He = 1$ | $SiH_4 = 200$ | | 0.18 | 15μ |
| 4 (Amorphous layer(II)) | Ar | 200 | Area ratio Si wafer:graphite = 6:4 | 0.3 | 1.0μ |

EXAMPLE 96

Image forming members were prepared according to entirely the same procedure as in Example 93 except for varying the content ratio of silicon atoms to carbon atoms in the second amorphous layer (II) by varying the area ratio of silicon wafer to graphite during formation of the amorphous layer (II). For the thus obtained image forming members, image evaluations conducted after repeating for 50,000 times the steps of image making, developing and cleaning as described in Example 93 to obtain the results as shown in Table 94.

TABLE 94

| | | | | | | | |
|---|---|---|---|---|---|---|---|
| SI:C Target (Area ratio) | 9:1 | 6.5:3.5 | 4:6 | 2:8 | 1:9 | 0.5:9.5 | 0.2:9.8 |
| Si:C (Content ratio) | 9.7:0.3 | 8.8:1.2 | 7.3:2.7 | 4.8:5.2 | 3:7 | 2:8 | 0.8:9.2 |
| Image quality evaluation | Δ | ○ | ⊙ | ⊙ | ⊙ | ○ | x |

⊙: Very good
○: Good
Δ: Practically satisfactory
x: Image defect formed

EXAMPLE 97

Image forming members were prepared according to entirely the same procedure as in Example 93 except for varying the layer thickness of the amorphous layer (II). By repeating the image making, developing and cleaning steps as described in Example 93, the following results were obtained.

TABLE 67

| Thickness of amorphous layer (II) (μ) | Results |
|---|---|
| 0.001 | Image defect liable to occur |
| 0.02 | No image defect during 20,000 repititions |
| 0.05 | Stable for 50,000 repetitions or more |
| 1 | Stable for 200,000 repetitions or more |

EXAMPLE 98

An image forming member was prepared according to the same procedure as in Example 93 except for changing the methods for forming the layers other than the amorphous layer (II) to those as shown in the Table below, and evaluation was conducted similarly to Example 93 to obtain good results.

TABLE 96

| Order of layer formation | Conditions: Gases employed | Flow rate (SCCM) | | Dis-charging power ($W/cm^2$) | Layer thick-ness |
|---|---|---|---|---|---|
| 1 (Lower interface layer) | Ar | 200 | Area ratio Si wafer:$Si_3N_4$ = 2:1 | 0.3 | 500 Å |
| 2 (Rectifying layer) | $SiH_3/He = 1$ $PH_3/He = 1 \times 10^{-2}$ | $SiH_4 = 200$ | Flow rate ratio $SiH_4:PH_3 = 1:3.0 \times 10^{-3}$ | 0.18 | 6000 Å |
| 3 (Upper interface layer) | Ar | 200 | Area ratio Si wafer:$Si_3N_4$ = 2:1 | 0.3 | 100 Å |
| 4 (Amorphous layer(I)) | $SiH_4/He = 1$ | $SiH_4 = 200$ | | 0.18 | 15μ |

EXAMPLE 99

An image forming member was prepared according to the same procedure as in Example 93 except for changing the methods for forming the layers other than the amorphous layer (II) to those as shown in the Table below, and evaluation was conducted similarly to Example 93 to obtain good results.

TABLE 97

| Order of layer formation | Conditions: Gases employed | Flow rate (SCCM) | | Discharging power (W/cm²) | Layer thickness |
|---|---|---|---|---|---|
| 1 (Interface layer) | Ar | 200 | Area ratio Si wafer:$Si_3N_4$ = 1:1 | 0.3 | 400 Å |
| 2 (Rectifying layer) | $SiH_4$/He = 1 $SiF_4$/He = 1 $PH_3$/He = $1 \times 10^{-2}$ | $SiH_4$ = 100 | Flow rate ratio $SiH_4$:$SiF_4$:$PH_3$ = 1:1:$5 \times 10^{-4}$ | 0.18 | 8000 Å |
| 3 (Amorphous layer(I) | $SiH_4$/He = 1 $SiF_4$/He = 1 | $SiH_4$ = 100 | Flow rate ratio $SiH_4SiF_4$ = 1:1 | 0.18 | 15μ |

TABLE 99

| Order of layer formation | Condition: Gases employed | Flow rate (SCCM) | | Discharge power (W/cm²) | Layer thickness |
|---|---|---|---|---|---|
| 1 (Interface layer) | Ar | 200 | Area ratio Si wafer:$Si_3N_4$ = 2:1 | 0.3 | 500 Å |
| 2 (Rectifying layer) | $SiH_4$/He = 1 $PH_3$/He = $1 \times 10^{-2}$ | $SiH_4$ = 200 | Flow rate ratio $SiH_4$:$Ph_3$ = 1:$5 \times 10^{-4}$ | 0.18 | 4000 Å |
| 3 (Amorphous layer(I)) | $SiH_4$/He = 1 | $SiH_4$ = 200 | | 0.18 | 15μ |
| 4 (Amorphous layer(II)) | $SiH_4$/He = 1 $C_2H_4$ | $SiH_4$ = 100 | Flow rate ratio $SiH_4$:$C_2H_4$ = 3:7 | 0.18 | 0.5μ |

EXAMPLE 100

Image forming members were prepared according to the same conditions and procedures as in Examples 93, 94, 95, 98 and 99 except that the amorphous layer (I) was formed under the conditions shown in the Table below, and evaluated similarly to respective Examples to obtain good results.

TABLE 98

| Layer formed | Gases employed | Flow rate (SCCM) | Flow rate ratio | Discharge power (W/cm²) | Layer thickness (μ) |
|---|---|---|---|---|---|
| Amorphous layer(I) | $SiH_4$/He = 1 $B_2H_6$/He = $1 \times 10^{-2}$ | $SiH_4$ = 200 | $SiH_4$:$B_2H_6$ = 1:$2 \times 10^{-5}$ | 0.18 | 15 |

EXAMPLE 101

By means of the preparation device as shown in FIG. 6, layers were formed on an aluminum substrate under the following conditions.

The image forming member for electrophogoraphy thus obtained was set in a copying device, subjected to corona charging at ⊖5 KV for 0.2 sec. and irradiated with a light image. As the light source, a tungsten lamp was employed at 1.0 lux.sec. The latent image was developed with a positively charged developer (containing toner and carrier) and transferred onto a plain paper. The transferred image was very good. The toner remaining on the image forming member for electrophotography without being transferred was subjected to cleaning by a rubber blade before turning to the next cycle of copying. Such step was repeated for 150,000 times or more, whereby no deterioration of image was observed.

Al substrate temperature: 250° C.
Discharging frequency: 13.56 MHz
Inner pressure in reaction chamber:

| | |
|---|---|
| interface layer | 0.2 Torr |
| rectifying layer, amorphous layer (I) | 0.3 Torr |
| amorphous layer (II) | 0.2 Torr |

EXAMPLE 102

By means of the preparation device as shown in FIG. 6, layers were formed on an aluminum substrate under the following conditions. Other conditions were the same as in Example 101.

The image forming member for electrophotography thus obtained was set in a copying device, subjected to corona charging at ⊖5 KV for 0.2 sec. and irradiated with a light image. As the light source, a tungsten lamp was employed at 1.0 lux.sec. The latent image was developed with a positively charged developer (containing toner and carrier) and transferred onto a plain paper. The transferred image was very good. The toner remaining on the image forming member for electrophotography without being transferred was subjected to cleaning by a rubber blade before turning to the next cycle of copying. Such a step was repeated for 100,000 times or more, whereby no deterioration of image was observed.

TABLE 100

| Order of layer formation | Condition: Gases employed | Flow rate (SCCM) | | Discharge power ($W/cm^2$) | Layer thickness |
|---|---|---|---|---|---|
| 1 (Interface layer) | Ar | 200 | Area ratio Si wafer:$Si_3N_4$ = 10:1 | 0.3 | 2000 Å |
| 2 (Rectifying layer) | $SiH_4/He = 1$ $PH_3/He = 1 \times 10^{-2}$ | $SiH_4$ =200 | Flow rate ratio $SiH_4:Ph_3$ = $1:1 \times 10^{-3}$ | 0.18 | 4000 Å |
| 3 (Amorphous layer(I)) | $SiH_4/He = 1$ | $SiH_4$ =200 | | 0.18 | 15μ |
| 4 (Amorphous layer(II)) | $SiH_4/He = 1$ $C_2H_4$ | $SiH_4$ =15 | Flow rate ratio $SiH_4:C_2H_4$ = 0.4:9.6 | 0.18 | 0.3μ |

EXAMPLE 103

By means of the preparation device as shown in FIG. 6, layers were formed on an aluminum substrate under the following conditions. Other conditions were the same in Example 101.

The image forming member for electrophotography thus obtained was set in a copying device, subjected to corona charging at ⊖5 KV for 0.2 sec. and irradiated with a light image. As the light source, a tungsten lamp was employed at 1.0 lux.sec. The latent image was developed with a positively charged developer (containing toner and carrier) and transferred onto a plain paper. The transferred image was very good. The toner remaining on the image forming member for electrophotography without being transferred was subjected to claning by a rubber blade before turning to the next cycle of copying. Such a step was repeared for 150,000 times or more, whereby no deterioration of image was observed.

TABLE 101

| Order of layer formation | Condition: Gases employed | Flow rate (SCCM) | | Discharge power ($W/cm^2$) | Layer thickness |
|---|---|---|---|---|---|
| 1 (Interface layer) | Ar | 200 | Area ratio Si wafer:$Si_3N_4$ = 2:1 | 0.3 | 500 Å |
| 2 (Rectifying layer | $SiH_4/He = 1$ $PH_3/He = 1 \times 10^{-2}$ | $SiH_4$ = 200 | Flow rate ratio $SiH_4:PH_3$ = $1:3 \times 10^{-3}$ | 0.18 | 4000 Å |
| 3 (Amorphous layer(I)) | $SiH_4/He = 1$ | $SiH_4$ = 200 | | 0.18 | 15μ |
| 4 (Amorphous layer(II) | $SiH_4/He = 0.5$ $C_2H_4$ | $SiH_4$ = 100 | Flow rate ratio $SiH_4:C_2H_4$ = 5:5 | 0.18 | 1.5μ |

EXAMPLE 104

Image forming members were prepared according to entirely the same procedure as in Example 101 except for varying the content ratio of silicon atoms to carbon atoms in the second amorphous layer (II) by varying the flow rate ratio of $SiH_4$ gas:$C_2H_4$ gas during formation of the amorphous layer (II). For the thus obtained image forming members, image evaluations were conducted after repeating 50,000 times the steps of image making, developing and cleaning as described in Example 101 to obtain the results as shown in Table 102.

TABLE 102

| | | | | | | | | |
|---|---|---|---|---|---|---|---|---|
| $SiH_4:C_2H_4$ (Flow rate ratio) | 9:1 | 6:4 | 4:6 | 2:8 | 1:9 | 0.5:9.5 | 0.35:9.65 | 0.2:9.8 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ⊙ | ⊙ | ⊙ | ⊙ | ○ | X |

⊙: Very good
○: Good
Δ: Practically satisfactory
X: Image defect liable to occur

EXAMPLE 105

Image forming members were prepared according to entirely the same procedure as in Example 101 except for varying the layer thickness of the amorphous layer (II) as shown in the Table below. The results of evaluation are as shown in the Table below.

TABLE 103

| Thickness of amorphous layer(II) (μ) | Results |
|---|---|
| 0.001 | Image defect liable to occur |
| 0.02 | No image defect during 20,000 repetitions |
| 0.05 | No image defect during 50,000 repetitions |
| 2 | Stable for 200,000 repetitions or more |

EXAMPLE 106

An image forming member was prepared according to the same procedure as in Example 101 except for changing the methods for forming the layers other than the amorphous layer (II) to those as shown in the Table below, and evaluation was conducted similarly as in Example 101 to obtain good results.

TABLE 104

| order of layer formation | Condition | | | | |
|---|---|---|---|---|---|
| | Gases employed | Flow rate (SCCM) | | Discharge power ($W/cm^2$) | Layer thickness |
| 1 (Interface layer) | Ar | 200 | Area ratio Si wafer:$Si_3N_4$ = 1:1 | 0.3 | 400 Å |
| 2 (Rectifying layer) | $SiH_4$/He = 100 $SiF_4$/He = 1 $PH_3$/He = $1 \times 10^{-2}$ | $SiH_4$ = 100 | Flow rate ratio $SiH_4$:$SiF_4$:$PH_3$ = $1:1:5 \times 10^{-4}$ | 0.18 | 8000 Å |
| 3 (Amorphous layer(I)) | $SiH_4$/He = 1 $SiF_4$/He = 1 | $SiH_4$ = 100 | Flow rate ratio $SiH_4$:$SiF_4$ = 1:1 | 0.18 | 15μ |

EXAMPLE 107

An image forming member was prepared according to the same procedure as in Example 101 except for changing the methods for forming the layers other than the amorphous layer (II) to those as shown in the Table below, and evaluation was conducted similarly to Example 101 to obtain good results.

TABLE 105

| Order of layer formation | Condition | | | | |
|---|---|---|---|---|---|
| | Gases employed | Flow rate (SCCM) | | Discharge power ($W/cm^2$) | Layer thickness |
| 1 (Lower interface layer) | Ar | 200 | Area ratio Si wafer:$Si_3N_4$ = 2:1 | 0.3 | 500 Å |
| 2 (Rectifying layer) | $SiH_4$/He = 1 $PH_3$/He = $1 \times 10^{-2}$ | $SiH_4$ = 200 | Flow rate ratio $SiH_4$:$PH_3$ = $1:3.0 \times 10^{-3}$ | 0.18 | 6000 Å |
| 3 (Upper interface layer) | Ar | 200 | Area ratio Si wafer: $Si_3N_4$ = 2:1 | 0.3 | 100 Å |
| 4 (Amorphous layer(I)) | $SiH_4$/He = 1 | $SiH_4$ = 200 | | 0.18 | 15μ |

EXAMPLE 108

Image forming members were prepared according to the same conditions and procedures as in Examples 101, 102, 103, 106 and 107 except that the amorphous layer (I) was formed under the conditions shown in the Table below, and evaluated similarly to respective Examples to obtain good results.

TABLE 106

| Layer formed | Gases employed | Flow rate (SCCM) | Flow rate ratio | Discharge power ($W/cm^2$) | Layer thickness (μ) |
|---|---|---|---|---|---|
| Amorphous layer(I) | $SiH_4$/He = 1 $B_2H_6$/He = $1 \times 10^{-2}$ | $SiH_4$ = 200 | $SiH_4$:$B_2H_6$ = $1:2 \times 10^{-5}$ | 0.18 | 15 |

EXAMPLE 109

By means of the preparation device as shown in FIG. 6, layers were formed on an aluminum substrate under the following conditions.

The image forming member thus obtained was set in a charge-exposure-developing device, subjected to corona charging at ⊖5 KV for 0.2 sec., followed immediately by irradiation of a light image. As the light source, a tungsten lamp was employed and irradiation was effected at 1.0 lux.sec. using a transmissive type test chart.

Immediately thereafter, a positively charged developer (containing toner and carrier) was cascaded onto the surface of the image forming member, whereby a good toner image was obtained thereon.

The thus obtained toner image was once subjected to cleaning with a rubber blade and again the above image making-cleaning steps were repeated. No deterioration of image was observed even after a repetition number of 150,000 or more.

TABLE 107

| Order of layer formation | Condition: Gases employed | Flow rate (SCCM) | | Discharge power (W/cm²) | Layer thickness |
|---|---|---|---|---|---|
| 1 (Interface layer) | Ar | 200 | Area ratio Si wafer:$Si_3N_4$ = 2:1 | 0.3 | 500 Å |
| 2 (Rectifying layer) | $SiH_4$/He = 1 $PH_3$/He = $1 \times 10^{-2}$ | $SiH_4$ = 200 | Flow rate ratio $SiH_4$:$PH_3$ = $1:5 \times 10^{-4}$ | 0.18 | 4000 Å |
| 3 (Amorphous layer(I)) | $SiH_4$/He = 1 | $SiH_4$ = 200 | | 0.18 | 15μ |
| 4 (Amorphous layer(II)) | $SiH_4$/He = 0.5 $SiF_4$/He = 0.5 $C_2H_4$ | $SiH_4$ + $SiF_4$ = 150 | Flow rate ratio $SiH_4$:$SiF_4$:$C_2H_4$ = 1.5:1.5:7 | 0.18 | 0.5μ |

Al substrate temperature: 250° C.
Discharging frequency: 13.56 MHz
Inner pressure in reaction chamber:

| | |
|---|---|
| interface layer | 0.2 Torr |
| rectifying layer | 0.3 Torr |
| amorphous layer (I) | 0.3 Torr |
| amorphous layer (II) | 0.5 Torr |

EXAMPLE 110

By means of the preparation device as shown in FIG. 6, layers were formed on an aluminum substrate under the following conditions. Other conditions were the same as in Example 109.

The image forming member thus obtained was set in a charging-exposure-developing device, subjected to corona charging at ⊖5 KV for 0.2 sec., followed immediately by irradiation of a light image. As the light source, a tungsten lamp was employed and irradiation was effected at 1.0 lux.sec. using a transmissive type test chart.

Immediately thereafter, a positively charged developer (containing toner and carrier) was cascaded onto the surface of the image forming member, whereby a good toner image was obtained thereon.

The thus obtained toner image was once subjected to cleaning with a rubber blade and again the above image making-cleaning steps were repeated. No deterioration of image was observed even after a repetition number of 100,000 or more.

TABLE 108

| Order of layer formation | Condition: Gases employed | Flow rate (SCCM) | | Discharge power (W/cm²) | Layer thickness |
|---|---|---|---|---|---|
| 1 (Interface layer) | Ar | 200 | Area ratio Si wafer:$Si_3N_4$ = 10:1 | 0.3 | 2000 Å |
| 2 (Rectifying layer) | $SiH_4$/He = 1 $PH_3$/He = $1 \times 10^{-2}$ | $SiH_4$ = 200 | Flow rate ratio $SiH_4$:$PH_3$ = $1:1 \times 10^{-3}$ | 0.18 | 4000 Å |
| 3 (Amorphous layer(I)) | $SiH_4$/He = 1 | $SiH_4$ = 200 | | 0.18 | 15μ |
| 4 (Amorphous layer(II)) | $SiH_4$/He = 0.5 $SiF_4$/He = 0.5 $C_2H_4$ | $SiH_4$ + $SiF_4$ = 15 | Flow rate ratio $SiH_4$:$SiF_4$:$C_2H_4$ = 0.3:0.1:9.6 | 0.18 | 0.3μ |

EXAMPLE 111

By means of the preparation device as shown in FIG. 6, layers were formed on an aluminum substrate under the following conditions. Other conditions were the same as in Example 109.

The image forming member thus obtained was set in a charging-exposure-developing device, subjected to corona charging at ⊖5 KV for 0.2 sec., followed immediately by irradiation of a light image. As the light source, a tungsten lamp was employed and irradiation was effected at 1.0 lux.sec. using a transmissive type test chart.

Immediately thereafter, a positively charged developer (containing toner and carrier) was cascaded onto the surface of the image forming member, whereby a good toner image was obtained thereon.

The thus obtained toner image was once subjected to cleaning with a rubber blade and again the above image making-cleaning steps were repeated. No deterioration of image was observed even after a repetition number of 150,000 or more.

TABLE 109

| Order of layer formation | Condition | | | | |
|---|---|---|---|---|---|
| | Gases employed | Flow rate (SCCM) | | Discharge power ($W/cm^2$) | Layer thickness |
| 1 (Interface layer) | Ar | 200 | Area ratio Si wafer:$Si_3N_4$ = 2:1 | 0.3 | 500 Å |
| 2 (Rectifying layer) | $SiH_4/He = 1$ $PH_3/He = 1 \times 10^{-2}$ | $SiH_4 = 200$ | Flow rate ratio $SiH_4:PH_3 = 1:3 \times 10^{-3}$ | 0.18 | 4000 Å |
| 3 (Amorphous layer(I)) | $SiH_4/He = 1$ | $SiH_4 = 200$ | | 0.18 | 15μ |
| 4 (Amorphous layer(II)) | $SiH_4/He = 0.5$ $SiF_4/He = 0.5$ $C_2H_4$ | $SiH_4 + SiF_4 = 150$ | Area ratio $SiH_4:SiF_4:C_2H_4$ = 3:3:4 | 0.18 | 1.5μ |

EXAMPLE 112

Image forming members were prepared according to entirely the same procedure as in Example 109 except for varying the content ratio of silicon atoms to carbon atoms in the second amorphous layer (II) by varying the flow rate ratio of $SiH_4$ gas: $SiF_4$ gas: $C_2H_4$ gas during formation of the amorphous layer (II). For the thus obtained image forming members, image evaluations were conducted after repeating 50,000 times the steps of image making, developing and cleaning as described in Example 109 to obtain the results as shown in Table 110.

TABLE 110

| | | | | | | | | |
|---|---|---|---|---|---|---|---|---|
| $SiH_4:SiF_4:C_2H_4$ (Flow rate ratio) | 5:4:1 | 3:3.5:3.5 | 2:2:6 | 1:1:8 | 0.6:0.4:9 | 0.2:0.3:9.5 | 0.2:0.15:9.65 | 0.1:0.1:9.8 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ◎ | ◎ | ◎ | ◎ | ○ | X |

◎: Very good
○: Good
Δ: Practically satisfactory
X: Image defect liable to occur

EXAMPLE 113

Image forming members were prepared according to entirely the same procedure as in Example 109 except for varying the layer thickness of the amorphous layer (II). By repeating the image making, developing and cleaning steps as described in Example 109, the following results were obtained.

TABLE 111

| Thickness of amorphous layer(II) (μ) | Results |
|---|---|
| 0.001 | Image defect liable to occur |
| 0.02 | No image defect during 20,000 repetitions |
| 0.05 | Stable for 50,000 repetitions or more |
| 1 | Stable for 200,000 repetitions or more |

EXAMPLE 114

An image forming member was prepared according to the same procedure as in Example 109 except for changing the methods for forming the layers other than the amorphous layer (II) to those as shown in the Table below, and evaluation was conducted similarly to Example 109 to obtain good results.

TABLE 112

| Order of layer formation | Condition | | | | |
|---|---|---|---|---|---|
| | Gases employed | Flow rate (SCCM) | | Discharge power ($W/cm^2$) | Layer thickness |
| 1 (Lower interface layer) | Ar | 200 | Area ratio Si wafer:$Si_3N_4$ = 2:1 | 0.3 | 500 Å |
| 2 (Rectifying layer) | $SiH_4/He = 1$ $PH_3/He = 1 \times 10^{-2}$ | $SiH_4 = 200$ | Flow rate ratio $SiH_4:PH_3 = 1:3.0 \times 10^{-3}$ | 0.18 | 6000 Å |
| 3 (Upper interface layer) | Ar | 200 | Area ratio Si wafer:$Si_3N_4$ = 2:1 | 0.3 | 100 Å |
| 4 (Amorphous layer(I)) | $SiH_4/He = 1$ | $SiH_4 = 200$ | | 0.18 | 15μ |

EXAMPLE 115

An image forming member was prepared according to the same procedure as in Example 109 except for changing the methods for forming the layers other than the amorphous layer (II) to those as shown in the Table below, and evaluation was conducted similarly as in Example 109 to obtain good results.

TABLE 113

| Order of layer formation | Condition: Gases employed | Flow rate (SCCM) | Flow rate ratio | Discharge power (W/cm$^2$) | Layer thickness |
|---|---|---|---|---|---|
| 1 (Interface layer) | Ar | 200 | Area ratio Si wafer:$Si_3N_4$ = 1:1 | 0.3 | 400 Å |
| 2 (Rectifying layer) | $SiH_4$/He = 1 $SiF_4$/He = 1 $PH_3$/He = $1 \times 10^{-2}$ | $SiH_4$ = 100 | Flow rate ratio $SiH_4$:$SiF_4$:$PH_3$ = 1:1:5 × $10^{-4}$ | 0.18 | 8000 Å |
| 3 (Amorphous layer(I)) | $SiH_4$/He = 1 $SiF_4$/He = 1 | $SiH_4$ = 100 | Flow rate ratio $SiH_4$:$SiF_4$ = 1:1 | 0.18 | 15μ |

EXAMPLE 116

An image forming member was prepared according to the same method as in Example 111 except that the amorphous layer (II) was formed according to the sputtering method under the conditions shown in the Table below, and evaluated similarly to Example 111 to obtain good results.

TABLE 114

| Layer formed | Gases employed | Flow rate (SCCM) | Flow rate ratio | Discharge power (W/cm$^2$) | Layer thickness (μ) |
|---|---|---|---|---|---|
| Amorphous layer(I) | $SiH_4$/He = 1 $B_2H_6$/He = $1 \times 10^{-2}$ | $SiH_4$ = 200 | $SiH_4$:$B_2H_6$ = 1:2 × $10^{-5}$ | 0.18 | 15 |

EXAMPLE 117

Image forming members were prepared according to the same conditions as in Examples 109, 110, 111, 114 and 115 except that the amorphous layer (I) was formed under the conditions shown in the Table below, and evaluated similarly to respective Examples to obtain good results.

TABLE 115

| Layer formed | Gases employed | Flow rate (SCCM) | Target area ratio Si wafer:graphite | Discharge power (W/cm$^2$) | Layer thickness (μ) |
|---|---|---|---|---|---|
| Amorphous layer(II) | Ar $SiF_4$/He = 0.5 | Ar = 200 $SiF_4$ = 100 | 2.5:7.5 | 0.3 | 1 |

EXAMPLE 118

By means of the preparation device as shown in FIG. 5, layers were formed on a drumshaped aluminum substrate under the following conditions.

The image forming member for electrophotography thus obtained was set in a copying device, subjected to corona charging at ⊖5 KV for 0.2 sec. and irraidated with a light image. As the light source, a tungsten lamp was employed at 1.0 lux.sec. The latent image was developed with a positively charged developer (containing toner and carrier) and transferred onto a plain paper. The transferred image was very good. The toner remaining on the image forming member without being transferred was subjected to cleaning by a rubber blade before turning to the next cycle of copying. Such a step was repeated for 100,000 times or more, whereby no peel-off of layers occurred and the images were good.

TABLE 116

| Order of layer formation | Condition: Gases employed | Flow rate (SCCM) | Flow rate ratio | Discharge power (W/cm$^2$) | Layer thickness |
|---|---|---|---|---|---|
| 1 (Interface layer) | $SiH_4$/He = 1 $NH_3$ | $SiH_4$ = 100 | $SiH_4$:$NH_3$ = 3:1 | 0.18 | 500 Å |
| 2 (Rectifying layer) | $SiH_4$/He = 1 $PH_3$/He = $1 \times 10^{-2}$ | $SiH_4$ = 200 | $SiH_4$:$PH_3$ = 1:5 × $10^{-4}$ | 0.18 | 4000 Å |
| 3 (Amorphous layer) | $SiH_4$/He = 1 | $SiH_4$ = 200 | | 0.18 | 15μ |

Al substrate temperature: 250° C.
Discharging frequency: 13.56 MHz
Inner pressure in reaction chamber: 0.3 Torr

EXAMPLE 119

Image forming members for electrophotography were prepared according to entirely the same procedure as in Example 118 except for varying the content of nitrogen atoms relative to silicon atoms in the interface layer.

The results of evaluation conducted similarly to Example 118 are shown below.

TABLE 117

| Nitrogen content (atomic %) | 0.1 | 1 | 10 | 20 | 23 | 25 |
|---|---|---|---|---|---|---|
| Evaluation | Good | Good | Excellent | Good | Good | Image defect formed in few cases |

EXAMPLE 120

Image forming members for electrophotography were prepared according to entirely the same procedure as in Example 118 except for varying the layer thickness of the interface layer and evaluated similarly to Example 118 to obtain the results shown below.

TABLE 118

| Layer thickness | 10 Å | 30 Å | 400 Å | 2μ | 5μ |
|---|---|---|---|---|---|
| Evaluation | Readily peeled | ○ | ○ | ○ | Image defect formed in some cases |

○: Not peeled, and good image obtained

EXAMPLE 121

Image forming members for electrophotography were prepared according to entirely the same procedure as in Example 118 except for varying the layer thickness of the rectifying layer and the content of phosphorus atoms as follows. All of the results were good.

TABLE 119

| Sample No. | 12101 | 12102 | 12103 | 12104 | 12105 | 12106 | 12107 |
|---|---|---|---|---|---|---|---|
| Phosphorus atom content (atomic ppm) | $1 \times 10^5$ | 50000 | 3500 | 1500 | 800 | 500 | 100 |
| Thickness (μ) | 0.3 | 0.4 | 0.8 | 0.5 | 0.9 | 1.5 | 5 |

EXAMPLE 122

By means of the preparation device as shown in FIG. 5, layers were formed on a drum-shaped aluminum substrate under the following conditions.

The obtained drum was of a high quality without any layer peel-off or image defect at all.

TABLE 120

| Order of layer formation | Condition: Gases employed | Flow rate (SCCM) | Flow rate ratio | Discharge power (W/cm²) | Layer thickness |
|---|---|---|---|---|---|
| 1 (Lower interface layer) | $SiH_4$/He = 1 $NH_3$ | $SiH_4$ = 100 | $SiH_4$:$NH_3$ = 3:1 | 0.18 | 500 Å |
| 2 (Rectifying layer) | $SiH_4$/He = 1 $PH_3$/He = $1 \times 10^{-2}$ | $SiH_4$ = 200 | $SiH_4$:$PH_3$ = $1:1 \times 10^{-3}$ | 0.18 | 6000 Å |
| 3 (Upper interface layer) | $SiH_4$/He = 1 $NH_3$ | $SiH_4$ = 10 | $SiH_4$:$NH_3$ = 1:10 | 0.18 | 500 Å |
| 4 (Amorphous layer) | $SiH_4$/He = 1 | $SiH_4$ = 200 | | 0.18 | 15μ |

EXAMPLE 123

By means of the device as shown in FIG. 5, layers were formed on a drum-shaped aluminum substrate under the following conditions.

The image forming member for electrophotography thus obtained was evaluated similarly as in Example 118 to obtain very good results.

TABLE 121

| Order of layer formation | Condition: Gases employed | Flow rate (SCCM) | Flow rate ratio | Discharge power (W/cm²) | Layer thickness |
|---|---|---|---|---|---|
| 1 (Interface layer) | $SiH_4$/He = 1 $NH_3$ | $SiH_4$ = 100 | $SiH_4$:$NH_3$ = 1:1 | 0.18 | 400 Å |
| 2 (Rectifying layer) | $SiH_4$/He = 1 $SiF_4$/He = 1 $PH_3$/He = $1 \times 10^{-2}$ | $SiH_4$ = 100 | $SiH_4$:$SiF_4$:$PH_3$ = $1:1:3 \times 10^{-4}$ | 0.18 | 1μ |
| 3 (Amorphous layer) | $SiH_4$/He = 1 $SiF_4$/He = 1 | $SiH_4$ = 100 | $SiH_4$:$SiF_4$ = 1:1 | 0.18 | 15μ |

EXAMPLE 124

Image forming members were prepared according to the same conditions and procedures as in Examples 118, 122 and 123 except that the amorphous layer was formed under the conditions shown in the Table below, and evaluated similarly to respective Examples to obtain good results.

TABLE 122

| Layer formed | Gases employed | Flow rate (SCCM) | Flow rate ratio | Discharge power (W/cm²) | Layer thickness (μ) |
|---|---|---|---|---|---|
| Amorphous layer(I) | $SiH_4/He = 1$<br>$B_2H_6/He = 1 \times 10^{-2}$ | $SiH_4 = 200$ | $SiH_4:B_2H_6 = 1:2 \times 10^{-5}$ | 0.18 | 15 |

EXAMPLE 125

By means of the preparation device as shown in FIG. 6, layers were formed on an aluminum substrate under the following conditions.

The image forming member thus obtained was set in a charging-exposure-developing device, subjected to corona charging at ⊖5 KV for 0.2 sec., followed immediately by irradiation of a light image. As the light source, a tungsten lamp was employed and irradiation was effected at 1.0 lux.sec. using a transmissive type test chart.

Immediately thereafter, a positively charged developer (containing toner and carrier) was cascaded onto the surface of the image forming member, whereby a good toner image was obtained thereon.

The thus obtained toner image was subjected to cleaning with a rubber blade and again the above image making-cleaning steps were repeated. No deterioration of image was observed even after a repetition number of 150,000 or more.

EXAMPLE 126

By means of the preparation device as shown in FIG. 6, layers were formed on an aluminum substrate under the following conditions.

Other conditions were the same as in Example 125.

The image forming member thus obtained was set in a charging-exposure-developing device, subjected to corona charging at ⊖5 KV for 0.2 sec., followed immediately by irradiation of a light image. As the light source, a tungsten lamp was employed and irradiation was effected at 1.0 lux.sec. using a transmissive type test chart.

Immediately thereafter, a positively charged developer (containing toner and carrier) was cascaded onto the surface of the image forming member, whereby a good toner image was obtained thereon.

The thus obtained toner image was once subjected to cleaning with a rubber blade and again the above image making-cleaning steps were repeated. No deterioration of image was observed even after a repetition number of 100,000 or more.

TABLE 123

| Order of layer formation | Condition: Gases employed | Flow rate (SCCM) | Flow rate ratio | Discharge power (W/cm²) | Layer thickness |
|---|---|---|---|---|---|
| 1 (Interface layer) | $SiH_4/He = 1$<br>$NH_3$ | $SiH_4 = 100$ | $SiH_4:NH_3 = 3:1$ | 0.18 | 500 Å |
| 2 (Rectifying layer) | $SiH_4/He = 1$<br>$PH_3/He = 1 \times 10^{-2}$ | $SiH_4 = 200$ | $SiH_4:PH_3 = 1:5 \times 10^{-4}$ | 0.18 | 4000 Å |
| 3 (Amorphous layer (I)) | $SiH_4/He = 1$ | $SiH_4 = 200$ | | 0.18 | 15μ |
| 4 (Amorphous layer (II)) | Ar | 200 | Si wafer:graphite = 1.5:8.5 | 0.3 | 0.5μ |

Al substrate temperature: 250° C.
Discharging frequency: 13.56 MHz
Inner pressure in reaction chamber:
amorphous layer (I), 0.3 Torr
amorphous layer (II), 0.2 Torr

TABLE 124

| Order of layer formation | Condition: Gases employed | Flow rate (SCCM) | | Discharge power (W/cm²) | Layer thickness |
|---|---|---|---|---|---|
| 1 (Interface layer) | $SiH_4/He = 1$<br>$NH_3$ | $SiH_4 = 100$ | Flow rate ratio<br>$SiH_4:NH_3 = 10:1$ | 0.18 | 2000 Å |
| 2 (Rectifying layer) | $SiH_4/He = 1$<br>$PH_3/He = 1 \times 10^{-2}$ | $SiH_4 = 200$ | Flow rate ratio<br>$SiH_4:PH_3 = 1:1 \times 10^{-3}$ | 0.18 | 4000 Å |
| 3 (Amorphous layer(I)) | $SiH_4/He = 1$ | $SiH_4 = 200$ | | 0.18 | 15μ |
| 4 (Amorphous layer(II)) | Ar | 200 | Area ratio<br>Si wafer:graphite = 0.5:9.5 | 0.3 | 0.3μ |

EXAMPLE 127

By means of the preparation device as shown in FIG. 6, layers were formed on an aluminum substrate under the following conditions.

Other conditions were the same as in Example 125.

The image forming member thus obtained was set in a charging-exposure-developing device, subjected to corona charging at ⊖5 KV for 0.2 sec., followed immediately by irradiation of a light image. As the light source, a tungsten lamp was employed and irradiation was effected at 1.0 lux.sec. using a transmissive type test chart.

Immediately thereafter, a positively charged developer (containing toner and carrier) was cascaded onto the surface of the image forming member, whereby a good toner image with very high density was obtained thereon.

The thus obtained toner image was once subjected to cleaning with a rubber blade and again the above image making-cleaning steps were repeated. No deterioration of image was observed even after a repetition number of 150,000 or more.

TABLE 125

| Order of layer formation | Condition: Gases employed | Flow rate (SCCM) | Flow rate ratio | Discharge power (W/cm²) | Layer thickness |
|---|---|---|---|---|---|
| 1 (Interface layer) | $SiH_4$/He = 1<br>$NH_3$ | $SiH_4$ = 100 | Flow rate ratio<br>$SiH_4$:$NH_3$ = 3:1 | 0.18 | 500 Å |
| 2 (Rectifying layer) | $SiH_4$/He = 1<br>$PH_3$/He = $1 \times 10^{-2}$ | $SiH_4$ = 200 | Flow rate ratio<br>$SiH_4$:$PH_3$ = $1:3 \times 10^{-3}$ | 0.18 | 4000 Å |
| 3 (Amorphous layer(I)) | $SiH_4$/He = 1 | $SiH_4$ = 200 | | 0.18 | 15μ |
| 4 (Amorphous layer(II)) | Ar | 200 | Area ratio<br>Si wafer:graphite = 6:4 | 0.3 | 1.0μ |

EXAMPLE 128

Image forming members were prepared according to entirely the same procedure as in Example 125 except for varying the content ratio of silicon atoms to carbon atoms in the second amorphous layer (II) by varying the area ratio of silicon wafer to graphite during formation of the amorphous layer (II). For the thus obtained image forming members, image evaluations were conducted after repeating 50,000 times the steps of image making, developing and cleaning as described in Example 125 to obtain the results as shown in Table 126.

TABLE 126

| | | | | | | | |
|---|---|---|---|---|---|---|---|
| Si:C Target (Area ratio) | 9.1 | 6.5:3.5 | 4:6 | 2:8 | 1:9 | 0.5:9.5 | 0.2:9.8 |
| Si:C (Content ratio) | 9.7:0.3 | 8.8:1.2 | 7.3:2.7 | 4.8:5.2 | 3:7 | 2:8 | 0.8:9.2 |
| Image quality evaluation | Δ | ○ | ⊙ | ⊙ | ⊙ | ○ | X |

⊙: Very good
○: Good
Δ: Practically satisfactory
X: Image defect formed

EXAMPLE 129

Image forming members were prepared according to entirely the same procedure as in Example 125 except for varying the film thickness of the amorphous layer (II). By repeating the image making, developing and cleaning steps as described in Example 125, the following results were obtained.

TABLE 127

| Thickness of amorphous layer (II) (μ) | Results |
|---|---|
| 0.001 | Image defect liable to occur |
| 0.02 | No image defect during 20,000 repetitions |
| 0.05 | Stable for 50,000 repetitions or more |
| 1 | Stable for 200,000 repetitions or more |

EXAMPLE 130

An image forming member was prepared according to the same procedure as in Example 125 except for changing the methods for forming the layers other than the amorphous layer (II) to those as shown in the Table below, and evaluation was conducted similarly to Example 125 to obtain good results.

TABLE 128

| Order of layer formation | Condition: Gases employed | Flow rate (SCCM) | Flow rate ratio | Discharge power (W/cm²) | Layer thickness |
|---|---|---|---|---|---|
| 1 (Lower interface layer) | $SiH_4$/He = 1<br>$NH_3$ | $SiH_4$ = 100 | $SiH_4$:$NH_3$ = 3:1 | 0.18 | 500 Å |
| 2 (Rectifying layer) | $SiH_4$/He = 1<br>$PH_3$/He = $1 \times 10^{-2}$ | $SiH_4$ = 200 | $SiH_4$:$PH_3$ = $1:3 \times 10^{-3}$ | 0.18 | 6000 Å |
| 3 | $SiH_4$/He = 1 | $SiH_4$ = 100 | $SiH_4$:$NH_3$ = 3:1 | 0.18 | 500 Å |

TABLE 128-continued

| Order of layer formation | Condition: Gases employed | Flow rate (SCCM) | Flow rate ratio | Discharge power (W/cm²) | Layer thickness |
|---|---|---|---|---|---|
| (Upper interface layer) | $NH_3$ | | | | |
| 4 (Amorphous layer (I)) | $SiH_4$/He = 1 | $SiH_4$ = 200 | | 0.18 | 15μ |

EXAMPLE 131

An image forming member was prepared according to the same procedure as in Example 125 except for changing the methods for forming the layers other than the amorphous layer (II) to those as shown in the Table below, and evaluation was conducted similarly to Example 125 to obtain good results.

TABLE 129

| Order of layer formation | Condition: Gases employed | Flow rate (SCCM) | Flow rate ratio | Discharge power (W/cm²) | Layer thickness |
|---|---|---|---|---|---|
| 1 (Interface layer) | $SiH_4$/He = 1<br>$NH_3$ | $SiH_4$ = 100 | $SiH_4$:$NH_3$ = 1:1 | 0.18 | 400 Å |
| 2 (Rectifying layer) | $SiH_4$/He = 1<br>$SiF_4$/He = 1<br>$PH_3$/He = 1 × $10^{-2}$ | $SiH_4$ = 100 | $SiH_4$:$SiF_4$:$PH_3$ = 1:1:5 × $10^{-4}$ | 0.18 | 1μ |
| 3 (Amorphous layer (I)) | $SiH_4$/He = 1 | $SiH_4$ = 100 | $SiH_4$:$SiF_4$ = 1:1 | 0.18 | 15μ |

EXAMPLE 132

Image forming members were prepared according to the same conditions and procedures as in Examples 125, 126, 127, 130 and 131 except that the amorphous layer (I) was formed under the conditions shown in the Table below, and evaluated similarly to respective Examples to obtain good results.

TABLE 130

| Layer formed | Gases employed | Flow rate (SCCM) | Flow rate ratio | Discharge power (W/cm²) | Layer thickness (μ) |
|---|---|---|---|---|---|
| Amorphous layer (I) | $SiH_4$/He = 1<br>$B_2H_6$/He = 1 × $10^{-2}$ | $SiH_4$ = 200 | $SiH_4$:$B_2H_6$ = 1:2 × $10^{-5}$ | 0.18 | 15 |

EXAMPLE 133

By means of the preparation device as shown in FIG. 5, layers were formed on a drum-shaped aluminum substrate under the following conditions.

The image forming member for electrophotography thus obtained was set in a copying device, subjected to corona charging at ⊖5 KV for 0.2 sec. and irradiated with a light image. As the light source, a tungsten lamp was employed at 1.0 lux.sec. The latent image was developed with a positively charged developed (containing toner and carrier) and transferred onto a plain paper. The transferred image was very good. The toner remaining on the image forming member without being transferred was subjected to cleaning by a rubber blade before turning to the next cycle of copying. Such a step was repeated for 150,000 times or more, whereby no deterioration of image was observed.

TABLE 131

| Order of layer formation | Condition: Gases employed | Flow rate (SCCM) | Flow rate ratio | Discharge power (W/cm²) | Layer thickness |
|---|---|---|---|---|---|
| 1 (Interface layer) | $SiH_4$/He = 1<br>$NH_3$ | $SiH_4$ = 100 | $SiH_4$:$NH_3$ = 3:1 | 0.18 | 500 Å |
| 2 (Rectifying layer) | $SiH_4$/He = 1<br>$PH_3$/He = 1 × $10^{-2}$ | $SiH_4$ = 200 | $SiH_4$:$PH_3$ = 1:5 × $10^{-4}$ | 0.18 | 4000 Å |
| 3 (Amorphous layer(I)) | $SiH_4$/He = 1 | $SiH_4$ = 200 | | 0.18 | 15μ |
| 4 (Amorphous layer(II)) | $SiH_4$/He = 0.5<br>$C_2H_4$ | $SiH_4$ = 100 | $SiH_4$:$C_2H_4$ = 3:7 | 0.18 | 0.5μ |

Al substrate temperature: 250° C.

Discharging frequency: 13.56 MHz
Inner pressure in reaction chamber:
amorphous layer (I), 0.3 Torr
amorphous layer (II) 0.5 Torr

EXAMPLE 134

By means of the preparation device as shown in FIG. 5, layers were formed on a drum-shaped aluminum substrate under the following conditions.

The image forming member for electrophotography thus obtained was set in a copying device, subjected to corona charging at ⊖5 KV for 0.2 sec. and irradiated with a light image. As the light sorce, a tungsten lamp was employed at 1.0 lux.sec. The latent image was developed with a positively charged developer (containing toner and carrier) and transferred onto a plain paper. The transferred image was very good. The toner remaining on the image forming member without being transferred was subjected to cleaning by a rubber blade before turning to the next cycle of copying. Such a step was repeated for 100,000 times or more, whereby no deterioration of image was observed.

TABLE 132

| Order of layer formation | Condition: Gases employed | Flow rate (SCCM) | Flow rate ratio | Discharge power (W/cm$^2$) | Layer thickness |
|---|---|---|---|---|---|
| 1 (Interface layer) | $SiH_4$/He = 1<br>$NH_3$ | $SiH_4$ = 100 | $SiH_4$:$NH_3$ = 10:1 | 0.18 | 2000 Å |
| 2 (Rectifying layer) | $SiH_4$/He = 1<br>$PH_3$/He = $1 \times 10^{-2}$ | $SiH_4$ = 200 | $SiH_4$:$PH_3$ = 1:1 $\times 10^{-3}$ | 0.18 | 4000 Å |
| 3 (Amorphous layer(I)) | $SiH_4$/He = 1 | $SiH_4$ = 200 | | 0.18 | 15μ |
| 4 (Amorphous layer(II)) | $SiH_4$/He = 1<br>$C_2H_4$ | $SiH_4$ = 15 | $SiH_4$:$C_2H_4$ = 0.4:9.6 | 0.18 | 0.3μ |

EXAMPLE 135

By means of the preparation device as shown in FIG. 5, layers were formed on a drumshaped aluminum substrate under the following conditions.

The image forming member for electrophotography thus obtained was set in a copying device, subjected to corona charging at ⊖5 KV for 0.2 sec. and irradiated with a light image. As the light source, a tungsten lamp was employed at 1.0 lux.sec. The latent image was developed with a positively charged developer (containing toner and carrier) and transferred onto a plain paper. The transferred image was very good with a very high density. The toner remaining on the image forming member without being transferred was subjected to cleaning by a rubber blade before turning to the next cycle of copying. Such a step was repeated for 150,000 times or more, whereby no deterioration of image was observed.

TABLE 133

| Order of layer formation | Condition: Gases employed | Flow rate (SCCM) | Flow rate ratio | Discharge power (W/cm$^2$) | Layer thickness |
|---|---|---|---|---|---|
| 1 (Interface layer) | $SiH_4$/He = 1<br>$NH_3$ | $SiH_4$ = 100 | $SiH_4$:$NH_3$ = 3:1 | 0.18 | 500 Å |
| 2 (Rectifying layer) | $SiH_4$/He = 1<br>$PH_3$/He = $1 \times 10^{-2}$ | $SiH_4$ = 200 | $SiH_4$:$PH_3$ = 1:3 $\times 10^{-3}$ | 0.18 | 4000 Å |
| 3 (Amorphous layer(I)) | $SiH_4$/He = 1 | $SiH_4$ = 200 | | 0.18 | 15μ |
| 4 (Amorphous layer(II)) | $SiH_4$/He = 0.5<br>$C_2H_4$ | $SiH_4$ = 100 | $SiH_4$:$C_2H_4$ = 5:5 | 0.18 | 1.5μ |

EXAMPLE 136

Image forming members were prepared according to entirely the same procedure as in Example 133 except for varying the content ratio of silicon atoms to carbon atoms in the second amorphous layer (II) by varying the flow rate ratio of $SiH_4$ gas:$C_2H_4$ gas during formation of the amorphous layer (II). For the thus obtained image forming members, image evaluations were conducted after repeating 50,000 times the steps of image making, developing and cleaning as described in Example 133 to obtain the results as shown in Table 134.

TABLE 134

| | | | | | | | | |
|---|---|---|---|---|---|---|---|---|
| $SiH_4$:$C_2H_4$ (Flow rate ratio) | 9:1 | 6:4 | 4:6 | 2:8 | 1:9 | 0.5:9.5 | 0.35:9.65 | 0.2:9.8 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ⊙ | ⊙ | ⊙ | ⊙ | ○ | X |

⊙: Very good
○: Good
Δ: Practically satisfactory
X: Image defect formed

EXAMPLE 137

Image forming members were prepared according to entirely the same procedure as in Example 133 except for varying the layer thickness of the amorphous layer (II) as shown in the Table below. The results of evaluations are as shown in the Table below.

TABLE 135

| Thickness of amorphous layer (II) (μ) | Results |
|---|---|
| 0.001 | Image defect liable to occur |
| 0.02 | No image defect during 20,000 repetitions |
| 0.05 | No image defect during 50,000 repetitions |
| 2 | Stable for 200,000 repetitions or more |

EXAMPLE 138

An image forming member was prepared according to the same procedure as in Example 133 except for changing the methods for forming the layers other than the amorphous layer (II) to those as shown in the Table below, and evaluation was conducted similarly to Example 133 to obtain good results.

TABLE 136

| Order of layer formation | Condition: Gases employed | Flow rate (SCCM) | Flow rate ratio | Discharge power (W/cm$^2$) | Layer thickness |
|---|---|---|---|---|---|
| 1 (Lower interface layer) | $SiH_4$/He = 1<br>$NH_3$ | $SiH_4$ = 100 | $SiH_4$:$NH_3$ = 3:1 | 0.18 | 500 Å |
| 2 (Rectifying layer) | $SiH_4$/He = 1<br>$PH_3$/He = $1 \times 10^{-2}$ | $SiH_4$ = 200 | $SiH_4$:$PH_3$ = $1:3 \times 10^{-3}$ | 0.18 | 6000 Å |
| 3 (Upper interface layer) | $SiH_4$/He = 1<br>$NH_3$ | $SiH_4$ = 100 | $SiH_4$:$NH_3$ = 3:1 | 0.18 | 500 Å |
| 4 (Amorphous layer (I)) | $SiH_4$/He = 1 | $SiH_4$ = 200 | | 0.18 | 15μ |

EXAMPLE 139

An image forming member was prepared according to the same procedure as in Example 133 except for changing the methods for forming the layers other than the amorphous layer (II) to those as shown in the Table below, and evaluation was conducted similarly to Example 133 to obtain good results.

TABLE 137

| Order of layer formation | Condition: Gases employed | Flow rate (SCCM) | Flow rate ratio | Discharge power (W/cm$^2$) | Layer thickness |
|---|---|---|---|---|---|
| 1 (Interface layer) | $SiH_4$/He = 1<br>$NH_3$ | $SiH_4$ = 100 | $SiH_4$:$NH_3$ = 1:1 | 0.18 | 400 Å |
| 2 (Rectifying layer) | $SiH_4$/He = 1<br>$SiF_4$/He = 1<br>$PH_3$/He = $1 \times 10^{-2}$ | $SiH_4$ = 100 | $SiH_4$:$SiF_4$:$PH_3$ = $1:1:5 \times 10^{-4}$ | 0.18 | 8000 Å |
| 3 (Amorphous layer) | $SiH_4$/He = 1<br>$SiF_4$/He = 1 | $SiH_4$ = 100 | $SiH_4$:$SiF_4$ = 1:1 | 0.18 | 15μ |

EXAMPLE 140

Image forming members were prepared according to the same conditions and procedures as in Examples 133, 134, 135, 138 and 139 except that the amorphous layer (I) was formed under the conditions shown in the Table below, and evaluated similarly to respective Examples to obtain good results.

TABLE 138

| Layer formed | Gases employed | Flow rate (SCCM) | Flow rate ratio | Discharge power (W/cm$^2$) | Layer thickness (μ) |
|---|---|---|---|---|---|
| Amorphous layer(I) | $SiH_4$/He = 1<br>$B_2H_6$/He = $1 \times 10^{-2}$ | $SiH_4$ = 200 | $SiH_4$:$B_2H_6$ = $1:2 \times 10^{-5}$ | 0.18 | 15 |

EXAMPLE 141

By means of the preparation device as shown in FIG. 6, layers were formed on an aluminum substrate under the following conditions.

The image forming member thus obtained was set in a charging-exposure-developing device, subjected to corona charging at ⊖5 KV for 0.2 sec., followed immediately by irradiation of a light image. As the light source, a tungsten lamp was employed and irradiation was effected at 1.0 lux.sec. using a transmissive type test chart.

Immediately thereafter, a positively charged developer (containing toner and carrier) was cascaded onto the surface of the image forming member, whereby a good toner image was obrained thereon.

The thus obtained toner image was once subjected to cleaning with a rubber blade and again the above image making-cleaning steps were repeated. No deterioration of image was observed even after a repetition number of 150,000 or more.

TABLE 139

| Order of layer formation | Condition: Gases employed | Flow rate (SCCM) | Flow rate ratio | Discharge power ($W/cm^2$) | Layer thickness |
|---|---|---|---|---|---|
| 1 (Interface layer) | $SiH_4/He = 1$ $NH_3$ | $SiH_4 = 100$ | $SiH_4:NH_3 = 3:1$ | 0.18 | 500 Å |
| 2 (Rectifying layer) | $SiH_4/He = 1$ $PH_3/He = 1 \times 10^{-2}$ | $SiH_4 = 200$ | $SiH_4:PH_3 = 1:5 \times 10^{-4}$ | 0.18 | 4000 Å |
| 3 (Amorphous layer(I)) | $SiH_4/He = 1$ | $SiH_4 = 200$ | | 0.18 | 15μ |
| 4 (Amorphous layer(II)) | $SiH_4/He = 0.5$ $SiF_4/He = 0.5$ $C_2H_4$ | $SiH_4 + SiF_4 = 150$ | $SiH_4:SiF_4:C_2H_4 = 1.5:1.5:7$ | 0.18 | 0.5μ |

Al substrate temperature: 250° C.

Discharging frequency: 13.56 MHz
Inner pressure in reaction chamber:
amorphous layer (I) 0.3 Torr
amorphous layer (II) 0.5 Torr

EXAMPLE 142

By means of the preparation device as shown in FIG. 6, layers were formed on an aluminum substrate under the following conditions.

Other conditions were the same as in Example 141.

The image forming member thus obtained was set in a charging-exposure-developing device, subjected to corona charigng at ⊖5 KV for 0.2 sec., followed immediately by irradiation of a light image. As the light source, a tungsten lamp was employed and irradiation was effected at 1.0 lux.sec. using a transmissive type test chart.

Immediately thereafter, a positively charged developed (containing toner and carrier) was cascaded onto the surface of the image forming member, whereby a good toner image was obtained thereon.

The thus obtained toner image was once subjected to cleaning with a rubber blade and again the above image making-cleaning steps were repeated. No deterioration of image was observed even after a repetition number of 100,000 or more.

TABLE 140

| Order of layer formation | Condition: Gases employed | Flow rate (SCCM) | Flow rate ratio | Discharge power ($W/cm^2$) | Layer thickness |
|---|---|---|---|---|---|
| 1 (Interface layer) | $SiH_4/He = 1$ $NH_3$ | $SiH_4 = 100$ | $SiH_4:NH_3 = 10:1$ | 0.18 | 2000 Å |
| 2 (Rectifying layer) | $SiH_4/He = 1$ $PH_3/He = 1 \times 10^{-2}$ | $SiH_4 = 200$ | $SiH_4:PH_3 = 1:1 \times 10^{-3}$ | 0.18 | 4000 Å |
| 3 (Amorphous layer(I)) | $SiH_4/He = 1$ | $SiH_4 = 200$ | | 0.18 | 15μ |
| 4 (Amorphous layer(II)) | $SiH_4/He = 0.5$ $SiF_4/He = 0.5$ $C_2H_4$ | $SiH_4 + SiF_4 = 15$ | $SiH_4:SiF_4:C_2H_4 = 0.3:0.1:9.6$ | 0.18 | 0.3μ |

EXAMPLE 143

By means of the preparation device as shown in FIG. 6, layers were formed on an aluminum substrate under the following conditions.

Other conditions were the same as in Example 141.

The image forming member thus obtained was set in a charging-exposure-developing device, subjected to corona charging at ⊖5 KV for 0.2 sec., followed immediately by irradiation of a light image. As the light source, a tungsten lamp was employed and irradiation was effected at 1.0 lux.sec. using a transmissive type test chart.

Immediately thereafter, a positively charged developer (containing toner and carrier) was cascaded onto the surface of the image forming member, whereby a good toner image was obtained thereon.

The thus obtained toner image was once subjected to cleaning with a rubber blade and again the above image making-cleaning steps were repeated. No deterioration of image was observed even after a repetition number of 150,000 or more.

TABLE 141

| Order of layer formation | Condition: Gases employed | Flow rate (SCCM) | Flow rate ratio | Discharge power ($W/cm^2$) | Layer thickness |
|---|---|---|---|---|---|
| 1 (Interface layer) | $SiH_4/He = 1$ $NH_3$ | $SiH_4 = 100$ | $SiH_4:NH_3 = 3:1$ | 0.18 | 500 Å |
| 2 | $SiH_4/He = 1$ | $SiH_4 = 200$ | $SiH_4:PH_3 =$ | 0.18 | 4000 Å |

TABLE 141-continued

| Order of layer formation | Condition: Gases employed | Flow rate (SCCM) | Flow rate ratio | Discharge power (W/cm$^2$) | Layer thickness |
|---|---|---|---|---|---|
| (Rectifying layer) | $PH_3/He = 1 \times 10^{-2}$ | | $1:3 \times 10^{-3}$ | | |
| 3 (Amorphous layer(I)) | $SiH_4/He = 1$ | $SiH_4 = 200$ | | 0.18 | 15μ |
| 4 (Amorphous layer(II)) | $SiH_4/He = 0.5$ $SiF_4/He = 0.5$ $C_2H_4$ | $SiH_4 + SiF_4 = 150$ | $SiH_4:SiF_4:C_2H_4 = 3:3:4$ | 0.18 | 1.5μ |

EXAMPLE 144

Image forming members were prepared according to entirely the same procedure as in Example 141 except for varying the content ratio of silicon atoms to carbon atoms in the second amorphous layer (II) by varying the flow rate ratio of $SiH_4$ gas:$SiF_4$ gas:$C_2H_4$ gas during formation of the amorphous layer (II). For the thus obtained image forming members, image evaluations were conducted after repeating 50,000 times the steps of image making, developing and cleaning as described in Example 141 to obtain the results as shown in Table 142.

TABLE 142

| | | | | | | | | |
|---|---|---|---|---|---|---|---|---|
| $SiH_4:SiF_4:C_2H_4$ (Flow rate ratio) | 5:4:1 | 3:3.5:3.5 | 2:2:6 | 1:1:8 | 0.6:0.4:9 | 0.2:0.3:9.5 | 0.2:0.15:9.65 | 0.1:0.1:9.8 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ◎ | ◎ | ◎ | ◎ | ○ | X |

◎: Very good
○: Good
Δ: Practically satisfactory
X: Image defect liable to occur

EXAMPLE 145

Image forming members were prepared according to entirely the same procedure as in Example 141 except for varying the layer thickness of the amorphous layer (II). By repeating the image making, developing and cleaning steps as described in Example 141, the following results were obtained.

TABLE 143

| Thickness of amorphous layer (II) (μ) | Results |
|---|---|
| 0.001 | Image defect liable to occur |
| 0.02 | No image defect during 20,000 repetitions |
| 0.05 | Stable for 50,000 repetitions or more |
| 1 | Stable for 200,000 repetitions or more |

EXAMPLE 146

An image forming member was prepared according to the same procedure as in Example 141 except for changing the methods for forming the layers other than the amorphous layer (II) to those as shown in the Table below, and evaluation was conducted similarly to Example 141 to obtain good results.

TABLE 144

| Order of layer formation | Condition: Gases employed | Flow rate (SCCM) | Flow rate ratio | Discharge power (W/cm$^2$) | Layer thickness |
|---|---|---|---|---|---|
| 1 (Lower interface layer) | $SiH_4/He = 1$ $NH_3$ | $SiH_4 = 100$ | $SiH_4:NH_3 = 3:1$ | 0.18 | 500 Å |
| 2 (Rectifying layer) | $SiH_4/He = 1$ $PH_3/He = 1 \times 10^{-2}$ | $SiH_4 = 200$ | $SiH_4:PH_3 = 1:3 \times 10^{-3}$ | 0.18 | 6000 Å |
| 3 (Upper interface layer) | $SiH_4/He = 1$ $NH_3$ | $SiH_4 = 100$ | $SiH_4:NH_3 = 3:1$ | 0.18 | 500 Å |
| 4 (Amorphous layer (I)) | $SiH_4/He = 1$ | $SiH_4 = 200$ | | 0.18 | 15μ |

EXAMPLE 147

An image forming member was prepared according to the same procedure as in Example 141 except for changing the methods for forming the layers other than the amorphous layer (II) to those as shown in the Table below, and evaluation was conducted similarly as in Example 141 to obtain good results.

TABLE 145

| Order of layer formation | Condition: Gases employed | Flow rate (SCCM) | Flow rate ratio | Discharge power (W/cm$^2$) | Layer thickness |
|---|---|---|---|---|---|
| 1 (Interface layer) | $SiH_4$/He = 1<br>$NH_3$ | $SiH_4$ = 100 | $SiH_4$:$NH_3$ = 1:1 | 0.18 | 400 Å |
| 2 (Rectifying layer) | $SiH_4$/He = 1<br>$SiF_4$/He = 1<br>$PH_3$/He = $1 \times 10^{-2}$ | $SiH_4$ = 100 | $SiH_4$:$SiF_4$:$PH_3$ = 1:1:1 $\times 10^{-3}$ | 0.18 | 1μ |
| 3 (Amorphous layer) | $SiH_4$/He = 1<br>$SiF_4$/He = 1 | $SiH_4$ = 100 | $SiH_4$:$SiF_4$ = 1:1 | 0.18 | 15μ |

EXAMPLE 148

An image forming member was prepared according to the same method as in Example 143 except that the amorphous layer (II) was formed according to the sputtering method under the conditions shown in the Table below, and evaluated similarly to Example 143 to obtain good results.

TABLE 146

| Layer formed | Gases employed | Flow rate (SCCM) | Target area ratio Si wafer:graphite | Discharge power (W/cm$^2$) | Layer thickness (μ) |
|---|---|---|---|---|---|
| Amorphous layer(II) | Ar<br>$SiF_4$/He = 0.5 | Ar = 200<br>$SiF_4$ = 100 | 2.5:7.5 | 0.3 | 1 |

EXAMPLE 149

Image forming members were prepared according to the same conditions and procedures as in Examples 141, 142, 143, 146 and 147 except that the amorphous layer (I) was formed under the conditions shown in the Table below, and evaluated similarly to respective Examples to obtain good results.

TABLE 147

| Layer formed | Gases employed | Flow rate (SCCM) | Flow rate ratio | Discharge power (W/cm$^2$) | Layer thickness (μ) |
|---|---|---|---|---|---|
| Amorphous layer(I) | $SiH_4$/He = 1<br>$B_2H_6$/He = $1 \times 10^{-2}$ | $SiH_4$ = 200 | $SiH_4$:$B_2H_6$ = 1:2 $\times 10^{-5}$ | 0.18 | 15 |

EXAMPLE 150

By means of the preparation device as shown in FIG. 6, layers were formed on an aluminum substrate under the following conditions.

The image forming member for electrophotography thus obtained was set in a copying device, subjected to corona charging at ⊖5 KV for 0.2 sec and irradiated with a light image. As the light source, a tungsten lamp was employed at 1.0 lux.sec. The latent image was developed with a positively charged developer (containing toner and carrier) and transferred onto a plain paper. The presence of any image defect (e.g. blank area at the black image portion) was checked, but no such defect was recognized at all and the image quality was found to be very good. The toner remaining on the image forming member without being transferred was subjected to cleaning by a rubber blade before turning to the next cycle of copying. Such a step was repeated for 100,000 times or more, whereby no image defect or peel-off of layers occurred.

TABLE 148

| Order of layer formation | Condition: Layer formation method | Gases employed | Flow rate (SCCM) | Flow rate ratio | Inner pressure in reaction chamber | Discharge power (W/cm$^2$) | Layer thickness |
|---|---|---|---|---|---|---|---|
| 1 (Interface layer) | Glow | $SiH_4$/He = 1<br>$SiF_4$/He = 1<br>$NH_3$ | $SiH_4$ = 100 | $SiH_4$:$SiF_4$:$NH_3$ = 1:1:1 | 0.3 | 0.18 | 300 Å |
| 2 (Rectifying layer) | Glow | $SiH_4$/He = 1<br>$PH_3$/He = $1 \times 10^{-2}$ | $SiH_4$ = 200 | $SiH_4$:$PH_3$ = 1:3 $\times 10^{-3}$ | 0.3 | 0.18 | 4000 Å |
| 3 (Amorphous layer) | Glow | $SiH_4$/He = 1 | $SiH_4$ = 200 | | 0.3 | 0.18 | 15μ |

Al substrate temperature: 250° C.
Discharging frequency: 13.56 MHz

EXAMPLE 151

Image forming members for electrophotography were prepared according to entirely the same procedure as in Example 150 except for varying the content of nitrogen atoms relative to silicon atoms in the interface layer by varying the area ratio of Si wafer to $Si_3N_4$ wafer of the targets for sputtering and evaluated similarly to Example 150 to obtain the results shown below.

TABLE 149

| Nitrogen atom content (atomic %) | $5 \times 10^{-4}$ | 1 | 10 | 20 | 23 | 27 | 50 |
|---|---|---|---|---|---|---|---|
| Evaluation | Readily peeled | Good | Good | Excellent | Excellent | Good | Image defect slightly formed |

EXAMPLE 152

Image forming members for electrophotography were prepared according to entirely the same procedure as in Example 150 except for varying the layer thickness of the interface layer and evaluated similarly to Example 150 to obtain the results shown below.

TABLE 150

| Layer thickness | 10 Å | 30 Å | 400 Å | 2μ | 5μ |
|---|---|---|---|---|---|
| Evaluation | readily peeled | Good | Excellent | Good | Image defect slightly formed |

EXAMPLE 153

Image forming members for electrophotography were prepared according to entirely the same procedure as in Example 150 except for varying the layer thickness of the rectifying layer and the content of boron atoms as follows. All of the results were good.

TABLE 151

| Sample No. | 15301 | 15302 | 15303 | 15304 | 15305 | 15306 | 15307 |
|---|---|---|---|---|---|---|---|
| Boron atom content (atomic ppm) | $1 \times 10^5$ | 50000 | 3500 | 1500 | 800 | 500 | 100 |
| Thickness (μ) | 0.3 | 0.4 | 0.8 | 0.5 | 0.9 | 1.5 | 5 |

EXAMPLE 154

By means of the preparation device as shown in FIG. 6, layers were formed on an aluminum substrate under the following conditions.

TABLE 152

| Order of layer formation | Layer formation method | Gases employed | Flow rate (SCCM) | Flow rate ratio | Inner pressure in reaction chamber | Discharge power (W/cm²) | Layer thickness |
|---|---|---|---|---|---|---|---|
| 1 (Interface layer) | Glow | $SiH_4$/He = 1<br>$SiF_4$/He = 1<br>$NH_3$ | $SiH_4$ = 100 | $SiH_4$:$SiF_4$:$NH_3$ = 1:2:1 | 0.3 | 0.18 | 500 Å |
| 2 (Rectifying layer) | Glow | $SiH_4$/He = 1<br>$PH_3$/He = $1 \times 10^{-2}$ | $SiH_4$ = 200 | $SiH_4$:$PH_3$ = $1:3 \times 10^{-3}$ | 0.3 | 0.18 | 6000 Å |
| 3 (Upper interface layer) | Glow | $SiH_4$/He = 1<br>$NH_3$ | $SiH_4$ = 100 | $SiH_4$:$NH_3$ 3:1 | 0.3 | 0.18 | 500 Å |
| 4 (Amorphous layer) | Glow | $SiH_4$/He = 1 | $SiH_4$ = 200 | | 0.3 | 0.18 | 15μ |

The image forming member for electrophotography thus obtained was evaluated similarly to Example 150 to obtain very good results.

EXAMPLE 155

Layer forming operations were conducted similarly to Example 150 by means of the device as shown in FIG. 6 except for using the following conditions.

TABLE 153

| Order of layer formation | Gases employed | Flow rate (SCCM) | Flow rate ratio | Discharge power (W/cm²) | Layer thickness |
|---|---|---|---|---|---|
| 1 (Interface layer) | $SiH_4$/He = 1<br>$SiF_4$/He = 1<br>$NH_3$ | $SiH_4$ = 100 | $SiH_4$:$SiF_4$:$NH_3$ = 2:1:1 | 0.18 | 400 Å |
| 2 (Rectifying layer) | $SiH_4$/He = 1<br>$SiF_4$/He = 1<br>$PH_3$/He = $1 \times 10^{-2}$ | $SiH_4$ = 100 | $SiH_4$:$SiF_4$:$PH_3$ = $1:1:5 \times 10^{-4}$ | 0.18 | 8000 Å |
| 3 (Amorphous layer) | $SiH_4$/He = 1<br>$SiF_4$/He = 1 | $SiH_4$ = 100 | $SiH_4$:$SiF_4$ = 1:1 | 0.18 | 15μ |

The image forming member for electrophotography thus obtained was evaluated similarly to Example 150 to obtain very good results.

EXAMPLE 156

Image forming members were prepared according to the same conditions and procedures as in Examples 150, 154 and 155 except that the amorphous layer (I) was formed under the conditions shown in the Table below, and evaluated similarly to respective Examples to obtain good results.

TABLE 154

| Layer formed | Gases employed | Flow rate (SCCM) | Flow rate ratio | Discharge power (W/cm²) | Layer thickness (μ) |
|---|---|---|---|---|---|
| Amorphous layer(I) | $SiH_4/He = 1$<br>$B_2H_6/He = 1 \times 10^{-2}$ | $SiH_4 = 200$ | $SiH_4:B_2H_6 =$<br>$1:2 \times 10^{-5}$ | 0.18 | 15 |

EXAMPLE 157

By means of the preparation device as shown in FIG. 6, layers were formed on an aluminum substrate under the following conditions.

The image forming member thus obtained was set in a charging-exposure-developing device, subjected to corona charging at ⊖5 KV for 0.2 sec., followed immediately by irradiation of a light image. As the light source, a tungsten lamp was employed and irradiation was effected at 1.0 lux.sec. using a transmissive type test chart.

Immediately thereafter, a positively charged developer (containing toner and carrier) was cascaded onto the surface of the image forming member, whereby a good toner image was obtained thereon.

The thus obtained toner image was once subjected to cleaning with a rubber blade and again the above image making-cleaning steps were repeated. No deterioration of image was observed even after a repetition number of 150,000 or more.

TABLE 155

| Order of layer formation | Condition: Gases employed | Flow rate (SCCM) | Flow rate ratio | Discharge power (W/cm²) | Layer thickness |
|---|---|---|---|---|---|
| 1 (Interface layer) | $SiH_4/He = 1$<br>$SiF_4/He = 1$<br>$NH_3$ | $SiH_4 = 100$ | Flow rate ratio<br>$SiH_4:SiF_4:NH_3 =$<br>5:5:1 | 0.18 | 2000 Å |
| 2 (Rectifying layer) | $SiH_4/He = 1$<br>$PH_3/He = 1 \times 10^{-2}$ | $SiH_4 = 200$ | Flow rate ratio<br>$SiH_4:PH_3 =$<br>$1:1 \times 10^{-3}$ | 0.18 | 4000 Å |
| 3 (Amorphous layer(I)) | $SiH_4/He = 1$ | $SiH_4 = 200$ | | 0.18 | 15μ |
| 4 (Amorphous layer(II)) | Ar | 200 | Area ratio<br>Si wafer:graphite =<br>0.5:9.5 | 0.3 | 0.3μ |

EXAMPLE 158

By means of the preparation device as shown in FIG. 6, layers were formed on an aluminum substrate under the following conditions.

Other conditions were the same as in Example 157.

The image forming member thus obtained was set in a charging-exposure-developing device, subjected to corona charging at ⊖5 KV for 0.2 sec., followed immediately by irradiation of a light image. As the light source, a tungsten lamp was employed and irradiation was effected at 1.0 lux.sec. using a transmissive type test chart.

Immediately thereafter, a positively charged developer (containing toner and carrier) was cascaded onto the surface of the image forming member, whereby a good toner image was obtained thereon.

The thus obtained toner image was once subjected to cleaning with a rubber blade and again the above image making-cleaning steps were repeated. No deterioration of image was observed even after a repetition number of 100,000 or more.

TABLE 156

| Order of layer formation | Condition: Gases employed | Flow rate (SCCM) | Flow rate ratio | Discharge power (W/cm²) | Layer thickness |
|---|---|---|---|---|---|
| 1 (Interface layer) | $SiH_4/He = 1$<br>$SiF_4/He = 1$<br>$NH_3$ | $SiH_4 = 100$ | Flow rate ratio<br>$SiH_4:SiF_4:NH_3 =$<br>1:1:1 | 0.18 | 500 Å |
| 2 (Rectifying layer) | $SiH_4/He = 1$<br>$PH_3/He = 1 \times 10^{-2}$ | $SiH_4 = 200$ | Flow rate ratio<br>$SiH_4:PH_3 =$<br>$1:3 \times 10^{-3}$ | 0.18 | 4000 Å |
| 3 (Amorphous layer(I)) | $SiH_4/He = 1$ | $SiH_4 = 200$ | | 0.18 | 15μ |
| 4 (Amorphous layer(II)) | Ar | 200 | Area ratio<br>Si wafer:graphite =<br>6:4 | 0.3 | 1.0μ |

EXAMPLE 159

By means of the preparation device as shown in FIG. 6, layers were formed on an aluminum substrate under the following conditions.

Other conditions were the same as in Example 157.

The image forming member thus obtained was set in a charging-exposure-developing device, subjected to corona charging at ⊖5 KV for 0.2 sec., followed immediately by irradiation of a light image. As the light source, a tungsten lamp was employed and irradiation was effected at 1.0 lux.sec. using a transmissive type test chart.

Immediately thereafter, a positively charged developer (containing toner and carrier) was cascaded onto the surface of the image forming member, whereby a good toner image with a very high density was obtained thereon.

The thus obtained toner image was once subjected to cleaning with a rubber blade and again the above image making-cleaning steps were repeated. No deterioration of image was observed even after a repetition number of 150,000 or more.

TABLE 157

| | | | | | | | |
|---|---|---|---|---|---|---|---|
| Si:C Target (Area ratio) | 9:1 | 6.5:3.5 | 4:6 | 2:8 | 1:9 | 0.5:9.5 | 0.2:9.8 |
| Si:C (Content ratio) | 9.7:0.3 | 8.8:1.2 | 7.3:2.7 | 4.8:5.2 | 3:7 | 2:8 | 0.8:9.2 |
| Image quality evaluation | Δ | ○ | ◎ | ◎ | ◎ | ○ | X |

◎: Very good
○: Good
Δ: Practically satisfactory
X: Image defect formed

EXAMPLE 160

An image forming member was prepared according to entirely the same procedure as in Example 157 except for changing the content ratio of silicon atoms to carbon atoms in the second amorphous layer (II) by changing the area ratio of silicon wafer to graphite during formation of the amorphous layer (II). For the thus obtained image forming members, image evaluations were conducted after repeating 50,000 times the steps of image making, developing and cleaning as described in Example 157 to obtain the results as shown in Table 158.

TABLE 158

| | | | | | | | |
|---|---|---|---|---|---|---|---|
| Si:C Target (Area ratio) | 9:1 | 6.5:3.5 | 4:6 | 2:8 | 1:9 | 0.5:9.5 | 0.2:9.8 |
| Si:C | 9.7: | 8.8:1.2 | 7.3: | 4.8:5.2 | 3:7 | 2:8 | 0.8:9.2 |

TABLE 158-continued

| | | | | | | | |
|---|---|---|---|---|---|---|---|
| (Content ratio) | 0.3 | | 2.7 | | | | |
| Image quality evaluation | Δ | ○ | ◎ | ◎ | ◎ | ○ | X |

◎: Very good
○: Good
Δ: Practically satisfactory
X: Image defect formed

EXAMPLE 161

Image forming members were prepared according to entirely the same procedure as in Example 157 except for varying the film thickness of the amorphous layer (II). By repeating the image making, developing and cleaning steps as described in Example 157, the following results were obtained.

TABLE 159

| Thickness of amorphous layer (II) (μ) | Results |
|---|---|
| 0.001 | Image defect liable to occur |
| 0.02 | No image defect during 20,000 repetitions |
| 0.05 | Stable for 50,000 repetitions or more |
| 1 | Stable for 200,000 repetitions or more |

EXAMPLE 162

An image forming member was prepared according to the same procedure as in Example 157 except for changing the methods for forming the layers other than the amorphous layer (II) to those as shown in the Table below, and evaluation was conducted similarly to Example 157 to obtain good results.

TABLE 160

| Order of layer formation | Condition: Gases employed | Flow rate (SCCM) | Flow rate ratio | Discharge power (W/cm²) | Layer thickness |
|---|---|---|---|---|---|
| 1 (Lower interface layer) | $SiH_4/He = 1$<br>$SiF_4/He = 1$<br>$NH_3$ | $SiH_4 = 100$ | $SiH_4:SiF_4:NH_3 = 1:2:1$ | 0.18 | 500 Å |
| 2 (Rectifying layer) | $SiH_4/He = 1$<br>$PH_3/He = 1 \times 10^{-2}$ | $SiH_4 = 200$ | $SiH_4:PH_3 = 1:3 \times 10^{-3}$ | 0.18 | 6000 Å |
| 3 (Upper interface layer) | $SiH_4/He = 1$<br>$SiF_4/He = 1$<br>$NH_3$ | $SiH_4 = 100$ | $SiH_4:SiF_4:NH_3 = 1:2:1$ | 0.18 | 500 Å |
| 4 (Amorphous later (I)) | $SiH_4/He = 1$ | $SiH_4 = 200$ | | 0.18 | 15μ |

EXAMPLE 163

An image forming member was prepared according to the same procedure as in Example 157 except for changing the methods for forming the layers other than the amorphous layer (II) to those as shown in the Table below, and evaluation was conducted similarly to Example 157 to obtain good results.

TABLE 161

| Order of layer formation | Condition: Gases employed | Flow rate (SCCM) | Flow rate ratio | Discharge power (W/cm²) | Layer thickness |
|---|---|---|---|---|---|
| 1 (Interface layer) | $SiH_4/He = 1$<br>$SiF_4/He = 1$<br>$NH_3$ | $SiH_4 = 100$ | $SiH_4:SiF_4NH_3 = 2:1:1$ | 0.18 | 400 Å |

TABLE 161-continued

| Order of layer formation | Condition: Gases employed | Flow rate (SCCM) | Flow rate ratio | Discharge power ($W/cm^2$) | Layer thickness |
|---|---|---|---|---|---|
| 2 (Rectifying layer) | $SiH_4/He = 1$ $SiF_4/He = 1$ $PH_3/He = 1 \times 10^{-2}$ | $SiH_4 = 100$ | $SiH_4:SiF_4:PH_3 = 1:1:5 \times 10^{-4}$ | 0.18 | 8000 Å |
| 3 (Amorphous layer (I)) | $SiH_4/He = 1$ $SiF_4/He = 1$ | $SiH_4 = 100$ | $SiH_4:SiF_4 = 1:1$ | 0.18 | 15μ |

EXAMPLE 164

Image forming members were prepared according to the same conditions and procedures as in Examples 157, 158, 159, 162 and 163 except that the amorphous layer (I) was formed under the conditions shown in the Table below, and evaluated similarly to respective Examples to obtain good results.

TABLE 162

| Layer formed | Gases employed | Flow rate (SCCM) | Flow rate ratio | Discharge power ($W/cm^2$) | Layer thickness (μ) |
|---|---|---|---|---|---|
| Amorphous layer(I) | $SiH_4/He = 1$ $B_2H_6/He = 1 \times 10^{-2}$ | $SiH_4 = 200$ | $SiH_4:B_2H_6 = 1:2 \times 10^{-5}$ | 0.18 | 15 |

EXAMPLE 165

By means of the preparation device as shown in FIG. 6, layers were formed on an aluminum substrate under the following conditions.

The image forming member for electrophotography thus obtained was set in a copying device, subjected to corona charging at ⊖5 KV for 0.2 sec. and irradiated with a light image. As the light source, a tungsten lamp was employed at 1.0 lux.sec. The latent image was developed with a positively charged developer (containing toner and carrier) and transferred onto a plain paper. The transferred image was very good. The toner remaining on the image forming member for electrophotography without being transferred was subjected to cleaning by a rubber blade before turning to the next cycle of copying. Such a step was repeated for 150,000 times or more, whereby no deterioration of image was observed.

TABLE 163

| Order of layer formation | Condition: Gases employed | Flow rate (SCCM) | Flow rate ratio | Discharge power ($W/cm^2$) | Layer thickness |
|---|---|---|---|---|---|
| 1 (Interface layer) | $SiH_4/He = 1$ $SiF_4/He = 1$ $NH_3$ | $SiH_4 = 100$ | $SiH_4:SiF_4:NH_3 = 1:1:1$ | 0.18 | 500 Å |
| 2 (Rectifying layer) | $SiH_4/He = 1$ $PH_3/He = 1 \times 10^{-2}$ | $SiH_4 = 200$ | $SiH_4:PH_3 = 1:5 \times 10^{-4}$ | 0.18 | 4000 Å |
| 3 (Amorphous layer(I)) | $SiH_4/He = 1$ | $SiH_4 = 200$ | | 0.18 | 15μ |
| 4 (Amorphous layer(II)) | $SiH_4/He = 0.5$ $C_2H_4$ | $SiH_4 = 100$ | $SiH_4:C_2H_4 = 3:7$ | 0.18 | 0.5μ |

Al substrate temperature: 250° C.

Discharging frequency: 13.56 MHz

Inner pressure in reaction chamber:

| | |
|---|---|
| interface layer | 0.2 Torr |
| rectifying layer, amorphous layer (I) | 0.3 Torr |
| amorphous layer (II) | 0.2 Torr |

EXAMPLE 166

By means of the preparation device as shown in FIG. 6, layers were formed on an aluminum substrate under the following conditions. Other conditions were the same as in Example 165.

The image forming member for electrophotography thus obtained was set in a copying device, subjected to corona charging at ⊖5 KV for 0.2 sec. and irradiated with a light image. As the light source, a tungsten lamp was employed at 1.0 lux.sec. The latent image was developed with a positively charged developer (containing toner and carrier) and transferred onto a plain paper. The transferred image was very good. The toner remaining on the image forming member for electrophotography without being transferred was subjected to cleaning by a rubber blade before turning to the next cycle of copying. Such step was repeated for 100,000 times or more, whereby no deterioration of image was observed.

TABLE 164

| Order of layer formation | Condition: Gases employed | Flow rate (SCCM) | Flow rate ratio | Discharge power (W/cm$^2$) | Layer thickness |
|---|---|---|---|---|---|
| 1 (Interface layer) | $SiH_4$/He = 1<br>$SiF_4$/He = 1<br>$NH_3$ | $SiH_4$ = 100 | $SiH_4$:$SiF_4$:$NH_3$ = 5:5:1 | 0.18 | 2000 Å |
| 2 (Rectifying layer) | $SiH_4$/He = 1<br>$PH_3$/He = $1 \times 10^{-2}$ | $SiH_4$ = 200 | $SiH_4$:$PH_3$ = $1:1 \times 10^{-2}$ | 0.18 | 4000 Å |
| 3 (Amorphous layer (I)) | $SiH_4$/He = 1 | $SiH_4$ = 200 | | 0.18 | 15μ |
| 4 (Amorphous layer (II)) | $SiH_4$/He = 1<br>$C_2H_4$ | $SiH_4$ = 15 | $SiH_4$:$C_2H_4$ = 0.4:9.6 | 0.18 | 0.3μ |

EXAMPLE 167

By means of the preparation device as shown in FIG. 6, layers were formed on an aluminum substrate under the following conditions. Other conditions were the same as in Example 165.

The image forming member for electrophotography thus obtained was set in a copying device, subjected to corona charging at ⊖5 KV for 0.2 sec. and irradiated with a light image. As the light source, a tungsten lamp was employed at 1.0 lux.sec. The latent image was developed with a positively charged developer (containing toner and carrier) and transferred onto a plain paper. The transferred image was very good with very high density. The toner remaining on the image forming member for electrophotography without being transferred was subjected to cleaning by a rubber blade before turning to the next cycle of copying. Such a step was repeated for 150,000 times or more, whereby no deterioration of image was observed.

TABLE 165

| Order of layer formation | Condition: Gases employed | Flow rate (SCCM) | Flow rate ratio | Discharge power (W/cm$^2$) | Layer thickness |
|---|---|---|---|---|---|
| 1 (Interface layer) | $SiH_4$/He = 1<br>$SiF_4$/He = 1<br>$NH_3$ | $SiH_4$ = 100 | $SiH_4$:$SiF_4$:$NH_3$ = 1:1:1 | 0.18 | 500 Å |
| 2 (Rectifying layer) | $SiH_4$/He = 1<br>$PH_3$/He = $1 \times 10^{-2}$ | $SiH_4$ = 200 | $SiH_4$:$PH_3$ = $1:3 \times 10^{-3}$ | 0.18 | 4000 Å |
| 3 (Amorphous layer (I)) | $SiH_4$/He = 1 | $SiH_4$ = 200 | | 0.18 | 15μ |
| 4 (Amorphous layer (II)) | $SiH_4$/He = 0.5<br>$C_2H_4$ | $SiH_4$ = 100 | $SiH_4$:$C_2H_4$ = 5:5 | 0.18 | 1.5μ |

EXAMPLE 168

Image forming members were prepared according to entirely the same procedure as in Example 165 except for varying the content ratio of silicon atoms to carbon atoms in the second amorphous layer (II) by varying the flow rate ratio of $SiH_4$ gas:$C_2H_4$ gas during formation of the amorphous layer (II). For the thus obtained image forming members, image evaluations were conducted after repeating 50,000 times the steps of image making, developing and cleaning as described in Example 165 to obtain the results as shown in Table 166.

TABLE 166

| $SiH_4$:$C_2H_4$ (Flow rate ratio) | 9:1 | 6:4 | 4:6 | 2:8 | 1:9 | 0.5:9.5 | 0.35:9.65 | 0.2:9.8 |
|---|---|---|---|---|---|---|---|---|
| Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ◎ | ◎ | ◎ | ◎ | ○ | X |

◎: Very good
○: Good
Δ: Practically satisfactory
X: Image defect formed

EXAMPLE 169

Image forming members were prepared according to entirely the same procedure as in Example 165 except for varying the layer thickness of the amorphous layer (II) as shown in the Table below. The results of evaluations are as shown in the Table below.

TABLE 167

| Thickness of amorphous layer (II) (μ) | Results |
|---|---|
| 0.001 | Image defect liable to occur |
| 0.02 | No image defect during 20,000 repetitions |
| 0.05 | No image defect during 50,000 repetitions |
| 2 | Stable for 200,000 repetitions or more |

EXAMPLE 170

An image forming member was prepared according to the same procedure as in Example 165 except for changing the methods for forming the layers other than the amorphous layer (II) to those as shown in the Table below, the evaluation was conducted similarly as in Example 165 to obtain good results.

TABLE 168

| Order of layer formation | Condition: Gases employed | Flow rate (SCCM) | Flow rate ratio | Discharge power (W/cm$^2$) | Layer thickness |
|---|---|---|---|---|---|
| 1 (Interface layer) | $SiH_4$/He = 1<br>$SiF_4$/He = 1<br>$NH_3$ | $SiH_4$ = 100 | $SiH_4$:$SiF_4$:$NH_3$ = 2:1:1 | 0.18 | 400 Å |
| 2 (Rectifying layer) | $SiH_4$/He = 1<br>$SiF_4$/He = 1<br>$PH_3$/He = $1 \times 10^{-2}$ | $SiH_4$ = 100 | $SiH_4$:$SiF_4$:$PH_3$ = 1:1:5 $\times 10^{-4}$ | 0.18 | 8000 Å |
| 3 (Amorphous layer (I)) | $SiH_4$/He = 1<br>$SiF_4$/He = 1 | $SiH_4$ = 100 | $SiH_4$:$SiF_4$ = 1:1 | 0.18 | 15μ |

EXAMPLE 171

An image forming member was prepared according to the same procedure as in Example 165 except for changing the methods for forming the layers other than the amorphous layer (II) to those as shown in the Table below, and evaluation was conducted similarly as in Example 165 to obtain good results.

TABLE 169

| Order of layer formation | Condition: Gases employed | Flow rate (SCCM) | Flow rate ratio | Discharge power (W/cm$^2$) | Layer thickness |
|---|---|---|---|---|---|
| 1 (Lower interface layer) | $SiH_4$/He = 1<br>$SiF_4$/He = 1<br>$NH_3$ | $SiH_4$ = 100 | $SiH_4$:$SiF_4$:$NH_3$ = 1:2:1 | 0.3 | 500 Å |
| 2 (Rectifying layer) | $SiH_4$/He = 1<br>$PH_3$/He = $1 \times 10^{-2}$ | $SiH_4$ = 200 | $SiH_4$:$PH_3$ = 1:3 $\times 10^{-3}$ | 0.18 | 6000 Å |
| 3 (Upper interface layer) | $SiH_4$/He = 1<br>$SiF_4$/He = 1<br>$NH_3$ | $SiH_4$ = 100 | $SiH_4$:$SiF_4$:$NH_3$ = 1:2:1 | 0.18 | 500 Å |
| 4 (Amorphous layer (I)) | $SiH_4$/He = 1 | $SiH_4$ = 200 | | 0.18 | 15μ |

EXAMPLE 172

Image forming members were prepared according to the same conditions and procedures as in Examples 165, 166, 167, 170 and 171 except that the amorphous layer (I) was formed under the conditions shown in the Table below, and evaluated similarly to respective Examples to obtain good results.

TABLE 170

| Layer formed | Gases employed | Flow rate (SCCM) | Flow rate ratio | Discharge power (W/cm$^2$) | Layer thickness (μ) |
|---|---|---|---|---|---|
| Amorphous layer (I) | $SiH_4$/He = 1<br>$B_2H_6$/He = $1 \times 10^{-2}$ | $SiH_4$ = 200 | $SiH_4$:$B_2H_6$ = 1:2 $\times 10^{-5}$ | 0.18 | 15 |

EXAMPLE 173

By means of the preparation device as shown in FIG. 6, layers were formed on an aluminum substrate under the following conditions.

The image forming member thus obtained was set in a charging-exposure-developing device, subjected to corona charging at ⊖5 KV for 0.2 sec., followed immediately by irradiation of a light image. As the light source, a tungsten lamp was employed and irradiation was effected at 1.0 lux.sec. using a transmissive type test chart.

Immediately thereafter, a positively charged developer (containing toner and carrer) was cascaded onto the surface of the image forming member, whereby a good toner image was obtained thereon.

The thus obtained toner image was once subjected to cleaning with a rubber blade and again the above image making-cleaning steps were repeated. No deterioration of image was observed even after a repetition number of 150,000 or more.

TABLE 171

| Order of layer formation | Condition: Gases employed | Flow rate (SCCM) | Flow rate ratio | Discharge power (W/cm$^2$) | Layer thickness |
|---|---|---|---|---|---|
| 1 (Interface layer) | $SiH_4$/He = 1<br>$SiF_4$/He = 1<br>$NH_3$ | $SiH_4$ = 100 | $SiH_4$:$SiF_4$:$NH_3$ = 1:1:1 | 0.18 | 500 Å |

TABLE 171-continued

| Order of layer formation | Condition: Gases employed | Flow rate (SCCM) | Flow rate ratio | Discharge power ($W/cm^2$) | Layer thickness |
|---|---|---|---|---|---|
| 2 (Rectifying layer) | $SiH_4/He = 1$ $PH_3/He = 1 \times 10^{-2}$ | $SiH_4 = 200$ | $SiH_4:PH_3 = 1:5 \times 10^{-4}$ | 0.18 | 4000 Å |
| 3 (Amorphous layer (I)) | $SiH_4/He = 1$ | $SiH_4 = 200$ | | 0.18 | 15μ |
| 4 (Amorphous layer (II)) | $SiH_4/He = 0.5$ $SiF_4/He = 0.5$ $C_2H_4$ | $SiH_4 + SiF_4 = 150$ | $SiH_4:SiF_4:C_2H_4 = 1.5:1.5:7$ | 0.18 | 0.5μ |

Al substrate temperature: 250° C.
Discharging frequency: 13.56 MHz
Inner pressure in reaction chamber:

| | |
|---|---|
| interface layer | 0.2 Torr |
| rectifying layer<br>amorphous layer (I) | 0.3 Torr |
| amorphous layer (II) | 0.5 Torr |

EXAMPLE 174

By means of the preparation device as shown in FIG. 6, layers were formed on an aluminum substrate under the following conditions.

Other conditions were the same as in Example 173.

The image forming member thus obtained was set in a charging-exposure-developing device, subjected to corona charging at ⊖5 KV for 0.2 sec., followed immediately by irradiation of a light image. As the light source, a tungsten lamp was employed and irradiation was effected at 1.0 lux.sec. using a transmissive type test chart.

Immediately thereafter, a positively charged developer (containing toner and carrier) was cascaded onto the surface of the image forming member, whereby a good toner image was obtained thereon.

The thus obtained toner image was once subjected to cleaning with a rubber blade and again the above image making-cleaning steps were repeated. No deterioration of image was observed even after a repetition number of 100,000 or more.

TABLE 172

| Order of layer formation | Condition: Gases employed | Flow rate (SCCM) | Flow rate ratio | Discharge power ($W/cm^2$) | Layer thickness |
|---|---|---|---|---|---|
| 1 (Interface layer) | $SiH_4/He = 1$ $SiF_4/He = 1$ $NH_3$ | $SiH_4 = 100$ | $SiH_4:SiF_4:NH_3 = 5:5:1$ | 0.18 | 2000 Å |
| 2 (Rectifying layer) | $SiH_4/He = 1$ $PH_3/He = 1 \times 10^{-2}$ | $SiH_4 = 200$ | $SiH_4:PH_3 = 1:1 \times 10^{-3}$ | 0.18 | 4000 Å |
| 3 (Amorphous layer (I)) | $SiH_4/He = 1$ | $SiH_4 = 200$ | | 0.18 | 15μ |
| 4 (Amorphous layer (II)) | $SiH_4/He = 0.5$ $SiF_4/He = 0.5$ $C_2H_4$ | $SiH_4 + SiF_4 = 15$ | $SiH_4:SiF_4:C_2H_4 = 0.3:0.1:9.6$ | 0.18 | 0.3μ |

EXAMPLE 175

By means of the preparation device as shown in FIG. 6, layers were formed on an aluminum substrate under the following conditions.

Other conditions were the same as in Example 173.

The image forming member thus obtained was set in a charging-exposure-developing device, subjected to corona charging at ⊖5 KV for 0.2 sec., followed immediately by irradiation of a light image. As the light source, a tungsten lamp was employed and irradiation was effected at 1.0 lux.sec. using a transmissive type test chart.

Immediately thereafter, a positively charged developer (containing toner and carrier) was cascaded onto the surface of the image forming member, whereby a good toner with a very high density image was obtained thereon.

The thus obtainedtoner image was once subjected to cleaning with a rubber blade and again the above image making-cleaning steps were repeated. No deterioration of image was observed even after a repetition number of 150,000 or more.

TABLE 173

| Order of layer formation | Condition: Gases employed | Flow rate (SCCM) | Flow rate ratio | Discharge power ($W/cm^2$) | Layer thickness |
|---|---|---|---|---|---|
| 1 (Interface layer) | $SiH_4/He = 1$ $SiF_4/He = 1$ $NH_3$ | $SiH_4 = 100$ | $SiH_4:SiF_4:NH_3 = 1:1:1$ | 0.18 | 500 Å |
| 2 | $SiH_4/He = 1$ | $SiH_4 = 200$ | $SiH_4:PH_3 =$ | 0.18 | 4000 Å |

TABLE 173-continued

| Order of layer formation | Condition: Gases employed | Flow rate (SCCM) | Flow rate ratio | Discharge power (W/cm$^2$) | Layer thickness |
|---|---|---|---|---|---|
| (Rectifying layer) | $PH_3/He = 1 \times 10^{-2}$ | | $1:3 \times 10^{-3}$ | | |
| 3 (Amorphous layer (I)) | $SiH_4/He = 1$ | $SiH_4 = 200$ | | 0.18 | 15μ |
| 4 (Amorphous layer (II)) | $SiH_4/He = 0.5$ $SiF_4/He = 0.5$ $C_2H_4$ | $SiH_4 + SiF_4 = 150$ | $SiH_4:SiF_4:C_2H_4 = 3:3:4$ | 0.18 | 0.5μ |

EXAMPLE 176

Image forming members were prepared according to entirely the same procedure as in Example 173 except for varying the content ratio of silicon atoms to carbon atoms in the second amorphous layer (II) by varying the flow rate ratio of $SiH_4$ gas:$SiF_4$ gas:$C_2H_4$ gas during formation of the amorphous layer (II). For the thus obtained image forming members, image evaluations were conducted after repeating for 50,000 times the steps of image making, developing and cleaning as described in Example 173 to obtain the results as shown in Table 174.

TABLE 174

| $SiH_4:SiF_4:C_2H_4$ (Flow rate ratio) | 5:4:1 | 3:3.5:3.5 | 2:2:6 | 1:1:8 | 0.6:0.4:9 | 0.2:0.3.9.5 | 0.2:0.15:9.65 | 0.1:0.1:9.8 |
|---|---|---|---|---|---|---|---|---|
| Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ⊙ | ⊙ | ⊙ | ⊙ | ○ | X |

⊙: Very good
○: Good
Δ: Practically satisfactory
X: Image defect formed

EXAMPLE 177

Image forming members were prepared according to entirely the same procedure as in Example 173 except for varying the layer thickness of the amorphous layer (II). By repeating the image making, developing and cleaning steps as described in Example 173, the following results were obtained.

TABLE 175

| Thickness of amorphous layer (II) (μ) | Results |
|---|---|
| 0.001 | Image defect liable to occur |
| 0.02 | No image defect during 20,000 repetititons |
| 0.05 | Stable for 50,000 repetitions or more |
| 1 | Stable for 200,000 repetitions or more |

EXAMPLE 178

An image forming member was prepared according to the same procedure as in Example 173 except for changing the methods for forming the layers other than the amorphous layer (II) to those as shown in the Table below, and evaluation was conducted similarly to Example 173 to obtain good results.

TABLE 176

| Order of layer formation | Condition: Gases employed | Flow rate (SCCM) | Flow rate ratio | Discharge power (W/cm$^2$) | Layer thickness |
|---|---|---|---|---|---|
| 1 (Lower interface layer) | $SiH_4/He = 1$ $SiF_4/He = 1$ $NH_3$ | $SiH_4 = 100$ | $SiH_4:SiF_4:NH_3 = 1:2:1$ | 0.18 | 500 Å |
| 2 (Rectifying layer) | $SiH_4/He = 1$ $PH_3/He = 1 \times 10^{-2}$ | $SiH_4 = 200$ | $SiH_4:PH_3 = 1:3 \times 10^{-3}$ | 0.18 | 6000 Å |
| 3 (Upper interface layer) | $SiH_4/He = 1$ $SiF_4/He = 1$ $NH_3$ | $SiH_4 = 100$ | $SiH_4:SiF_4:NH_3 = 1:2:1$ | 0.3 | 500 Å |
| 4 (Amorphous layer (I)) | $SiH_4/He = 1$ | $SiH_4 = 200$ | | 0.18 | 15μ |

EXAMPLE 179

An image forming member was prepared according to the same procedure as in Example 173 except for changing the methods for forming the layers other than the amorphous layer (II) to those as shown in the Table below, and evaluation was conducted similarly to Example 173 to obtain good results.

TABLE 177

| Order of layer formation | Condition: Gases employed | Flow rate (SCCM) | Flow rate ratio | Discharge power (W/cm$^2$) | Layer thickness |
|---|---|---|---|---|---|
| 1 (Interface layer) | $SiH_4$/He = 1<br>$SiF_4$/He = 1<br>$NH_3$ | $SiH_4$ = 100 | $SiH_4$:$SiF_4$:$NH_3$ = 2:1:1 | 0.18 | 400 Å |
| 2 (Rectifying layer) | $SiH_4$/He = 1<br>$SiF_4$/He = 1<br>$PH_3$/He = $1 \times 10^{-2}$ | $SiH_4$ = 100 | $SiH_4$:$SiF_4$:$PH_3$ = 1:1:5 $\times 10^{-4}$ | 0.18 | 1μ |
| 3 (Amorphous layer (I)) | $SiH_4$/He = 1<br>$SiF_4$/He = 1 | $SiH_4$ = 100 | $SiH_4$:$SiF_4$ = 1:1 | 0.18 | 15μ |

EXAMPLE 180

An image forming member was prepared according to the same method as in Example 175 except that the amorphous layer (II) was formed according to the sputtering method under the conditions shown in the Table below, and evaluated similarly to Example 175 to obtain good results.

TABLE 178

| Layer formed | Gases employed | Flow rate (SCCM) | Target area ratio Si wafer:graphite | Discharge power (W/cm$^2$) | Layer thickness (μ) |
|---|---|---|---|---|---|
| Amorphous layer (II) | Ar<br>$SiF_4$/He = 0.5 | Ar = 200<br>$SiF_4$ = 100 | 2.5:7.5 | 0.3 | 1 |

EXAMPLE 181

Image forming members were prepared according to the same conditions and procedures as in Examples 173, 174, 175, 178 and 179 except that the amorphous layer (I) was formed under the conditions shown in the Table below, and evaluated similarly to respective Examples to obtain good results.

TABLE 179

| Layer formed | Gases employed | Flow rate (SCCM) | Flow rate ratio | Discharge power (W/cm$^2$) | Layer thickness (μ) |
|---|---|---|---|---|---|
| Amorphous layer (I) | $SiH_4$/He = 1<br>$B_2H_6$/He = $1 \times 10^{-2}$ | $SiH_4$ = 200 | $SiH_4$:$B_2H_6$ = 1:2 $\times 10^{-5}$ | 0.18 | 15 |

What we claim is:

1. A photoconductive member comprising a support for photoconductive member, an interface layer comprising an amorphous material represented by any of the formulas:

$$Si_aN_{1-a}(0.57<a<1) \quad (1)$$

$$(Si_bN_{1-b})_cH_{1-c}(0.6<b<1,\ 0.65\leqq c<1) \quad (2)$$

$$(Si_dN_{1-d})_e(X,H)_{1-e}(0.6<d<1,\ 0.8\leqq e<1) \quad (3)$$

(wherein X represents a halogen atom),
a rectifying layer comprising an amorphous material containing atoms (A) belonging to the group III or the group V of the periodic table as constituent atoms in a matrix of silicon atoms, and an amorphous layer exhibiting photoconductivity comprising an amorphous material containing at least one of hydrogen atoms and halogen atoms as constituent atoms in a matrix of silicon atoms.

2. A photoconductive member according to claim 1, further comprising an amorphous layer comprising an amorphous material containing at least silicon atoms and carbon atoms as constituent atoms on the amorphous layer exhibiting photoconductivity.

3. A photoconductive member according to claim 2, wherein the amorphous material containing carbon atoms further contains hydrogen atoms as constituent atoms.

4. A photoconductive member according to claim 2, wherein the amorphous material containig carbon atoms further contains halogen atoms as constituent atoms.

5. A photoconductive member according to claim 2, wherein the amorphous material containing carbon atoms further contains hydrogen atoms and halogen atoms as constituent atoms.

6. A photoconductive member according to claim 1, wherein atoms belonging to the group V of the periodic table are contained in the rectifying layer, and atoms belonging to the group III of the periodic table are contained in the amorphous layer exhibiting photoconductivity.

7. A photoconductive member according to claim 1, wherein a substance for controlling the conduction characteristic is contained in the amorphous layer exhibiting photoconductivity.

8. A photoconductive member according to claim 1, wherein the interface layer has a layer thickness of 30 Å to 2μ.

9. A photoconductive member according to claim 1, wherein the rectifying layer has a layer thickness of 0.3 to 5μ.

* * * * *

UNITED STATES PATENT AND TRADEMARK OFFICE

CERTIFICATE OF CORRECTION

PATENT NO. : 4,452,874

DATED : June 5, 1984

INVENTOR(S) : OGAWA, ET AL.

It is certified that error appears in the above-identified patent and that said Letters Patent is hereby corrected as shown below:

Col. 6, line 61, after "preferably" insert --be-- 1st occurrence.
Col. 9, line 11, before "included" insert --be--.
Col. 9, line 31, "comprise" should be --comprises--.
Col. 13, line 20, after "silicon halides" insert --,--.
Col. 14, line 20, before "surface" insert --the--.
Col. 22, Table 6, Column heading Gases employed, 2(Rectifying layer), "$B_2H_6$/He x $10^{-2}$" should be --$B_2H_6$/He = 1 x $10^{-2}$--.
Col. 24, line 13, "cascased" should be --cascaded--.
Col. 34, line 61, "deteriotation" should be --deterioration--.
Col. 40, line 42, the heading "Table 43" should be --Table 33--.
Col. 42, line 47, "a" should be --as--.
Col. 61, Table 66, "

| Image quality evaluation | ▲ | x |
|---|---|---|

should be --

| Image quality evaluation | ▲ | ○ | ◎ | ◎ | ◎ | ○ | x |
|---|---|---|---|---|---|---|---|

--.

Col. 71, line 15, "repititions" should be --repetitions--.
Col. 71, line 10, the heading "Table 67" should be --Table 81--.
Col. 72, line 7, after "similarly" should be --to--.
Col. 72, line 10, in heading "Table 56" should be --Table 83--.
Col. 74, line 4, in heading "Table 59" should be --86--.
Col. 75, line 16, "operation" should be --operations--.
Col. 80, line 23, in heading "Table 67" should be --Table 95--.

UNITED STATES PATENT AND TRADEMARK OFFICE

CERTIFICATE OF CORRECTION

PATENT NO. : 4,452,874

DATED : June 5, 1984

INVENTOR(S) : OGAWA, ET AL.

It is certified that error appears in the above-identified patent and that said Letters Patent is hereby corrected as shown below:

Col. 81, Table 97, Column heading Flow rate (SCCM), 3(Amorphous layer(I), Under Flow rate ratio, "$SiH_4SiF_4$ = 1:1" should be --$SiH_4$:$SiF_4$--.

Col. 81, line 57, "electrophogoraphy" should be --electrophotography--.

Col. 83, line 28, after "same" insert --as--.

Col. 83, line 39, "claning" should be --cleaning--.

Col. 83, line 40, "repeared" should be --repeated--.

Col. 85, Table 104, Column heading, "order of layer formation" should be --Order of layer formation--.

Col. 85, Table 104, Column heading, Gases employed, 2(Rectifying layer),"$SiH_4$/He = 100" should be --$SiH_4$/He = 1--.

Col. 92, line 24, "irraidated" should be --irradiated--.

Col. 99, Table 129, Accross from "3(Amorphous layer (I)), Under Gases employed, insert --$SiF_4$/He = 1--.

Col. 100, line 36, "developed" should be --developer--.

Col. 101, line 29, "sorce" should be --source--.

Col. 101, line 59, "drumshaped" should be --drum-shaped--.

Col. 104, line 46, "obrained" should be --obtained--.

Col. 105, lines 54-55, "developed" should be --developer--.

UNITED STATES PATENT AND TRADEMARK OFFICE

CERTIFICATE OF CORRECTION

PATENT NO. : 4,452,874

DATED : June 5, 1984

INVENTOR(S) : OGAWA, ET AL.

It is certified that error appears in the above-identified patent and that said Letters Patent is hereby corrected as shown below:

Col. 117, Table 163,"

TABLE 163

| Order of layer formation | Condition: Gases employed | Flow rate (SCCM) | Flow rate ratio | Discharge power ($W/cm^2$) | Layer thickness |
|---|---|---|---|---|---|
| 1 (Interface layer) | $SiH_4/He = 1$ $SiF_4/He = 1$ $NH_3$ | $SiH_4 = 100$ | $SiH_4:SiF_4:NH_3 =$ 1:1:1 | 0.18 | 500 Å |
| 2 (Rectifying layer) | $SiH_4/He = 1$ $PH_3/He = 1 \times 10^{-2}$ | $SiH_4 = 200$ $1.5 \times 10^{-4}$ | $SiH_4:PH_3 =$ | 0.18 | 4000 Å |
| 3 (Amorphous layer(I)) | $SiH_4/He = 1$ | $SiH_4 = 200$ | | 0.18 | 15μ |
| 4 (Amorphous layer(II)) | $SiH_4/He = 0.5$ $C_2H_4$ | $SiH_4 = 100$ | $SiH_4:C_2H_4 =$ 3:7 | 0.18 | 0.5μ |

should be

--

Table 163

| Condition / Order of layer formation | Gases employed | Flow rate (SCCM) | Flow rate ratio | Discharge power ($W/cm^2$) | Layer thickness |
|---|---|---|---|---|---|
| 1 (Interface layer) | $SiH_4/He=1$ $SiF_4/He=1$ $NH_3$ | $SiH_4=100$ | $SiH_4:SiF_4:NH_3$ =1:1:1 | 0.18 | 500 Å |
| 2 (Rectifying layer) | $SiH_4/He=1$ $PH_3/He=1x10^{-2}$ | $SiH_4=200$ | $SiH_4:PH_3$ $=1.5x10^{-4}$ | 0.18 | 4000 Å |
| 3 (Amorphous layer(I)) | $SiH_4/He=1$ | $SiH_4=200$ | | 0.18 | 15 μ |
| 4 (Amorphous layer(II)) | $SiH_4/He=0.5$ $C_2H_4$ | $SiH_4=100$ | $SiH_4:C_2H_4$ =1:7 | 0.18 | 0.5 μ |

--.

UNITED STATES PATENT AND TRADEMARK OFFICE

CERTIFICATE OF CORRECTION

PATENT NO. : 4,452,874

DATED : June 5, 1984

INVENTOR(S) : OGAWA, ET AL.

It is certified that error appears in the above-identified patent and that said Letters Patent is hereby corrected as shown below:

Col. 119, Table 164, Column heading, Flow rate ratio, 2(Rectifying layer), "1:1 x $10^{-2}$" should be --1:1 x $10^{-3}$--.
Col. 124, line 55, "obtainedtoner" should be --obtained toner--.
Col. 125, Table 173-continued, Column heading, Layer thickness, 4(Amorphous layer (II), "0.5μ" should be --1.5μ--.
Col. 125, Table 174, Column 6, "0.2:0.3.9.5" should be --0.2:0.3:9.5--.
Col. 128, Claim 4, line 33, "containig" should be --containing--.

Signed and Sealed this

*Thirtieth* Day of *April 1985*

[SEAL]

*Attest:*

DONALD J. QUIGG

*Attesting Officer* *Acting Commissioner of Patents and Trademarks*